US012703964B2

(12) United States Patent
Wells et al.

(10) Patent No.: US 12,703,964 B2
(45) Date of Patent: Aug. 11, 2026

(54) TOOTH ASSEMBLIES FOR GROUND ENGAGING TOOLS

(71) Applicant: CATERPILLAR INC., Peoria, IL (US)

(72) Inventors: Corey Michael Wells, East Peoria, IL (US); Eric Thomas Sinn, Tremont, IL (US); Brandon Hammig McCaffrey, St. Louis, IL (US); William Jay Ulrich, IV, East Peoria, IL (US); Douglas Charles Serrurier, Morton, IL (US); Thomas M. Congdon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 432 days.

(21) Appl. No.: 18/356,282

(22) Filed: Jul. 21, 2023

(65) Prior Publication Data

US 2025/0027296 A1 Jan. 23, 2025

(51) Int. Cl.
*E02F 9/28* (2006.01)

(52) U.S. Cl.
CPC ..... *E02F 9/2858* (2013.01); *E02F 9/2825* (2013.01); *E02F 9/2883* (2013.01)

(58) Field of Classification Search
CPC ..... E02F 9/2858; E02F 9/2883; E02F 9/2825; E02F 9/2833; E02F 9/2808; E02F 9/2816
See application file for complete search history.

(56) References Cited

U.S. PATENT DOCUMENTS

| | | | | |
|---|---|---|---|---|
| 5,937,550 | A | 8/1999 | Emrich | |
| 7,980,011 | B2 * | 7/2011 | Ruvang | E02F 9/2825 37/452 |
| 8,844,175 | B2 | 9/2014 | Snyder | |
| 9,290,915 | B2 * | 3/2016 | Marchand | E02F 9/2825 |
| 9,677,252 | B2 | 6/2017 | Simpson et al. | |
| 9,822,511 | B2 | 11/2017 | Tuto Faja et al. | |
| 10,508,418 | B2 * | 12/2019 | Bilal | E02F 9/2858 |
| 10,995,478 | B2 | 5/2021 | Bilal et al. | |

(Continued)

FOREIGN PATENT DOCUMENTS

| | | |
|---|---|---|
| AU | 2013200095 B2 | 1/2013 |
| AU | 2017264874 | 12/2018 |

(Continued)

*Primary Examiner* — Christopher J Sebesta
*Assistant Examiner* — Blake E Scoville

(57) ABSTRACT

A ground engaging tip assembly includes a ground engaging tip, an adapter, and a retention mechanism. The ground engaging tip includes an inner surface extending inward from a rear edge defining a nose cavity within the ground engaging tip. The nose cavity includes a front inner surface, top inner surface, bottom inner surface, and oppositely disposed side inner surfaces. The top inner surface includes a front portion proximate the front inner surface comprising a front central surface connecting two opposing front side-sloping surfaces and a rear portion proximate the rear edge comprising a rear central surface connecting two opposing rear side-sloping surfaces. The bottom includes a tapered bottom channel. The adapter includes a nose portion configured to be inserted into the nose cavity of the ground engaging tip. The retention mechanism is configured to secure the ground engaging tip to the adapter.

20 Claims, 55 Drawing Sheets

(56) References Cited

U.S. PATENT DOCUMENTS

| | | | | |
|---|---|---|---|---|
| 2013/0247428 | A1* | 9/2013 | Hughes | E02F 9/2825 37/455 |
| 2017/0328035 | A1* | 11/2017 | Bilal | E02F 9/2833 |
| 2022/0290413 | A1 | 9/2022 | Roska et al. | |

FOREIGN PATENT DOCUMENTS

| | | | | | |
|---|---|---|---|---|---|
| CA | 2945618 | C | * | 6/2021 | E02F 9/2858 |
| EP | 1314826 | | | 6/2006 | |
| JP | 2017203365 | | | 11/2017 | |
| WO | 2022/0256869 | A1 | | 12/2022 | |
| WO | WO-2022256869 | A1 | * | 12/2022 | E02F 9/2883 |

* cited by examiner

TOOTH ASSEMBLIES FOR GROUND ENGAGING TOOLS

TECHNICAL FIELD

The present disclosure relates generally to earth working machines with ground engaging implements, and, in particular, to tooth assemblies with replaceable tip and adapter systems attached to the leading or base edges of such ground engaging implements.

BACKGROUND

Earth-working machines such as, for example, excavators, wheel loaders, hydraulic mining shovels, cable shovels, bucket wheels, bulldozers, and draglines are generally used for digging or ripping into the earth or rock and/or moving loosened work material from one place to another on a worksite. These earth-working machines include various earth-working implements, such as a bucket or a blade, for excavating or moving the work materials. These implements can be subjected to extreme wear from the abrasion and impacts experienced during earth-working applications.

To facilitate the earth-moving process and to prolong the useful life of the implement, a plurality of tip assemblies may be placed along the base edge of the implement and attached to the surface of the implement. The tip assemblies project forward from the base edge as a first point of contact and penetration with the work material and reduce the amount of wear on the base edge. With this arrangement, the tip assemblies may be subjected to the wear and breakage caused by repetitive engagement with the work material. Eventually the tip assemblies must be replaced, but the implement may remain useable through multiple cycles of replacement of the tip assemblies. Depending on the variety of uses and work materials for the equipment, it may also be desirable to change the type or shape of the tip assemblies to most effectively utilize the implement.

Installation and replacement of the tip assemblies may be facilitated by providing the tip assemblies in a two-part system. The system may include an adapter that is attached to the base edge of the implement and a ground engaging tip configured to be attached to the adapter. The adapter and the ground engaging tip may be connected by a retention mechanism. The adapter may be welded, bolted, or otherwise secured to the base edge and the tip.

U.S. Patent Publication No. 2022/0290413 A1 ("the '413 application") of Michael B. Roska et al. published on Sep. 15, 2022 and discloses a wear assembly including a base having a nose and a wear member having a socket. The nose and socket of the '413 application include complementary stabilizing surfaces in the front and rear portions. Both the front portion and rear portion include bearing surfaces. For example, the front portion includes a first front bearing surface on a top or bottom side of the mounting cavity, two second front bearing surfaces on the top or bottom side of the mounting cavity opposite the first front bearing surface, and a front bearing wall transverse to the front bearing surfaces at a front end of the mounting cavity. The rear portion, meanwhile, includes a first rear bearing surface on the top or bottom side of the mounting cavity opposite the first front bearing surface, and two second rear bearing surfaces on the top or bottom side of the mounting cavity opposite the first rear bearing surface.

The '413 application may provide a base nose and socket with complementary bearing surfaces. The '413 application, however, may not maximize bearing surface contact area and frictional forces under load or properly support load conditions from each direction, resulting in increased stress on the nose and wear member, increased relative motion between the nose and wear member, increased concentration of wear leading to early failure, and increased load on the retention mechanism.

The present disclosure is directed to overcoming one or more of the shortcomings set forth above and/or other problems of the prior art.

SUMMARY

In one aspect, the present disclosure is directed to a ground engaging tip. The ground engaging tip may include a rear edge, a top outer surface extending forward from the rear edge, a bottom outer surface extending forward from the rear edge and converging with the top outer surface at a front edge, and oppositely disposed lateral outer surfaces extending downwardly from the top outer surface to the bottom outer surface. The ground engaging tip may further include an inner surface extending inwardly into the ground engaging tip from the rear edge and defining a nose cavity within the ground engaging tip. The nose cavity may include a front inner surface, a top inner surface, a bottom inner surface, and oppositely disposed side inner surfaces extending downward from the top inner surface to the bottom inner surface. The top inner surface may extend rearwardly from the front inner surface toward the rear edge of the ground engaging tip and may include a front portion proximate the front inner surface comprising a front central surface connecting two opposing front side-sloping surfaces and a rear portion proximate the rear edge comprising a rear central surface connecting two opposing rear side-sloping surfaces. The bottom inner surface may extend rearwardly from the front inner surface toward the rear edge of the ground engaging tip and may include a tapered bottom channel.

In another aspect, the present disclosure is directed to a ground engaging tip. The ground engaging tip may include a rear edge, a top outer surface extending forward from the rear edge, a bottom outer surface extending forward from the rear edge and converging with the top outer surface at a front edge, and oppositely disposed lateral outer surfaces extending downwardly from the top outer surface to the bottom outer surface. The ground engaging tip may further include an inner surface extending inwardly into the ground engaging tip from the rear edge and defining a nose cavity within the ground engaging tip. The nose cavity may include a front inner surface, a top inner surface, a bottom inner surface, and oppositely disposed side inner surfaces extending downward from the top inner surface to the bottom inner surface. The top inner surface may extend rearwardly from the front inner surface toward the rear edge of the ground engaging tip and may include a front portion proximate the front inner surface comprising a front central surface connecting two opposing front side-sloping surfaces and a rear portion proximate the rear edge comprising a rear central surface connecting two opposing rear side-sloping surfaces. The bottom inner surface may extend rearwardly from the front inner surface toward the rear edge of the ground engaging tip and is symmetrical to the top inner surface across a substantially longitudinal axis.

In yet another aspect, the present disclosure is directed to a ground engaging tip assembly. The ground engaging tip assembly may include a ground engaging tip, an adapter, and a retention mechanism. The ground engaging tip may include a rear edge, a top outer surface extending forward from the rear edge, a bottom outer surface extending forward from the rear edge and converging with the top outer surface at a front edge, and oppositely disposed lateral outer surfaces extending downwardly from the top outer surface to the bottom outer surface. The ground engaging tip may further include an inner surface extending inwardly into the ground engaging tip from the rear edge and defining a nose cavity within the ground engaging tip. The nose cavity may include a front inner surface, a top inner surface, a bottom inner surface, and oppositely disposed side inner surfaces extending downward from the top inner surface to the bottom inner surface. The top inner surface may extend rearwardly from the front inner surface toward the rear edge of the ground engaging tip and may include a front portion proximate the front inner surface comprising a front central surface connecting two opposing front side-sloping surfaces and a rear portion proximate the rear edge comprising a rear central surface connecting two opposing rear side-sloping surfaces. The bottom inner surface may extend rearwardly from the front inner surface toward the rear edge of the ground engaging tip and may include a tapered bottom channel. The adapter may include a nose portion with a shape corresponding to the inner surface of the ground engaging tip configured to be inserted into the nose cavity of the ground engaging tip. The retention mechanism may be configured to secure the ground engaging tip to the adapter

DETAILED DESCRIPTION

Although the following text sets forth a detailed description of numerous different embodiments of the invention, it should be understood that the detailed description is to be construed as exemplary only and does not describe every possible embodiment of the invention. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

Figure 1:
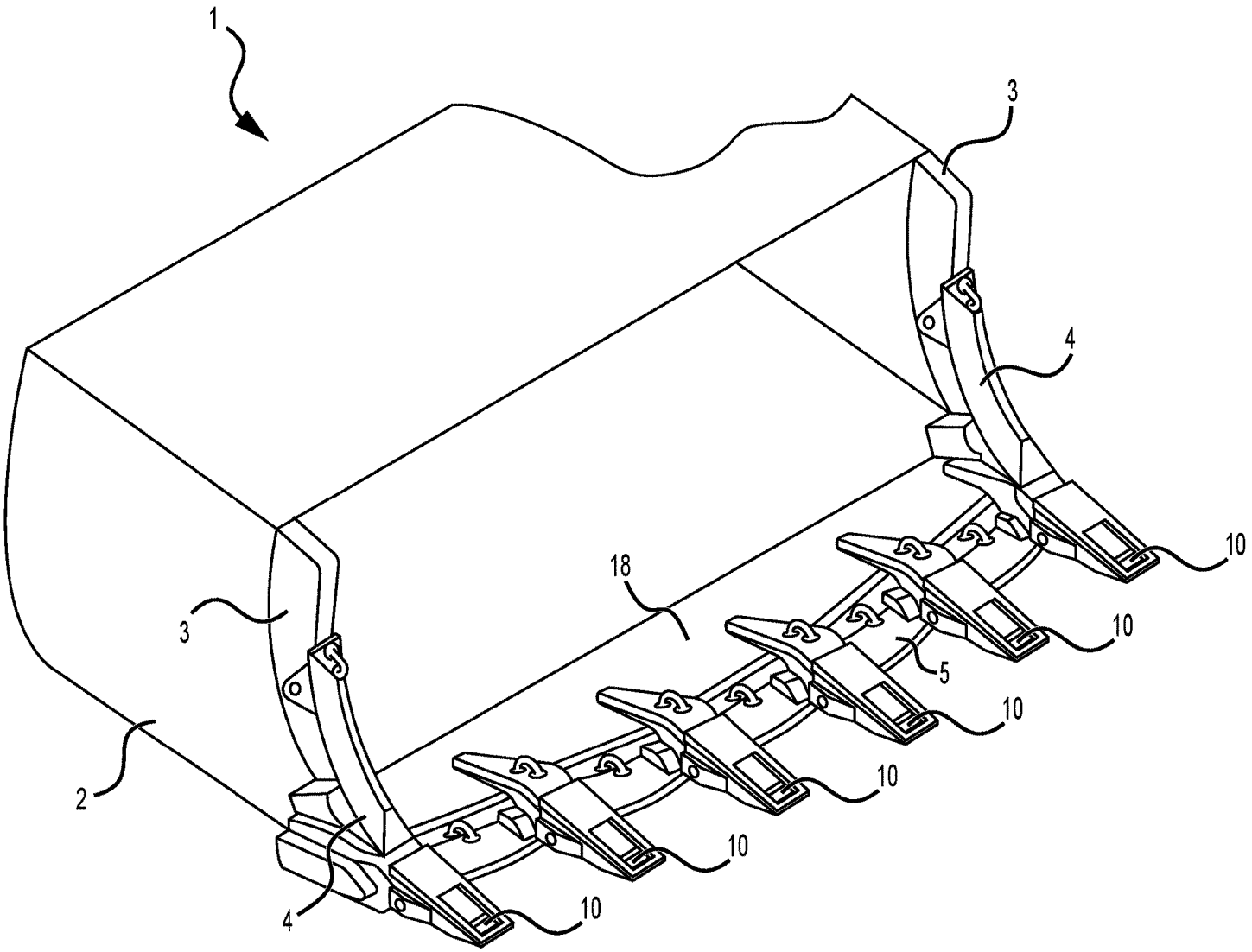
FIG. 1 is an isometric view of an exemplary loader bucket assembly having tip assemblies in accordance with the present disclosure.

Referring now to FIG. 1, there is shown an implement for a bottom-wearing application, such as a loader machine, in the form of an exemplary loader bucket assembly 1 that incorporates the features of the present disclosure. The loader bucket assembly 1 includes a loader bucket 2 which is partially shown in FIG. 1. The loader bucket 2 is used on the loader machine to excavate material. The loader bucket assembly 1 may include a pair of oppositely-disposed support arms 3 on which corresponding protector assemblies 4 may be mounted. The loader bucket assembly 1 may further include a number of edge protector assemblies 5 interposed between tip assemblies 10 in accordance with the present disclosure, with the edge protector assemblies 5 and the tip assemblies 10 being secured along a base edge 18 of the loader bucket 2.

Figure 2:
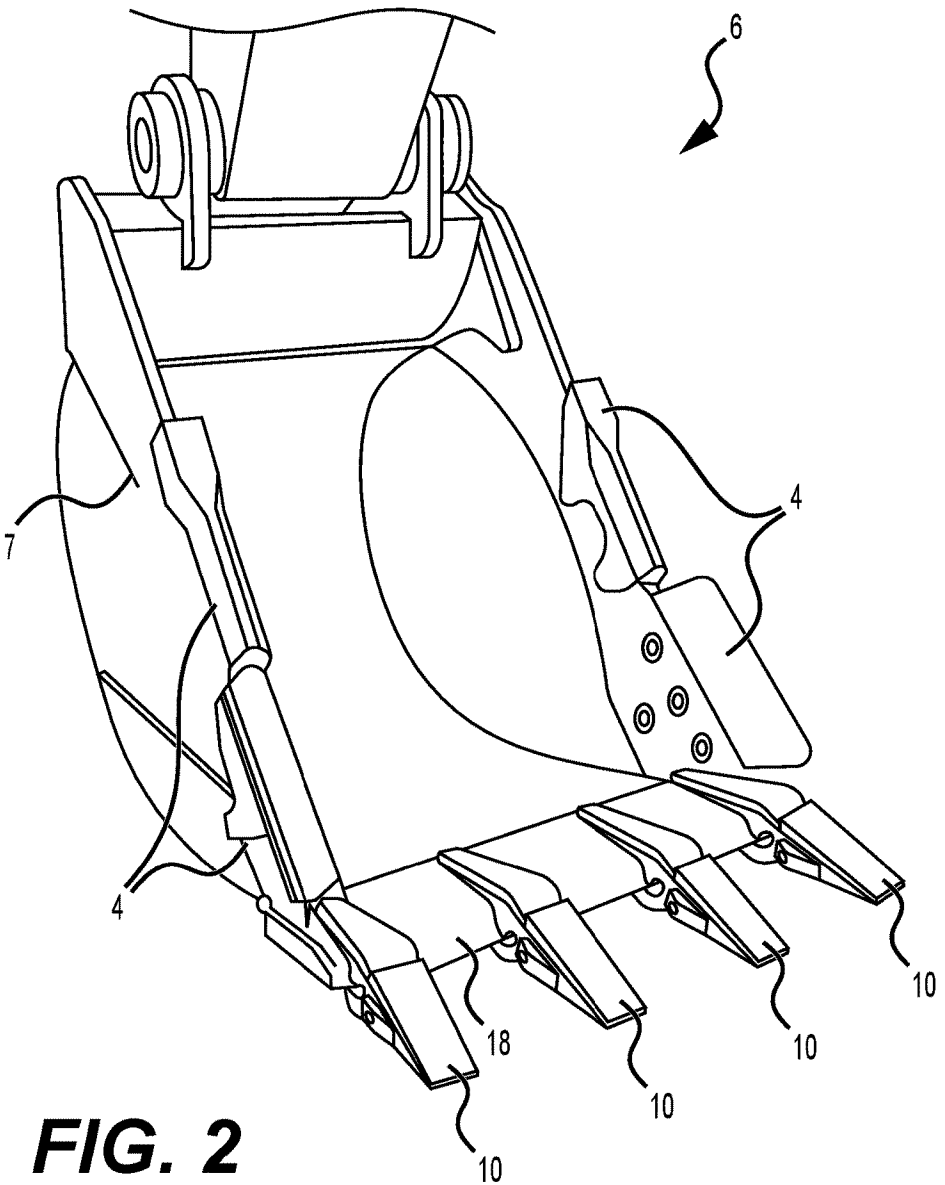
FIG. 2 is an isometric view of an exemplary excavator bucket assembly having tip assemblies in accordance with the present disclosure.

FIG. 2 illustrates an implement for a top-wearing application, such as an excavator, in the form of an exemplary excavator bucket assembly 6. The excavator bucket assembly 6 includes an excavator bucket 7 having protector assemblies 4 connected on either side, and a plurality of tip assemblies 10 attached across the base edge 18 of the excavator bucket 7. Various embodiments of tip assemblies are described herein that may be implemented in bottom-wearing and top-wearing applications. Even where a particular tip assembly or component embodiment is described with respect to a particular bottom-wearing or top-wearing application, it should be understood that the tip assemblies are not limited to a particular type of application and may be interchangeable between implements of various applications, and such interchangeability is contemplated for tip assemblies in accordance with the present disclosure. Although bottom-wearing and top-wearing applications have been described above, it is to be understood that the disclosed embodiments are not limited to the described applications. Rather, the disclosed embodiments may be used on implements used in other types of applications (e.g., front-wearing applications, end-wearing applications, or any other applications for which such implements may be used).

Figure 3:
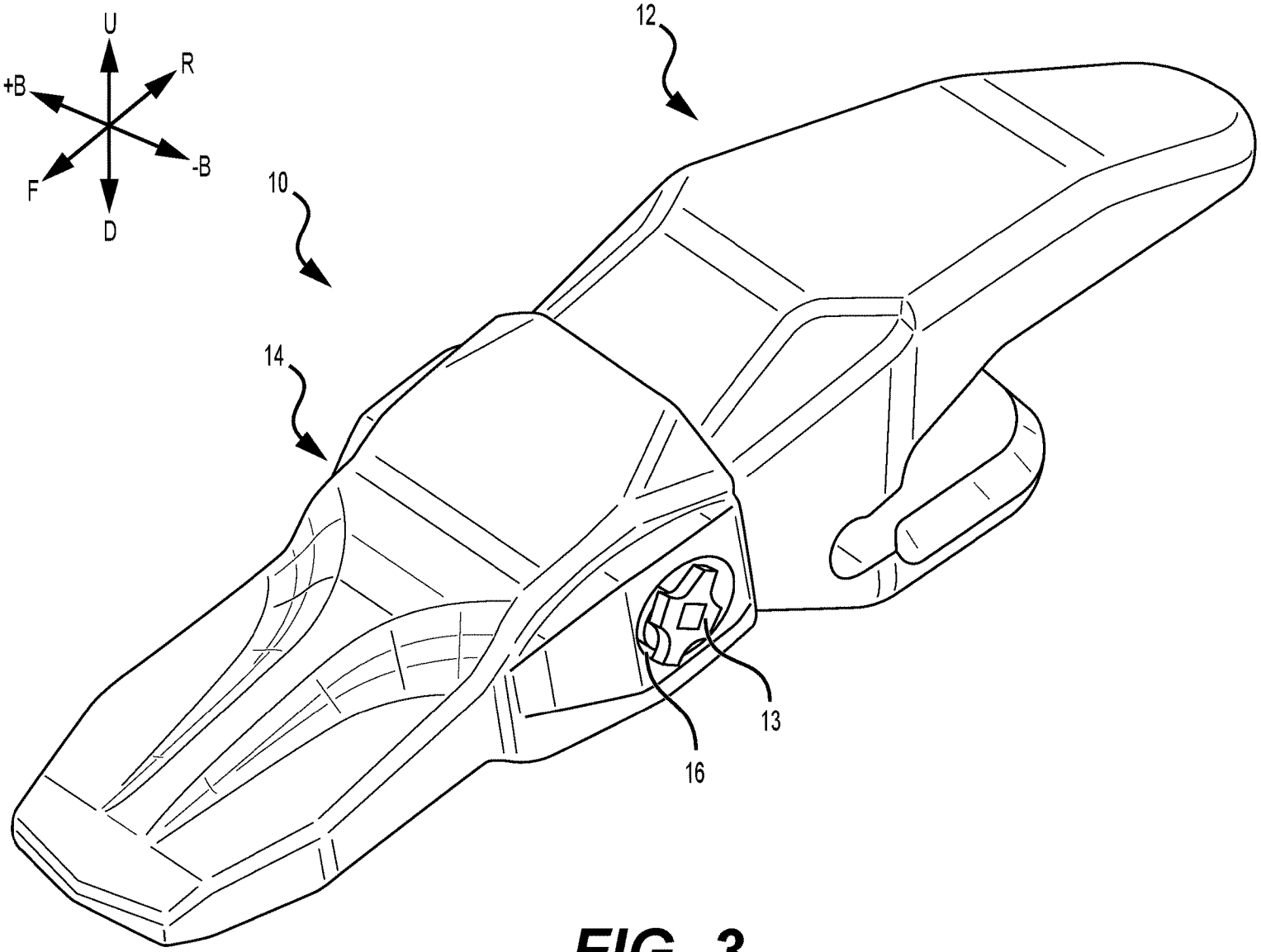
FIG. 3 is an isometric view of an exemplary tip assembly in accordance with the present disclosure.

FIG. 3 illustrates an embodiment of a tip assembly 10 in accordance with the present disclosure that may be useful with earth moving implements, and have particular use in top-wearing applications. The tip assembly 10 may be used on multiple types of ground engaging implements having base edges 18 (FIGS. 1, 2). The tip assembly 10 includes an adapter 12 configured for attachment to a base edge 18 of the loader bucket assembly 1 and/or excavator bucket assembly 6 (FIGS. 1 and 2, respectively), and a tip 14 configured for attachment to the adapter 12. The tip assembly 10 further includes a retention mechanism 13 configured to secure the tip 14 to the adapter 12. The retention mechanism 13 may utilize aspects of the adapter 12 and tip 14, such as retention apertures 16 in the sides of the tip 14 and/or the adapter 12. It is contemplated that a variety of retention mechanisms may be implemented in the tip assemblies 10 according to the present disclosure, and the tip assemblies 10 are not limited to any particular retention mechanism(s). Various directions, for example, forward "F", rearward "R", up or upward "U", down or downward "D", and transverse "+B" and "−B" are illustrated in FIG. 3 and in some of the other figures. Directions F and R are opposite to each other. Likewise, directions U and D are opposite to each other. Directions F and R are generally perpendicular to both of directions U and D, and vice-versa. Directions +B and −B are generally perpendicular to each of directions F, R, U, and D. The directions F, R, U, D, +B, and −B will be used to describe various geometrical features in the following description. It is to be understood that terms like forward, rearward, upward, downward, and transverse indicate relative directions and should not be interpreted as requiring a particular direction relative to, for example, a gravitational direction.

Asymmetrical Adapter (FIGS. 4-11 and 33-39)

Figure 4:
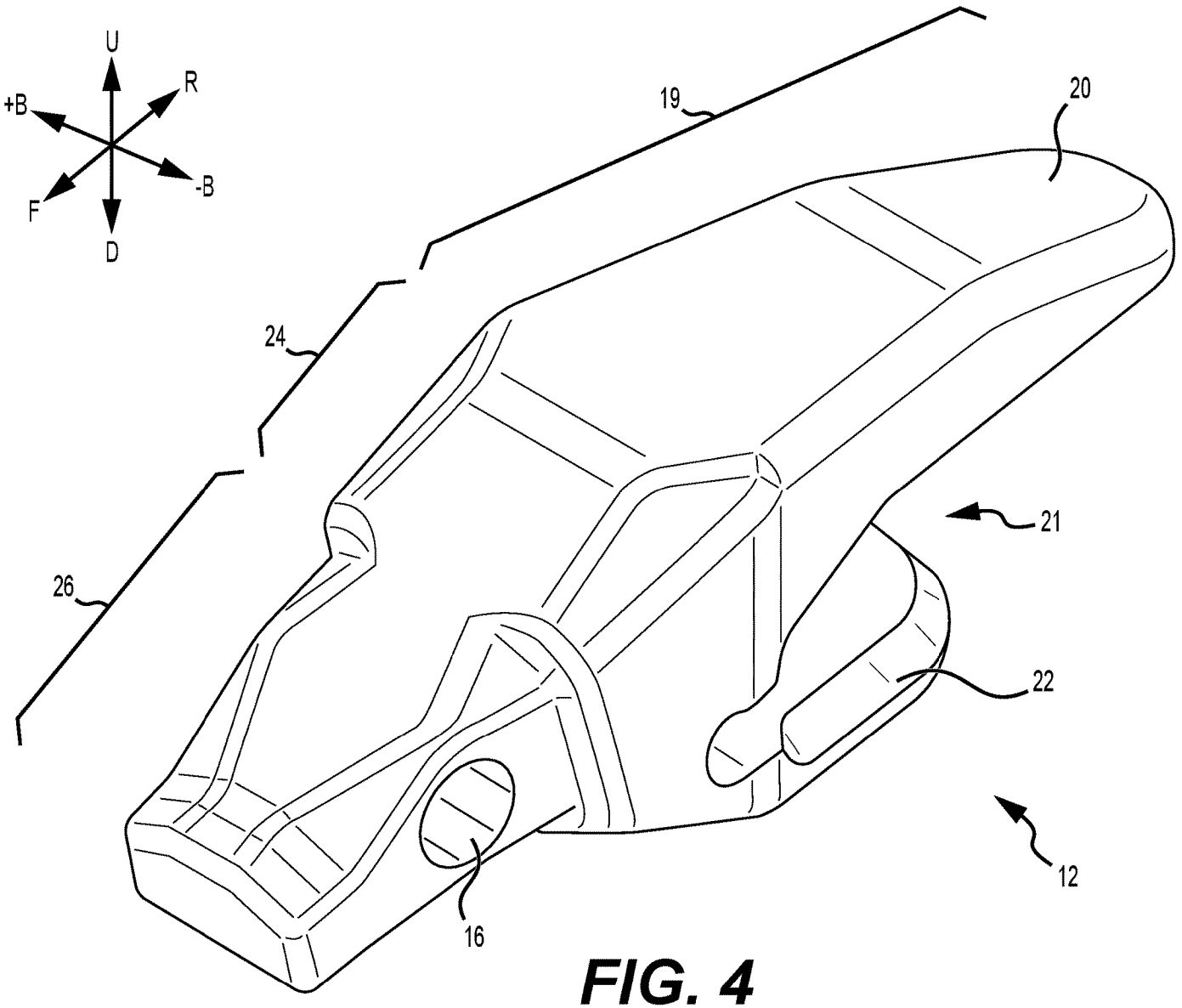
FIG. 4 is an isometric view of an exemplary adapter in accordance with the present disclosure.

An exemplary embodiment of adapter 12 is shown in greater detail in FIGS. 4-11 and 33-39. FIG. 4 is an isometric view of an exemplary adapter 12. Referring to FIG. 4, the adapter 12 may include a rear portion 19 having a top strap 20 and a bottom strap 22, an intermediate portion 24, and a nose 26 disposed at the front or forward position (e.g., towards direction F) of the adapter 12. The top strap 20 and the bottom strap 22 may define a gap 21 therebetween for receiving the base edge 18 (FIGS. 1, 2) of the loader bucket assembly 1 and/or excavator bucket assembly 6. The nose 26 may include one or more retention apertures 16 configured to interface with retention mechanism 13 (FIG. 3) to secure the adapter 12 to the tip 14. The retention apertures 16 may comprise, for example, through-holes or indentations configured to accept the retention mechanism 13. The retention apertures 16 may further comprise threading and/or internal recesses. Similarly, in some exemplary embodiments, retention apertures in nose 26, corresponding to retention apertures 16, may also include threading and/or internal recesses.

Figure 5:
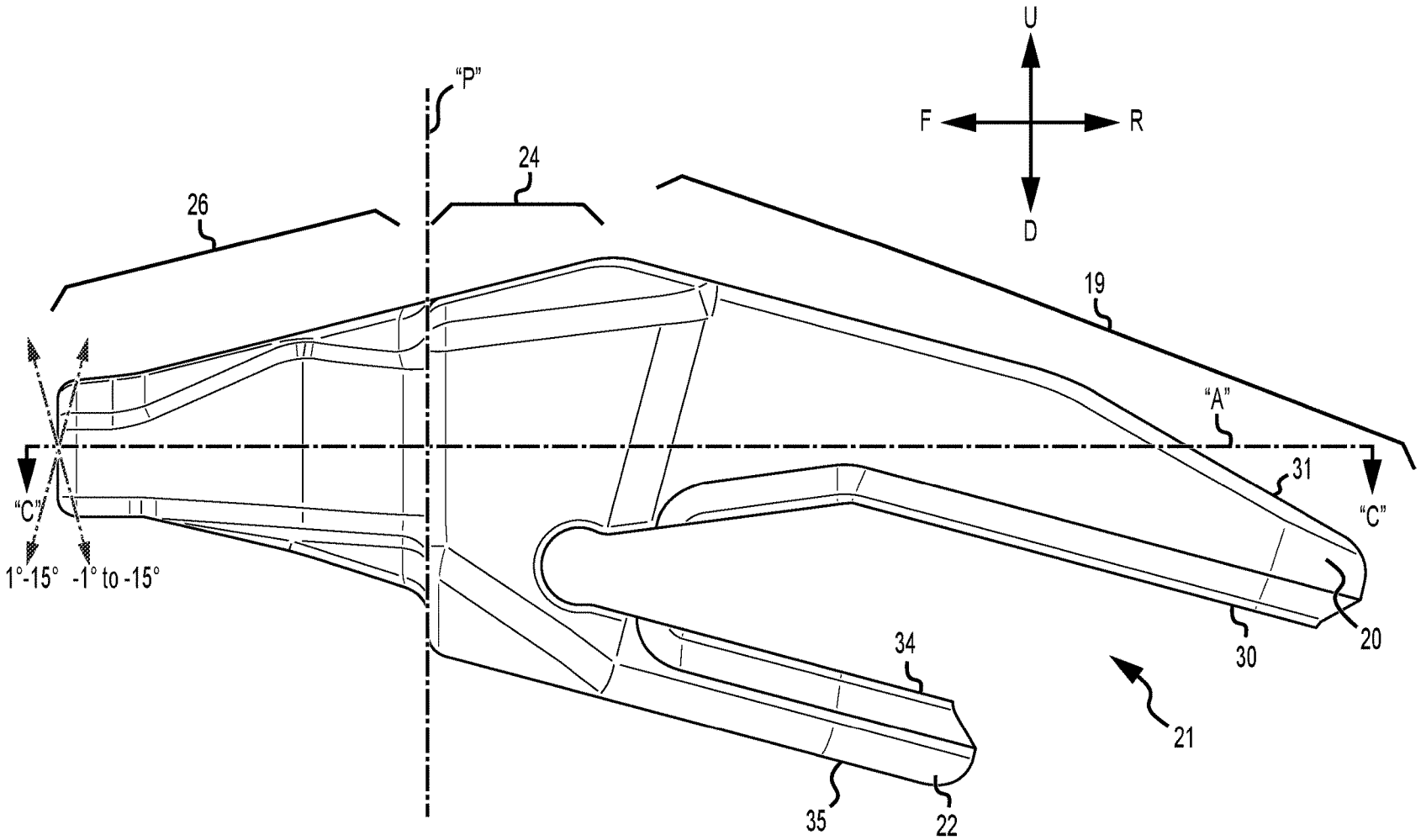
FIG. 5 is a side view of the adapter of FIG. 4 in accordance with the present disclosure.

FIG. 5 illustrates a side view of the adapter 12 of FIG. 4. As shown in FIG. 5, the top strap 20 may have a bottom surface 30 facing the gap 21 and a top surface 31. The bottom strap 22 may have a top surface 34 facing the gap 21 and a bottom surface 35. The adapter 12 may be secured in place on the base edge 18 (FIGS. 1, 2) of the loader bucket assembly 1 or excavator bucket assembly 6 by attaching the top strap 20 and the bottom strap 22 to the base edge 18 using any connection method or mechanism known to those skilled in the art. In one exemplary embodiment, the top strap 20, bottom strap 22, and base edge 18 may have corresponding apertures (not shown) through which fasteners (not shown) such as bolts or rivets may be inserted to hold the adapter 12 in place. Alternatively, the top strap 20 and bottom strap 22 may be welded the base edge 18 so that the adapter 12 and the base edge 18 do not move relative to each other during use. To reduce the impact of the top and bottom surface welds on the strength of the metal of the base edge 18, the top strap 20 and bottom strap 22 may be configured with different shapes so as to minimize the overlap of the welds formed on the top surface and bottom surface of the base edge 18.

It is contemplated that other connection configurations for the adapter 12 may be provided as alternatives to the top strap 20 and bottom strap 22 illustrated and described above. For example, the rear portion 19 of the adapter 12 may be provided with a single top strap 20 and no bottom strap 22, with the top strap 20 being attached to the top surface of the base edge 18 (FIGS. 1, 2). Conversely, a single bottom strap 22 and no top strap 20 may be provided, with the bottom strap 22 being attached to the bottom surface of the base edge 18. As a further alternative, a single center strap may be provided on the rear portion of the adapter 12, with the center strap being inserted into a gap in the base edge 18 of the loader bucket assembly 1 or excavator bucket assembly 6.

The intermediate portion 24 of the adapter 12 may provide a transition between the rear portion 19 and the nose 26. Intermediate portion 24 may extend between rear portion 19 and a rear end of nose 26 as defined by a vertical plane "P" that may be disposed generally perpendicular to a longitudinal axis "A" passing through nose 26. Longitudinal axis "A" may be positioned midway between sides of nose 26 as will be explained below. The nose 26 may be configured to be received by a corresponding nose cavity 126 (FIG. 19) of the tip 14 as will be described more fully below. Plane "P" may be positioned along longitudinal axis "A" at a location where nose 26 of adapter 12 may have its largest cross-sectional area prior to transitioning to intermediate portion 24. Plane P may also be generally perpendicular to longitudinal axis A.

Figure 6:
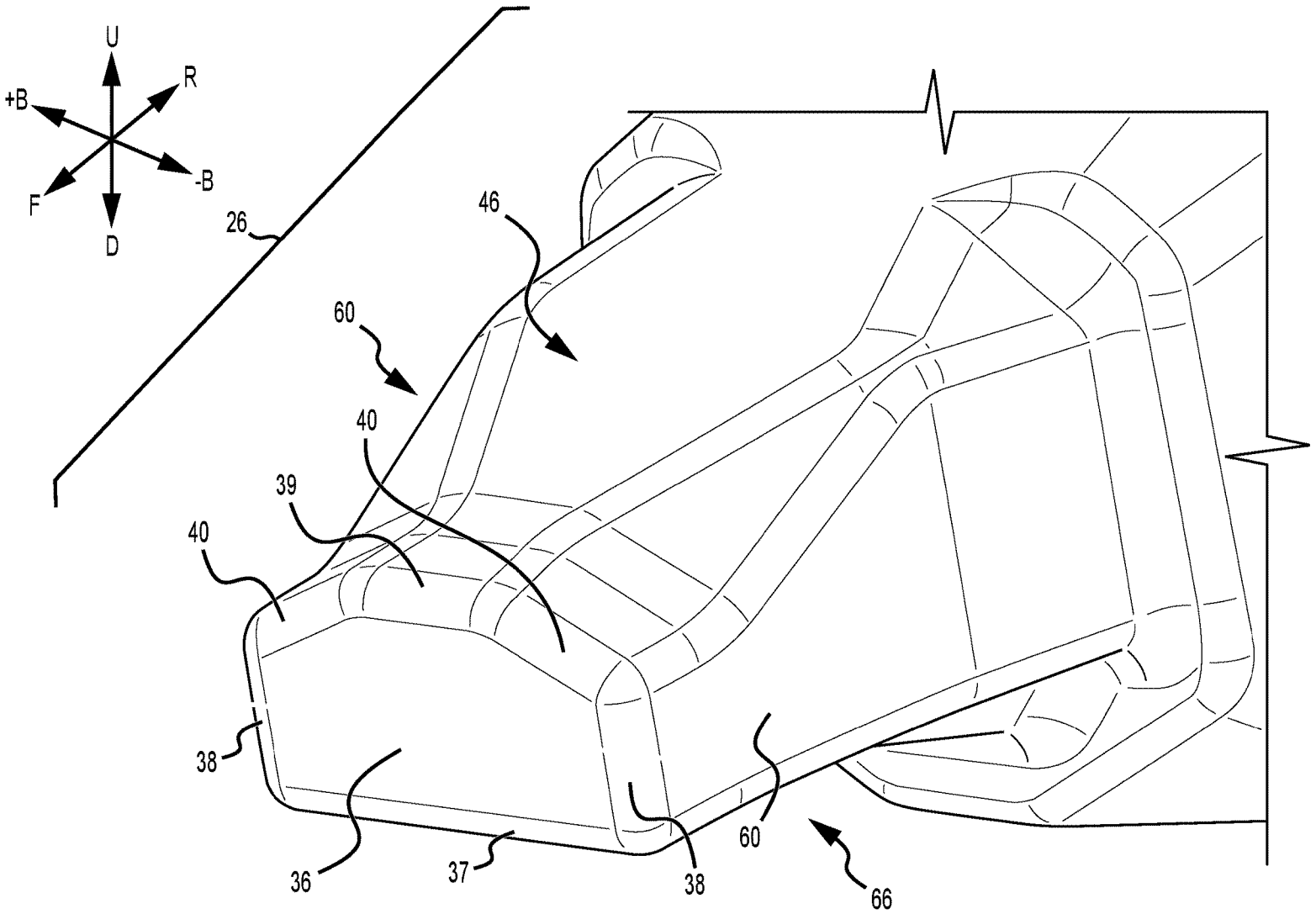
FIG. 6 is an isometric view of a nose of the adapter of FIG. 4 in accordance with the present disclosure.
Figure 7:
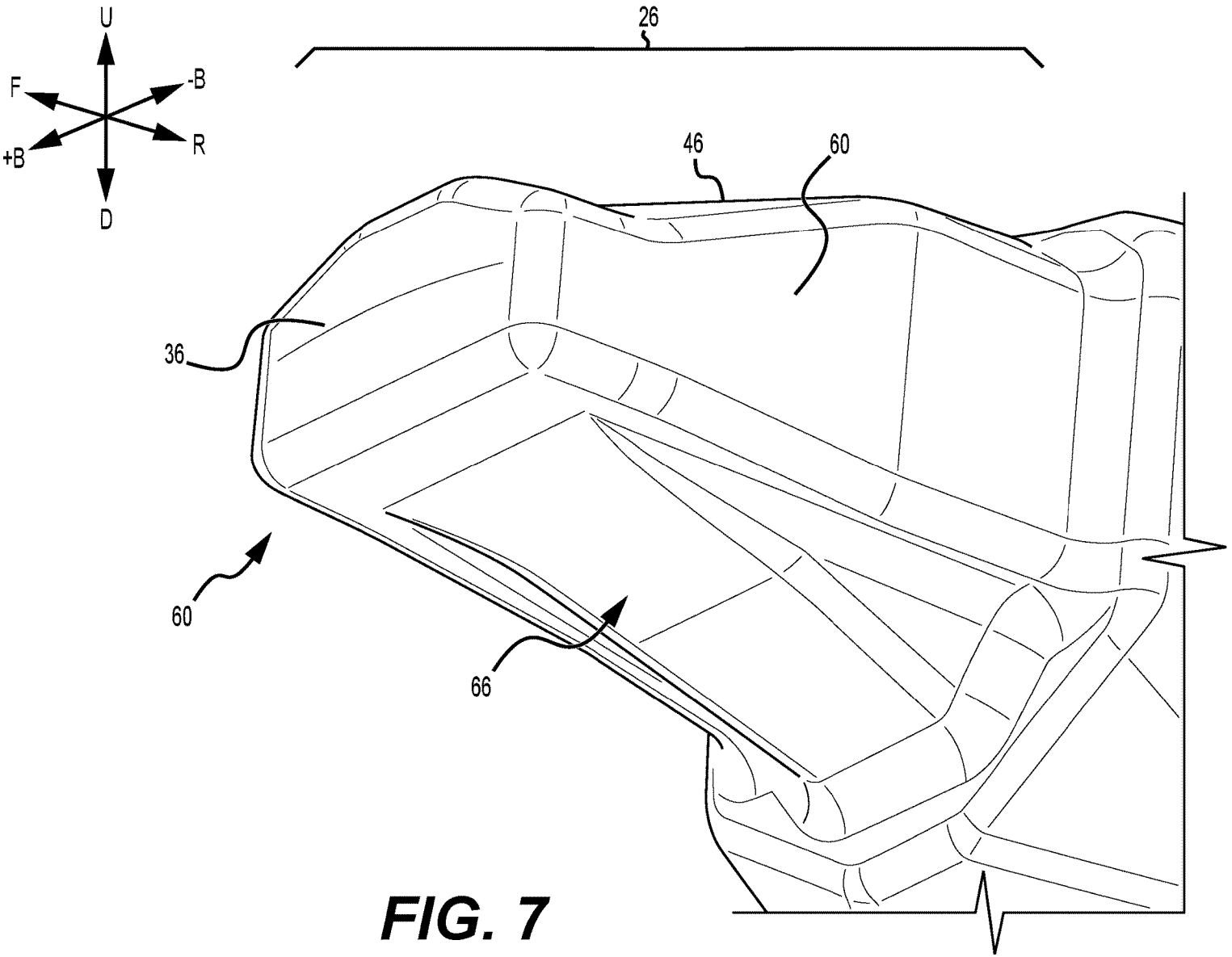
FIG. 7 is another isometric view of the nose of the adapter of FIG. 4 in accordance with the present disclosure.

FIGS. 6 and 7 illustrate isometric views of the nose 26 of adapter 12 of FIG. 4. As shown in FIGS. 6 and 7, the nose 26 may have a front surface 36, a top surface 46, opposing side surfaces 60, and a bottom surface 66. In one embodiment, the side surfaces 60 may have corresponding retention apertures 16 (e.g., similar to FIG. 3) into which a retention mechanism 13 (e.g., similar to FIG. 3) may be inserted to hold the tip 14 in place on the nose 26 of the adapter 12.

The front surface 36 of the nose 26 may include a generally planar portion surrounded by curved edge portions, as shown in FIG. 6. The planar portion of front surface 36 may be oriented generally perpendicular to a substantially longitudinal axis "A" (FIG. 5) that may be centered between the opposing side surfaces 60 (FIG. 6) of the nose 26 and perpendicular to a vertical plane "P" (FIG. 5) defining the rear of the nose 26 of the adapter 12. Alternatively, the planar portion of front surface 36 may be angled at an angle of 1° to 5° in counterclockwise direction relative to plane "P" or −1° to −15° in a clockwise direction relative to plane P. In some exemplary embodiments, front surface 36 may include a degree of curvature (e.g., may have a curved surface surrounded by curved edge portions) as illustrated in FIG. 7.

Figure 8:
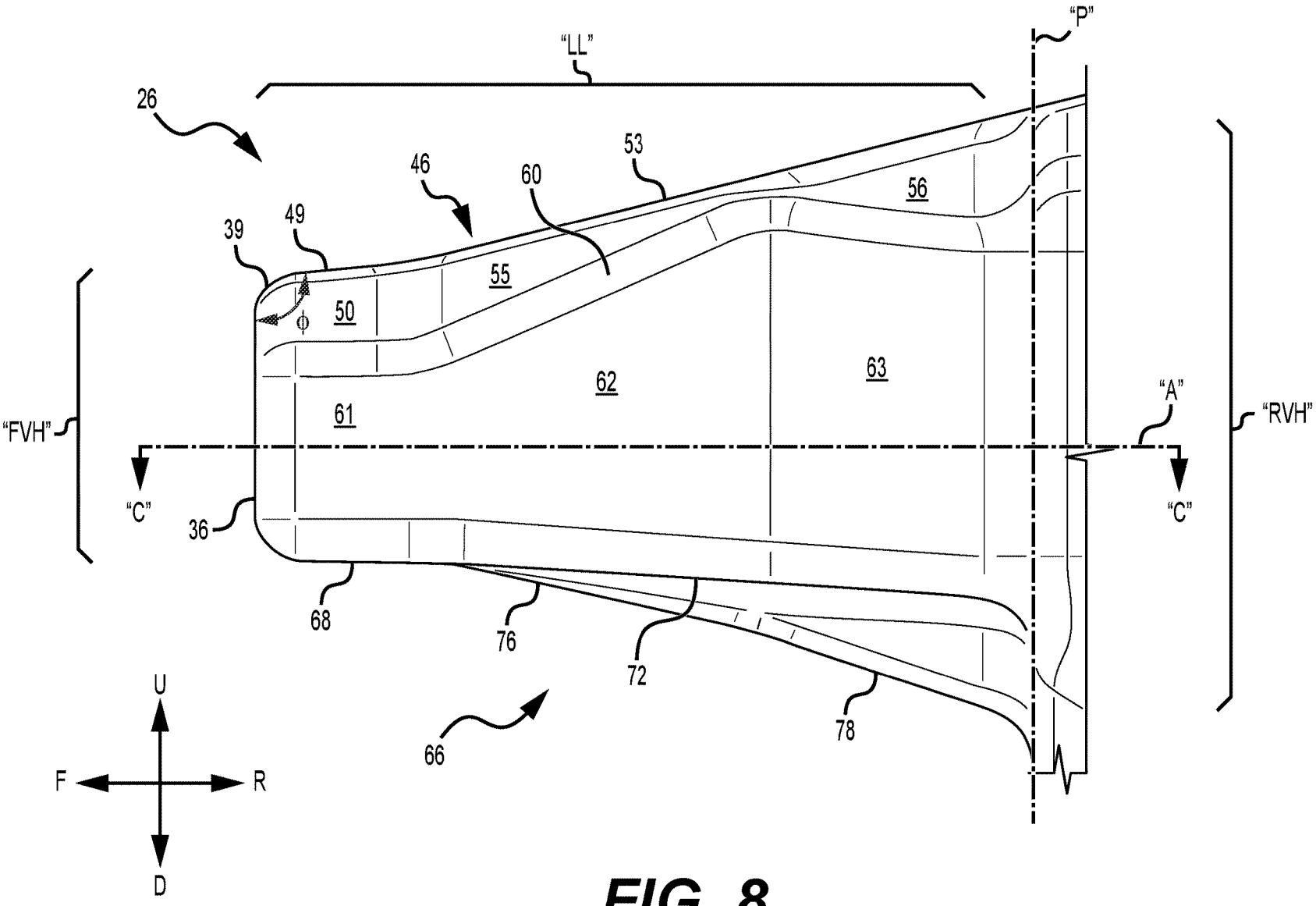
FIG. 8 is a side view of the nose of the adapter of FIG. 4 in accordance with the present disclosure.
Figure 9:
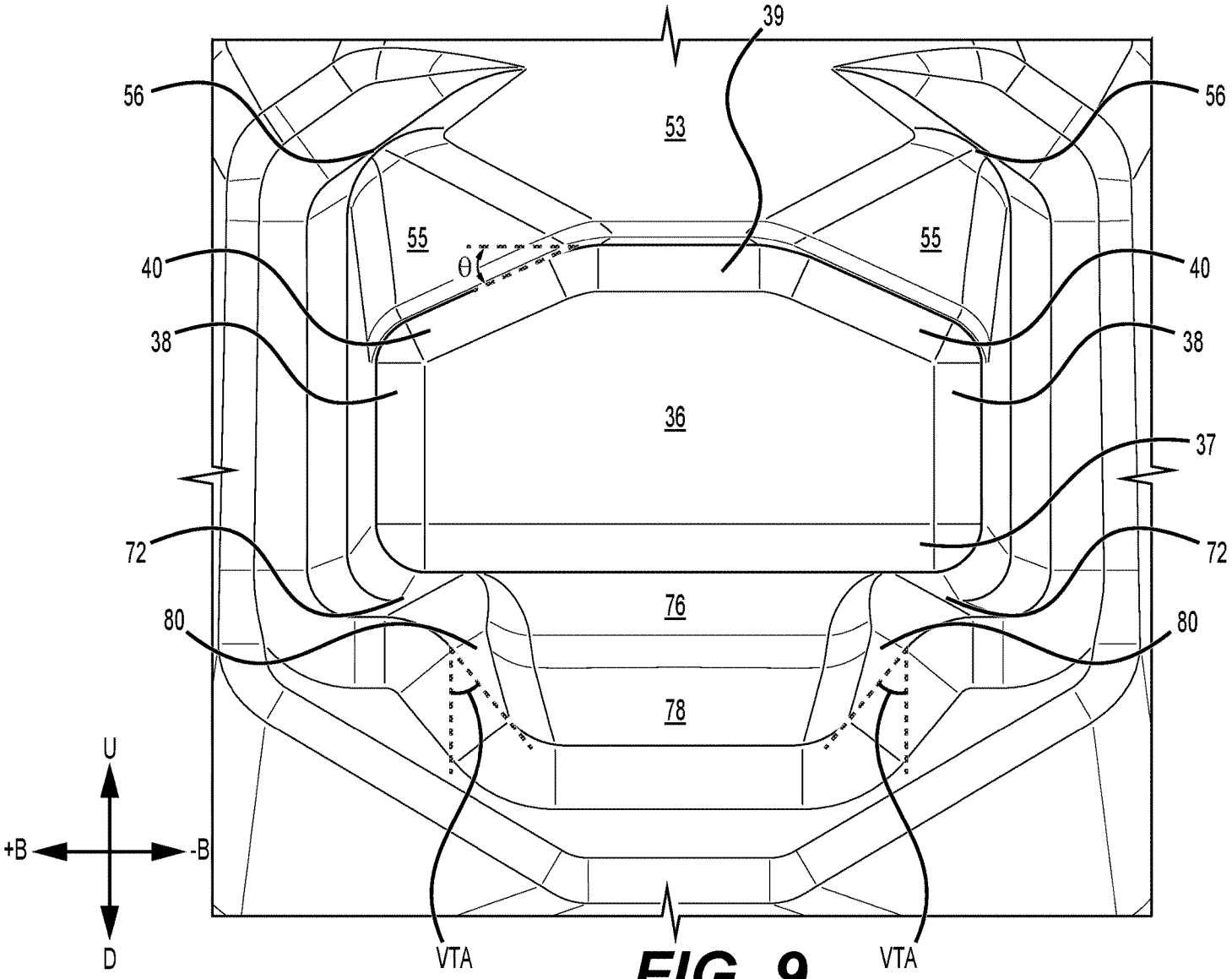
FIG. 9 is a front view of the nose of the adapter of FIG. 4 in accordance with the present disclosure.

FIG. 8 illustrates a side view of the nose 26 of the adapter 12 of FIG. 4 and FIG. 9 illustrates a front view of the nose 26 of adapter 12 of FIG. 4. As shown in FIG. 9, front surface 36 may be hexagonally shaped, comprising a bottom edge 37, opposing side edges 38 oriented at about 90° with respect to the bottom edge 37, a top horizontal edge 39 oriented about parallel to the bottom edge 37, and opposing top sloping edges 40 connecting the top horizontal edge 39 to the side edges 38. An angle θ between the top horizontal edge 39 and the top sloping edges 40 may range between about 18.5° to 30°, and may preferably be about 24.5°. The front edges 37-40 may be curved as shown in FIG. 6.

Figure 10:
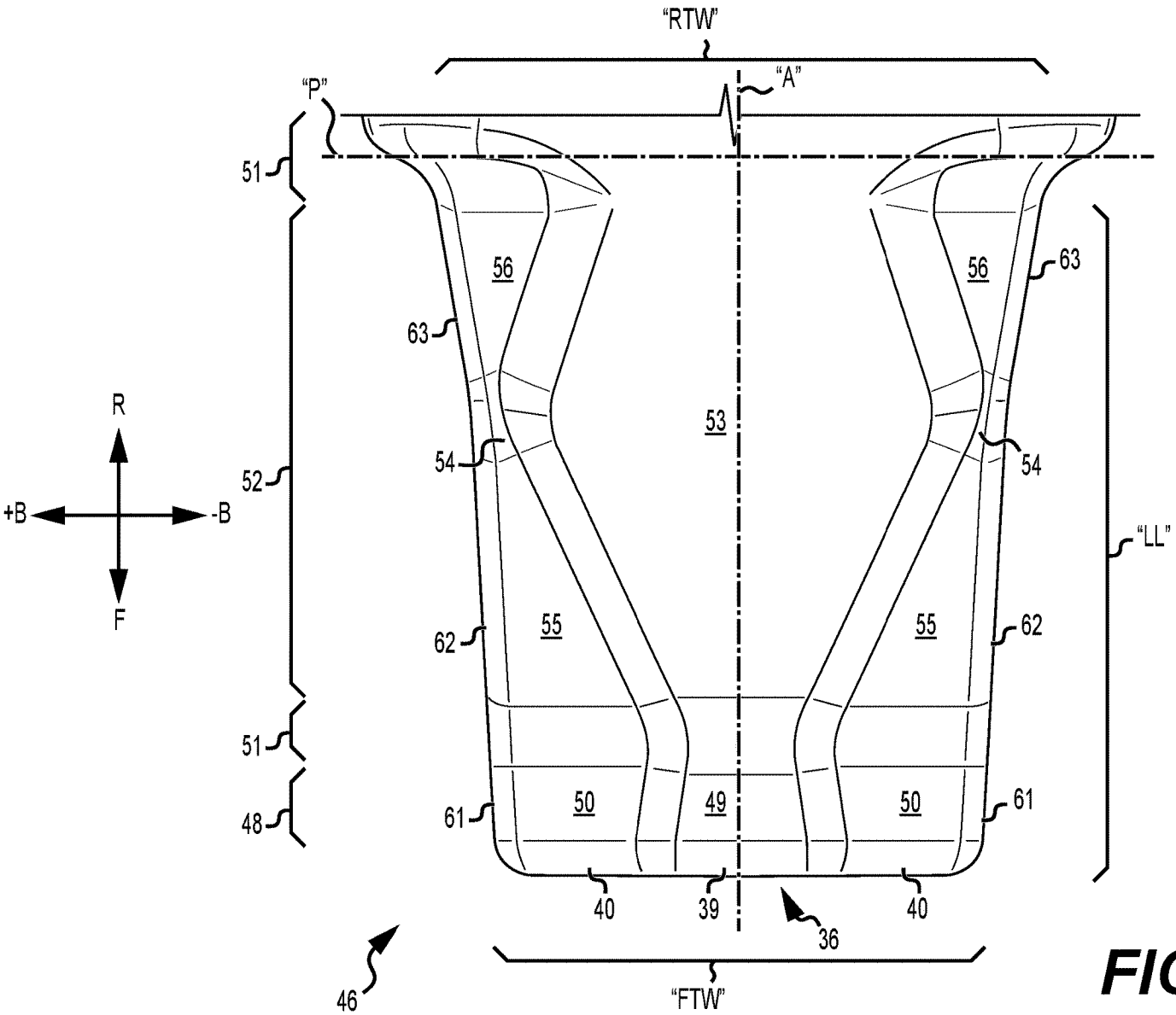
FIG. 10 is a top view of the nose of the adapter of FIG. 4 in accordance with the present disclosure.

The top surface 46 (FIG. 6) of the nose 26 may be configured to support the tip 14 during use of the loader bucket assembly 1 or excavator bucket assembly 6, and to facilitate retention of the tip 14 on the nose 26 when bearing the load of the work material. As shown in FIGS. 8 and 10, the top surface 46 may include a front portion 48 disposed proximate the front surface 36, a transition portion 51 extending rearwardly from front portion 48 toward plane P, and a rear portion 52 extending rearwardly from the transition portion 51 toward plane P. The front portion 48 may comprise a generally planar front central surface 49 extending rearwardly from the top horizontal edge 39 of the front surface 36. The front central surface 49 may be disposed between two generally planar, opposing front side-sloping surfaces 50 extending rearwardly from the top sloping edges 40 of the front surface 36 and sloping downwardly away from the front central surface 49 in the transverse direction (e.g., along directions +B and −B, perpendicular to longitudinal axis A). FIG. 10 illustrates a top view of the nose 26 of the adapter 12 of FIG. 4. As illustrated in FIG. 10, as the front central surface 49 extends rearward from the top horizontal edge 39, the transverse width of the front central surface 49 may decrease symmetrically, resulting in the front central surface 49 having generally trapezoidal shape. Alternatively, the transverse width of the front central surface 49 may be constant or may increase as the front central surface 49 extends rearward from the top horizontal edge 39.

As shown in FIG. 8, the front central surface 49 may extend upwardly away from the top horizontal edge 39 such that the front central surface 49 and the front surface 36 may be disposed at an angle ϕ ranging from 85° to 105°, preferably about 95°. Alternatively, the front central surface 49 may extend substantially perpendicular to the front surface 36, for example, at an angle ranging from 88° to 92°, preferably 90°. Alternatively, the front central surface 49 may extend at an acute angle relative to the front surface 36, for example, at an angle ranging from 85° to 87°. The front side-sloping surfaces 50 may be oriented with respect to the front central surface 49 such that the two surfaces may be disposed at an angle θ ranging from 18.5° to 30°, preferably about 24.5°. The front side-sloping surfaces 50 may help provide stability to the tip assembly 10 during downward and sideways loading patterns, for example, by acting as wedging surfaces to reduce relative motion between the nose 26 of the adapter 12 and the nose cavity 126 (FIG. 19) of the tip 14. The front side-sloping surfaces 50 may additionally increase the contact area between the nose 26 of the adapter 12 and the nose cavity 126 of the tip 14, reducing stress throughout the nose 26. Further, the front side-sloping surfaces 50 additionally increase the frictional force when load is applied to the tip assembly 10, reducing loading on the tip 14 and the retention mechanism 13, especially in combination with other transversely sloping surfaces, for example rib side surfaces 80, described below.

Returning to FIG. 10, the rear portion 52 of the top surface 46 may comprise a generally planar rear central surface 53 extending rearwardly from transition portion 51 toward the intermediate portion 24 of the adapter 12. Planar rear central surface 53 may be disposed between two opposing rear side-sloping surfaces 54 extending rearwardly from transition portion 51 and sloping downwardly away from the rear central surface 53 in the transverse directions +B and −B. The rear side-sloping surfaces 54 function to provide increased stability, for example during downward and sideways loading of the tip assembly 10 by acting as wedging surfaces to reduce relative motion and increase contact area between the nose 26 and the tip 14. Further, increased contact area provided by the rear side-sloping surfaces 54 may reduce stresses through the nose 26.

As the rear central surface 53 extends rearwardly, the transverse width of the rear central surface 53 may first increase, and subsequently decrease. In some embodiments, the width of the rear central surface 53 proximate the front central surface 49 ranges from 0.1 to 0.4 times, preferably about 0.23 times the transverse width at the rear ("RTW") of the nose 26 (at vertical plane "P"). In some embodiments, the width of the rear central surface 53 at its widest point as it extends rearwardly ranges from 0.6 to 0.9 times, preferably about 0.73 times the transverse width at the rear ("RTW") of the nose 26. In some embodiments, the width of the rear central surface 53 proximate the intermediate portion 24 of the adapter 12 ranges from 0.3 to 0.6 times, preferably about 0.46 times the transverse width at the rear ("RTW") of the nose 26. The rear central surface 53 may be inclined upwardly with respect to the front central surface 49. The differing angles of the front central surface 49 and the rear central surface 53 with respect to the substantially longitudinal axis "A" provide the advantage of creating friction on the front central surface 49, transferring load from the retention mechanism 13 to the nose 26 of the adapter 12. As shown for example in FIG. 8, the rear central surface 53 may be oriented with respect to the front central surface 49 such that an angle between the two surfaces ranges from 0° to 15°, preferably about 9°. Further, an angle of inclination of the rear central surface 53 may be about 5° to 25°, preferably 14° with respect to the substantially longitudinal axis "A". The slope of the rear central surface 53 facilitates insertion of the nose 26 into the nose cavity 126 (FIG. 19) of the tip 14, while the width of the rear central surface 53 limits the twisting of the tip 14 once installed on the nose 26.

As further illustrated in FIG. 10, the rear side-sloping surfaces 54 may comprise a generally planar triangular front bowtie-shaped surface 55 and a generally planar triangular rear bowtie-shaped surface 56 oriented with vertices pointing toward each other. The front bowtie-shaped surfaces 55 provide the advantage of acting as a main wedging surface during push-on loading. As shown for example in FIG. 8, the front bowtie-shaped surfaces 55 may be inclined upwardly (e.g., in the direction U) as they extend in the rearward direction R with respect to the front side-sloping surfaces 50. For example, the front bowtie-shaped surfaces 55 may be oriented with respect to the front side-sloping surfaces 50 such that an angle between the two surfaces ranges from 15° to 27.5°, preferably about 21.5°. Further, as shown for example in FIG. 9, the front bowtie-shaped surfaces 55 may be inclined downwardly (e.g., in the direction D) as they extend in the transverse directions +B and −B from the rear central surface 53. For example, the front bowtie-shaped surfaces 55 may be oriented with respect to the rear central surface 53 such that an angle between the two surfaces ranges from 17.5° to 32.5°, preferably about 25°.

As shown for example in FIGS. 8 and 10, the rear bowtie-shaped surfaces 56 may be inclined downwardly (e.g., in the direction D) as they extend in the transverse directions +B and −B from the rear central surface 53. The angle of inclination between the rear bowtie-shaped surfaces 56 and the rear central surface 53 may differ from the angle of inclination between the front bowtie-shaped surfaces 55 and the rear central surface 53. More specifically, the angle of inclination between the rear bowtie-shaped surfaces 56 and the rear central surface 53 may be greater than the angle of inclination between the front bowtie-shaped surfaces 55 and the rear central surface 53. For example, the rear bowtie-shaped surfaces 56 may be oriented with respect to the rear central surface 53 such that an angle between the two surfaces ranges from 30° to 45°, preferably about 37.5°. Further, as the rear bowtie-shaped surfaces 56 extend rearward from the front bowtie-shaped surfaces 55, the rear bowtie-shaped surfaces 56 may be oriented about parallel to the substantially longitudinal axis "A". Alternatively, as the rear bowtie-shaped surfaces 56 extend rearward from the front bowtie-shaped surfaces 55, the rear bowtie-shaped surfaces 56 may be angled upward, but at a shallower angle than that of the front bowtie-shaped surfaces 55 with respect to the substantially longitudinal axis "A". For example, rear bowtie-shaped surfaces 56 may be oriented with respect to the front bowtie-shaped surfaces 55 such that an angle between the two surfaces ranges from 18.5° to 30°, preferably about 24.5°. Referring to FIG. 8, the relative surface angles of the front side-sloping surfaces 50, front bowtie-shaped surfaces 55, and rear bowtie-shaped surfaces 56 provide the advantage of wedging the tip 14 onto the nose 26, especially during front loading, reducing overall motion of the tip 14 and dispersing stresses and wear through the nose 26.

Figure 33:
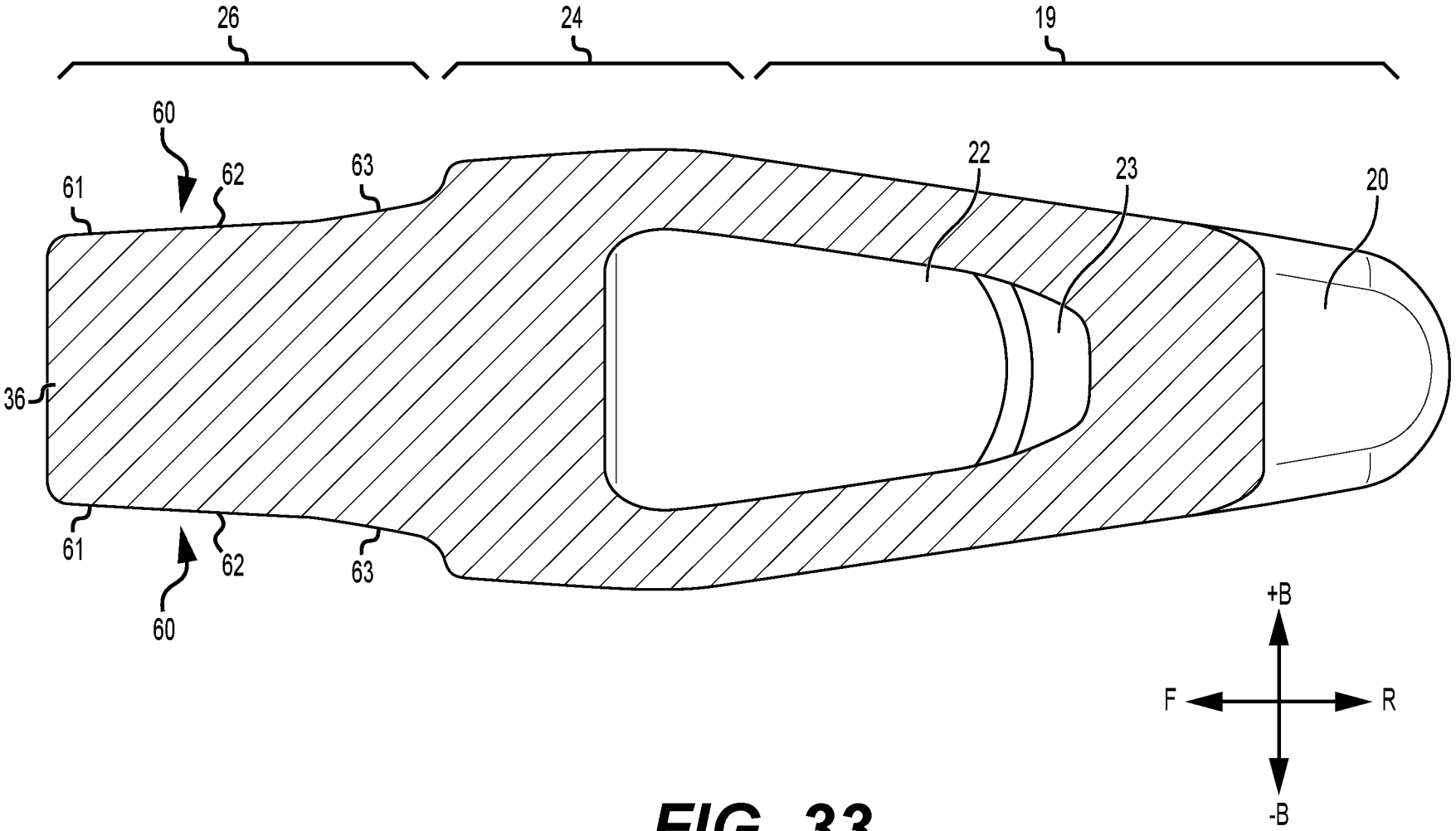
FIG. 33 illustrates a horizontal cross-sectional view taken along line C-C illustrated in FIG. 5 in accordance with the present disclosure.

Referring to FIG. 10, the front portion 48 of the top surface 46 of the nose 26, the rear portion 52 of the top surface 46 of the nose 26, and the intermediate portion 24 of the adapter 12 may each be separated by transition portions 51, which may comprise one or more curved surfaces translating between the relative angles of the otherwise adjoining, generally planar surfaces. The individually defined surfaces within the front portion 48 and the rear portion 52 of the top surface 46, for example the front and rear central surfaces 49, 53, the front side-sloping surfaces 50, and the front and rear bowtie-shaped surfaces 55, 56 may also be separated by transition portions 51. FIG. 33 illustrates a horizontal cross-sectional view taken along line C-C as illustrated in FIG. 5. Some of the surfaces associated with nose 26 of adapter 12 and discussed above are also illustrated in FIG. 33. As also illustrated in FIG. 33, in some exemplary embodiments, top strap 20 of adapter 12 may include an opening or recess 23.

Figure 11:
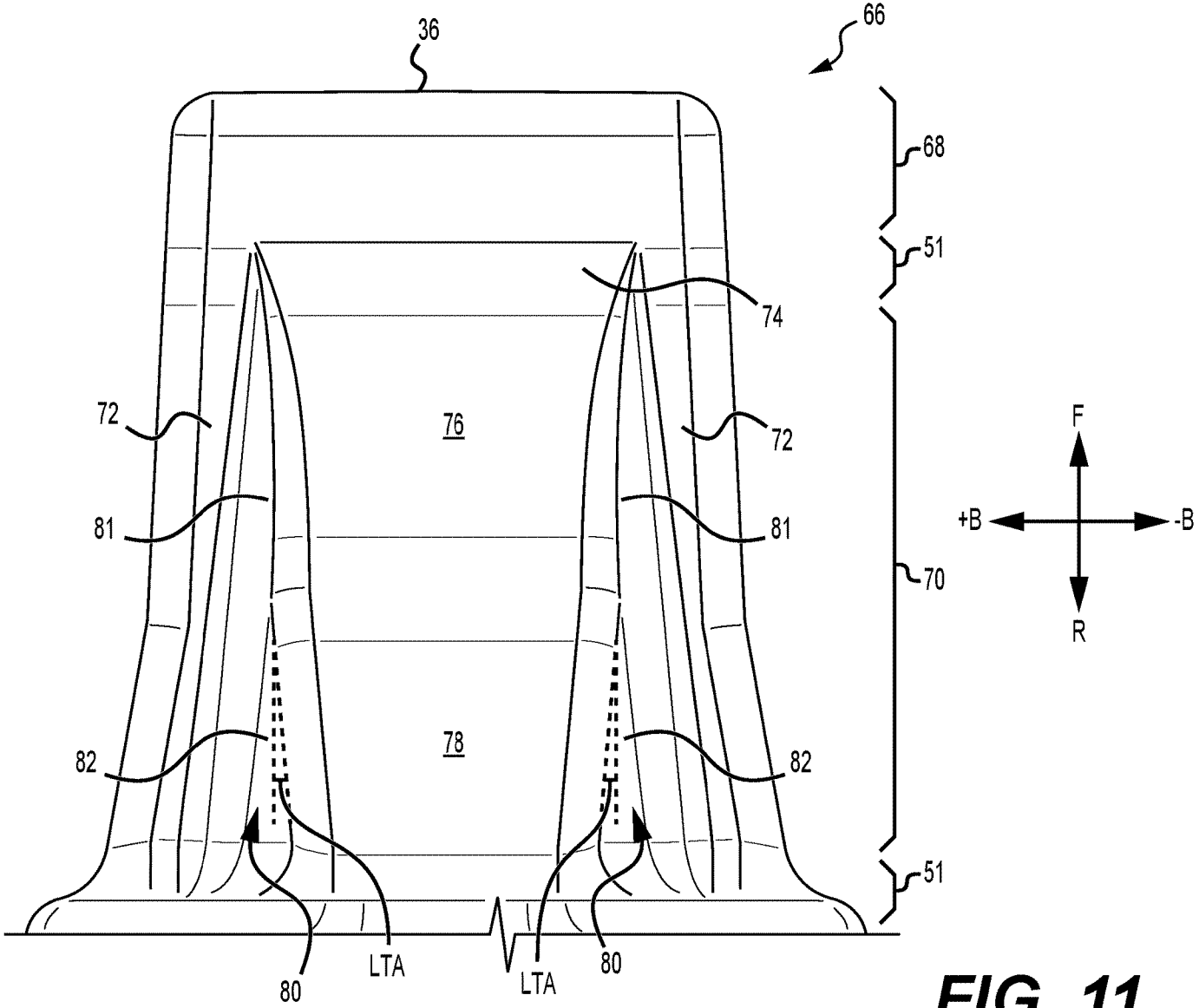
FIG. 11 is a bottom view of the nose of the adapter of FIG. 4 in accordance with the present disclosure.

FIG. 11 is a bottom view of the nose of the adapter of FIG. 4. As seen in FIG. 11, the bottom surface 66 may comprise a generally planar front portion 68 disposed proximate to and extending rearwardly from the front surface 36 and a rear portion 70 extending rearwardly toward the intermediate portion 24 of the adapter 12. Transition portion 51 may be disposed between front portion 68 and rear portion 70. The front portion 68 provides a flat stable surface to act as a main contact area during upload with the advantage of reducing wear on the tip assembly 10. As shown in FIG. 8, the front portion 68 may be oriented with respect to the front surface 36 at an angle ranging from 85° to 105°, preferably about 90°. Further, the front portion 68 may be oriented with respect to the front central surface 49 at an angle ranging from 0° to 15°, preferably about 5°. Such an orientation of the front portion 68 may provide the advantage of increased frictional force between the tip 14 and adapter 12, reducing slippage, for example, when the tip 14 is loaded in an upward direction, resulting in reduced loading on the retention mechanism 13.

The rear portion 70 of the bottom surface 66, as seen in FIG. 11, may comprise opposing generally planar shoulder surfaces 72 inclined downwardly (e.g., in direction D, see FIG. 8) or alternatively parallel relative to front portion 68 and a bottom rib 74 inclined downwardly (e.g., in direction D) relative to both the front portion 68 and the shoulder surfaces 72. As shown in FIG. 8, the shoulder surfaces 72 may be oriented with respect to the front portion 68 at an angle ranging from 0° to 10°, preferably about 4°.

The bottom rib 74 of the bottom surface 66, as seen in FIG. 11, may comprise a generally planar front rib portion 76 inclined downwardly (e.g., in direction D, see FIG. 8) relative to the front portion 68 and a generally planar rear rib portion 78 inclined downwardly (e.g., in direction D, see FIG. 8) relative to the front rib portion 76, between opposing rib side surfaces 80. The bottom rib 74 provides advantages such as increased stability during side loading and increased wedging during push-on loading. As shown in FIG. 8, the front rib portion 76 may be oriented with respect to the front portion 68 such that an angle between the two surfaces ranges from 6° to 18°, preferably about 12.5°. The rear rib portion 78 may be oriented with respect to the front rib portion 76 such that an angle between the two surfaces ranges from 0° to 15°, preferably 6°. The differing angles of, for example, the front rib portion 76 and rear rib portion 78 provide the benefits of reduce relative motion between the adapter 12 and tip 14, reduced wear, and more even distribution of stresses.

As seen in FIG. 11, the rib side surfaces 80 of the bottom rib 74 may comprise a front rib side surface 81 and a rear rib side surface 82. The front rib side surfaces 81 may connect the front rib portion 76 to the shoulder surfaces 72. The rear rib side surfaces 82 may connect the rear rib portion 78 to the shoulder surfaces 72. The front rib side surfaces 81 of the bottom rib 74 may be substantially parallel to each other such that the transverse width (along directions +B and −B) of the front rib portion 76 is substantially constant as the front rib portion 76 extends rearward. Alternatively, the front rib side surfaces 81 of the bottom rib 74 may be oriented with respect to each other such that a distance between the front rib side surfaces 81 decreases substantially symmetrically at a longitudinal taper angle "LTA" ranging from 0° to 20° with respect to longitudinal lines oriented parallel to the substantially longitudinal axis "A". Further, in some exemplary embodiments (not shown), the rear rib side surfaces 82 of the bottom rib 74 may be substantially parallel to each other such that the transverse width (e.g., along directions +B and −B) of the rear rib portion 78 is substantially constant as the rear rib portion 78 extends rearward. Alternatively, as shown in FIG. 11, the rear rib side surfaces 82 of the bottom rib 74 may be oriented with respect to each other such that a distance between the rear rib side surfaces 82 decreases substantially symmetrically at a longitudinal taper angle "LTA" ranging from 0° to 20°, preferably about 5° with respect to longitudinal lines oriented parallel to the substantially longitudinal axis "A". The orientation of the rib side surfaces 80 with respect to the substantially longitudinal axis "A" may provide the advantage of increased wedging resulting in reduced relative motion, including reducing pivoting side to side, and reduced wear during push-on loading and downward loading. As shown in FIG. 9, the rib side surfaces 80 of the bottom rib 74 may be oriented with respect to each other such that the distance between the rib side surfaces 80 decreases substantially symmetrically at a vertical taper angle "VTA" ranging from 30° to 50°, preferably about 39.5° with respect to parallel vertical lines. Further, the rib side surfaces 80 may be oriented with respect to the shoulder surfaces 72 such that an angle between the two surfaces ranges from 40° to 60°, preferably about 50.5°. Such an orientation of the rib side surfaces 80 may provide the advantages of increased stability during side loading, reduced nose volume, added strength, and an additional wedging effect increasing contact area and reducing sliding motion and related wear.

Referring to FIG. 11, the front portion 68 of the bottom surface 66 of the nose 26, the rear portion 70 of the bottom surface 66 of the nose 26, and the intermediate portion 24 of the adapter 12 may each be separated by transition portions 51, which may comprise one or more curved surfaces translating between the relative angles of the otherwise adjoining, generally planar surfaces. The individually defined surfaces within the front portion 68 and the rear portion 70 of the bottom surface 66, for example the shoulder surfaces 72, front rib portion 76, rear rib portion 78, and rib side surfaces 80 may also be separated by transition portions 51.

As shown in FIG. 7, the side surfaces 60 of the nose 26 may be generally planar and extend upwardly between the bottom surface 66 and the top surface 46. As illustrated in FIG. 8, the side surfaces 60 may comprise a generally planar front side surface 61 disposed proximate the front surface 36, a generally planar intermediate side surface 62 extending rearwardly from the front side surface 61, and a rear side surface 63 extending rearwardly from the intermediate side surface 62 to the intermediate portion 24 of the adapter 12. The front side surfaces 61 may be longitudinally aligned such that they separate the front side-sloping surfaces 50 of the top surface 46 from the front portion 68 of the bottom surface 66. The intermediate side surfaces 62 may be longitudinally aligned such that they separate the front bowtie-shaped surfaces 55 of the top surface 46 from the shoulder surfaces 72 of the bottom surface 66. The rear side surfaces 63 may be longitudinally aligned such that they separate the rear bowtie-shaped surfaces 56 of the top surface 46 from the shoulder surfaces 72 of the bottom surface 66.

As shown in FIG. 10, the front side surfaces 61 and the intermediate side surfaces 62 may be parallel and continuous as they extend rearward from the side edges 38 of the front surface 36. The front side surfaces 61 and the intermediate side surfaces 62 may be oriented with respect to the front surface 36 such that an angle between the surfaces ranges from 90° to 105°, preferably about 93°. Further, as shown in FIG. 8, the front side surfaces 61 may be configured such that the distance between the top surface 46 and the bottom surface 66 is substantially constant as the front side surfaces 61 extend rearward from the side edges 38. Alternatively, the front side surfaces 61 may be configured such that the distance between the top surface 46 and the bottom surface 66 increases slightly as the front side surfaces 61 extend rearward from the side edges 38. The intermediate side surfaces 62 may be configured such that the distance between the top surface 46 and the bottom surface 66 substantially increases as the intermediate side surfaces 62 extend rearward.

As shown in FIG. 10, the rear side surfaces 63 may be angled outwardly (e.g., along directions +B and −B) with respect to the front side surfaces 61 and the intermediate side surfaces 62 as they extend rearward from the intermediate side surfaces 62 such that the transverse distance (e.g., along directions +B and −B) between the rear side surfaces 63 symmetrically increases as the rear side surfaces 63 extend rearward. For example, the rear side surfaces 63 may be angled outwardly with respect to the intermediate side surfaces 62 at an angle ranging from greater than 0° to 15°, preferably about 7°. Angles greater than 0° provide the advantages of allowing the rear side surfaces 63 to act as wedging surfaces during push-on loading, increasing the contact surface between the adapter 12 and tip 14 during operation, and thereby reducing slippage and wear, and improving removability by reducing the friction between the adapter 12 and tip 14 during removal. Alternatively, in some exemplary embodiments, the rear side surfaces 63 may be oriented substantially parallel to the intermediate side surfaces 62. In some exemplary embodiments, the rear side surfaces 63 may be configured such that the distance between the top surface 46 and the bottom surface 66 decreases slightly as the rear side surfaces 63 extend rearward.

The front side surface 61, intermediate side surface 62, rear side surface 63 of the side surfaces 60 of the nose 26, the top surface 46, the bottom surface 66, and the intermediate portion 24 of the adapter 12 may each be separated by transition portions 51, which may comprise one or more curved surfaces translating between the relative angles of the otherwise adjoining, generally planar surfaces.

Figure 34:
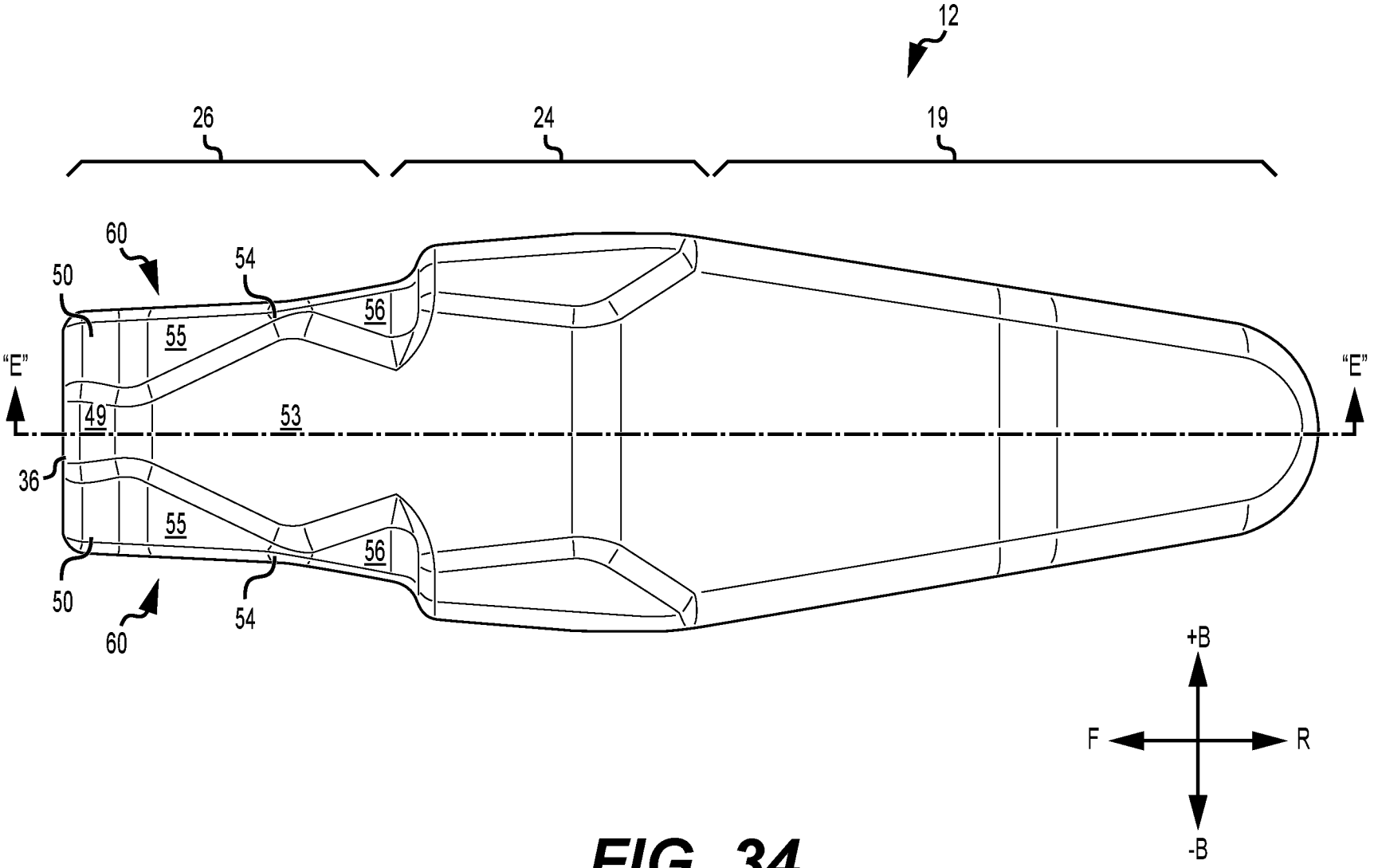
FIG. 34 illustrates a top plan view of the adapter of FIG. 4 in accordance with the present disclosure.
Figure 35:
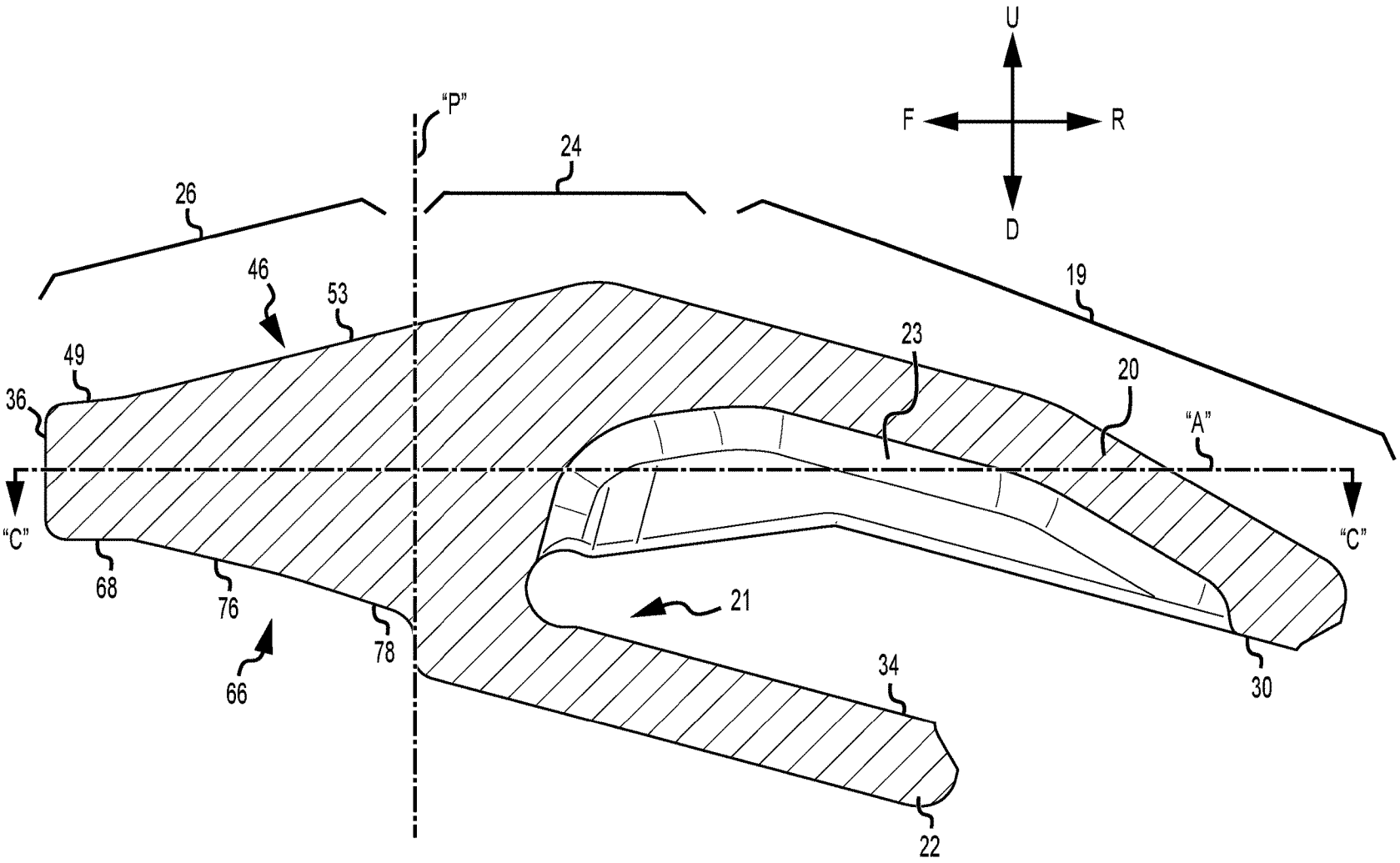
FIG. 35 illustrates a vertical cross-sectional view of the adapter of FIG. 4 taken along line E-E shown in FIG. 34 in accordance with the present disclosure.

As shown in FIG. 8, the vertical height at the rear ("RVH") of the nose 26 (at the vertical plane "P") may range from 0.5 to 1.0 times the longitudinal length ("LL") of the nose 26, where the longitudinal length ("LL") is defined as the distance along the substantially longitudinal axis "A" from the vertical plane "P" to the front surface 36. The vertical height at the front ("FVH") of the nose 26 (at the front surface 36) may range from 0.2 to 0.5 times the longitudinal length ("LL") of the nose 26. As shown in FIG. 10, the transverse width at the rear ("RTW") of the nose 26 (at the vertical plane "P") may range from 0.8 to 2.0 times the transverse width at the front ("FTW") of the nose 26 (at the front surface 36). The transverse width at the front ("FTW") of the nose 26 (at the front surface 36) may range from 0.4 to 1.5 times the longitudinal length ("LL") of the nose 26. The longitudinal length ("LL") of the nose 26 may range from 0.7 to 2.0 times the transverse width ("RTW") at the rear of the nose 26 (at the vertical plane "P"). FIG. 34 illustrates a top plan view of adapter 12 and FIG. 35 illustrates a vertical cross-sectional view of the adapter taken along line E-E shown in FIG. 34. Some of the surfaces associated with nose 26 of adapter 12 and discussed above are also illustrated in FIG. 35.

Figure 36:
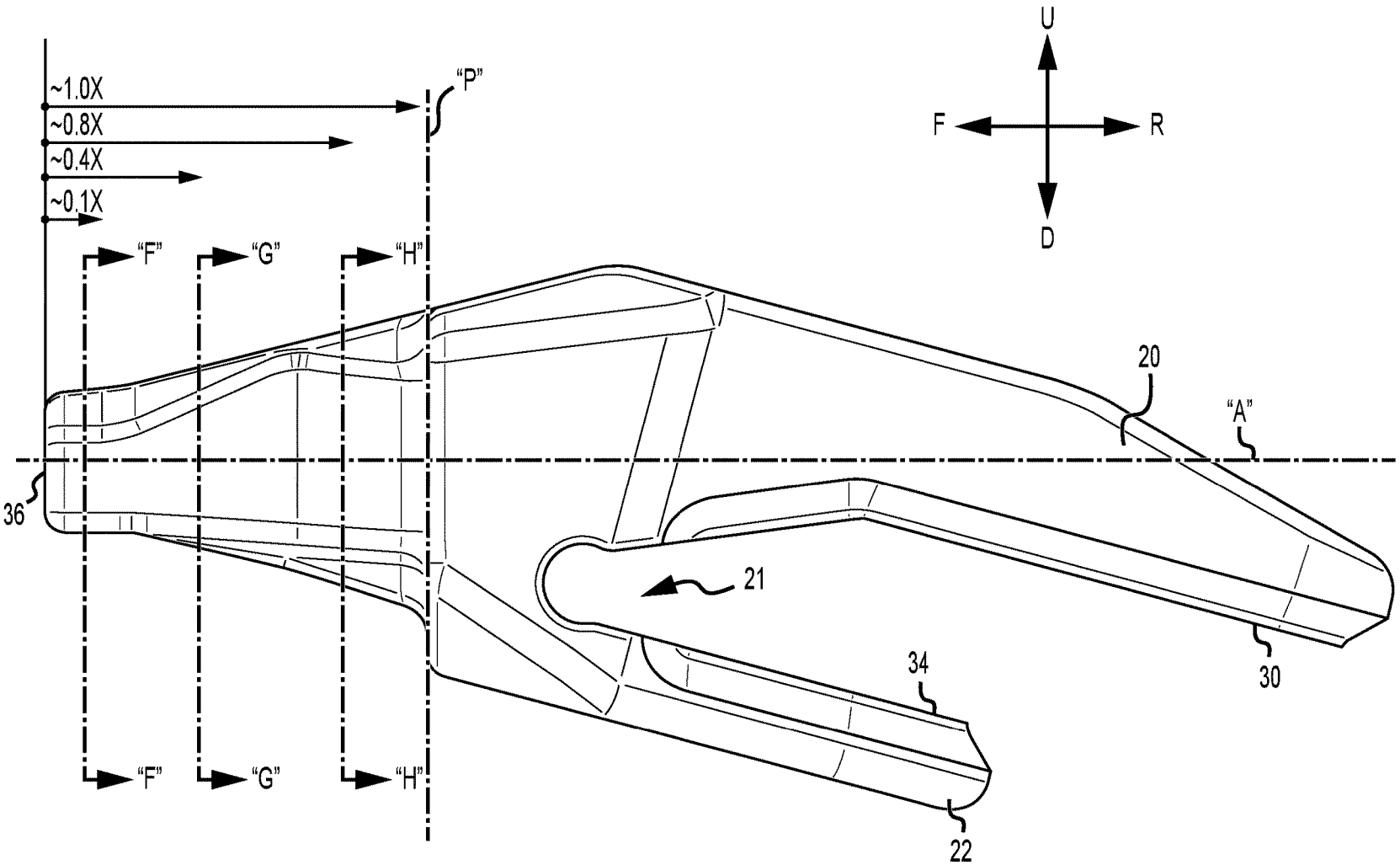
FIG. 36 illustrates a side view of the adapter of FIG. 4 with section lines F-F, G-G, and H-H in accordance with the present disclosure.
Figure 37:
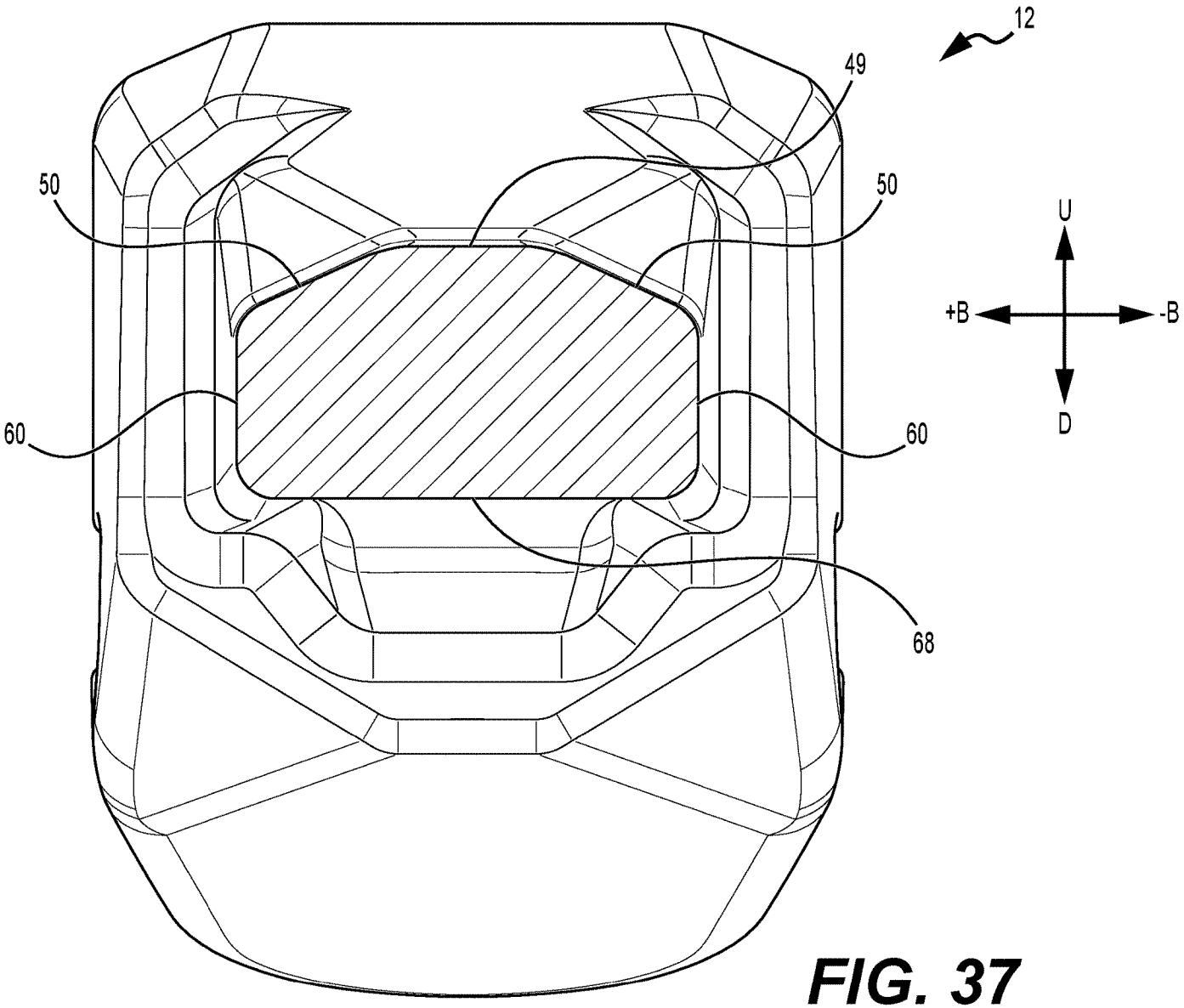
FIG. 37 illustrates a cross-sectional view of nose of the adapter of FIG. 4 taken along line F-F as shown in FIG. 36 in accordance with the present disclosure.
Figure 38:
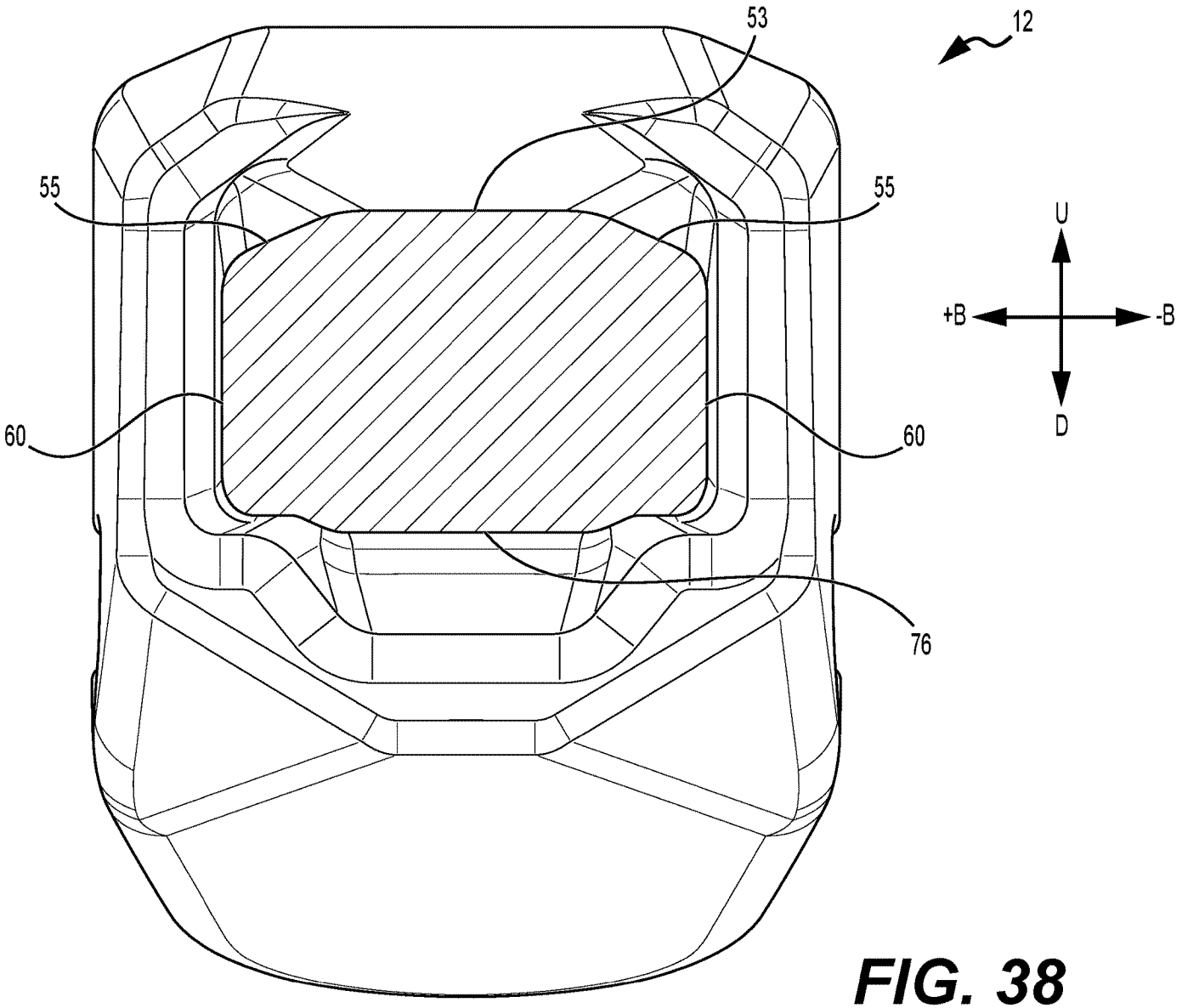
FIG. 38 illustrates a cross-sectional view of nose of the adapter of FIG. 4 taken along line G-G as shown in FIG. 36 in accordance with the present disclosure.

FIG. 36 illustrates a side view of the adapter of FIG. 4 with section lines F-F, G-G, and H-H. As illustrated in FIG. 36, section planes corresponding to lines F-F, G-G, and H-H may be located at distances of about 0.1×, 0.4×, 0.8×, and 1.0× from front surface 36 of nose 26. FIG. 37 illustrates a cross-sectional view of nose 26 along line F-F as shown in FIG. 36. As illustrated in FIG. 37, front central surface 49 may be disposed between two generally planar, opposing front side-sloping surfaces 50. The front side-sloping surfaces 50 may be oriented with respect to the front central surface 49 such that an angle between the two surfaces may range from 18.5° to 30°, preferably about 24.5°. FIG. 38 illustrates a cross-sectional view of nose 26 along line G-G as shown in FIG. 36. As illustrated in FIG. 38, front bowtie-shaped surfaces 55 may be inclined downwardly (e.g., in the direction D) as they extend in the transverse directions +B and −B from the rear central surface 53. For example, the front bowtie-shaped surfaces 55 may be oriented with respect to the rear central surface 53 such that an angle between the two surfaces ranges from 17.5° to 32.5°, preferably about 25°.

Figure 39:
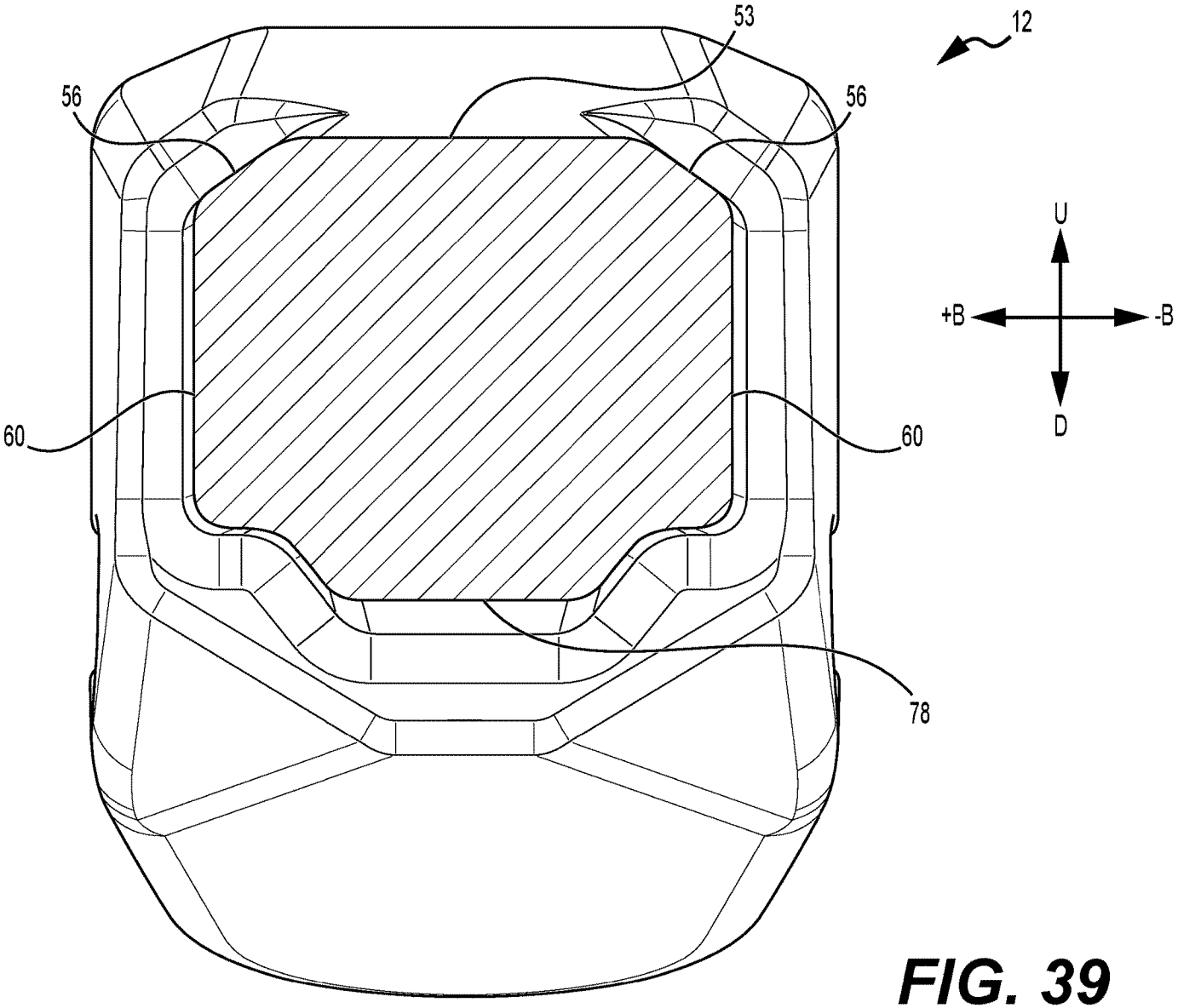
FIG. 39 illustrates a cross-sectional view of nose of the adapter of FIG. 4 taken along line H-H as shown in FIG. 36 in accordance with the present disclosure.

FIG. 39 illustrates a cross-sectional view of nose 26 along line G-G as shown in FIG. 36.

As illustrated in FIG. 39, the rear bowtie-shaped surfaces 56 may be inclined downwardly (e.g., in the direction D) as they extend in the transverse directions +B and −B from the rear central surface 53. The angle of inclination between the rear bowtie-shaped surfaces 56 and the rear central surface 53 may differ from the angle of inclination between the front bowtie-shaped surfaces 55 and the rear central surface 53 (see FIG. 38). More specifically, the angle of inclination between the rear bowtie-shaped surfaces 56 and the rear central surface 53 may be greater than the angle of inclination between the front bowtie-shaped surfaces 55 and the rear central surface 53. For example, the rear bowtie-shaped surfaces 56 may be oriented with respect to the rear central surface 53 such that an angle between the two surfaces ranges from 30° to 45°, preferably about 37.5°.

Symmetrical Adapter (FIGS. 12-17 and 40-45)

Figure 12:
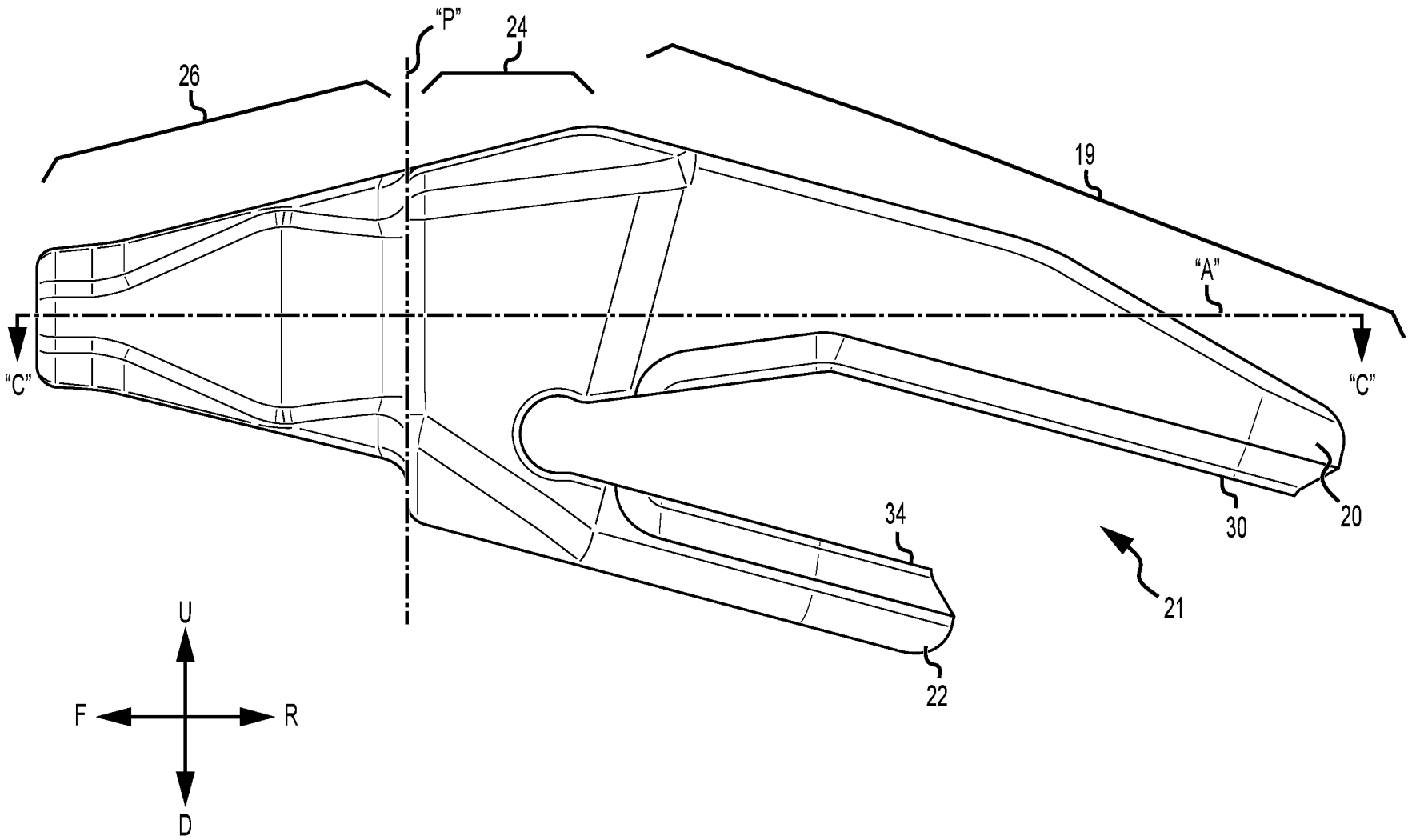
FIG. 12 is a side view of another exemplary adapter in accordance with the present disclosure.

An alternative embodiment of the adapter 12 is shown in FIGS. 12-17 and 40-45 comprising a symmetrical nose 27. FIG. 12 is a side view of an alternative embodiment of exemplary adapter 12. The symmetrical nose 27 is configured to be received by a corresponding alternative embodiment of the tip 14 comprising a symmetrical nose cavity 127 (FIGS. 27-32) as will be described more fully below. The symmetrical nose 27 and corresponding symmetrical nose cavity 127 provide the benefit of enabling a user to reverse the top and bottom orientation of the tip 14 as it is attached to the adapter 12 to allow for more even wear of the top and bottom surfaces of the tip. The symmetrical nose 27 may also allow for installation of a tip that may provide one angle of attack in one orientation and a different angle of attack when installed in another orientation (e.g., 180° rotated from the one orientation). The intermediate portion 24 of the adapter 12 may provide a transition between the rear portion 19 and the symmetrical nose 27. Intermediate portion 24 may extend between rear portion 19 and a rear end of symmetrical nose 27 as defined by a vertical plane "P" that may be disposed generally perpendicular to a longitudinal axis "A" passing through symmetrical nose 27. Longitudinal axis "A" may be positioned midway between sides of symmetrical nose 27 as will be explained below. Plane "P" may be positioned along longitudinal axis "A" at a location where adapter 12 may have its largest cross-sectional area prior to transitioning to intermediate portion 24. Plane P may also be generally perpendicular to longitudinal axis A.

Figure 13:
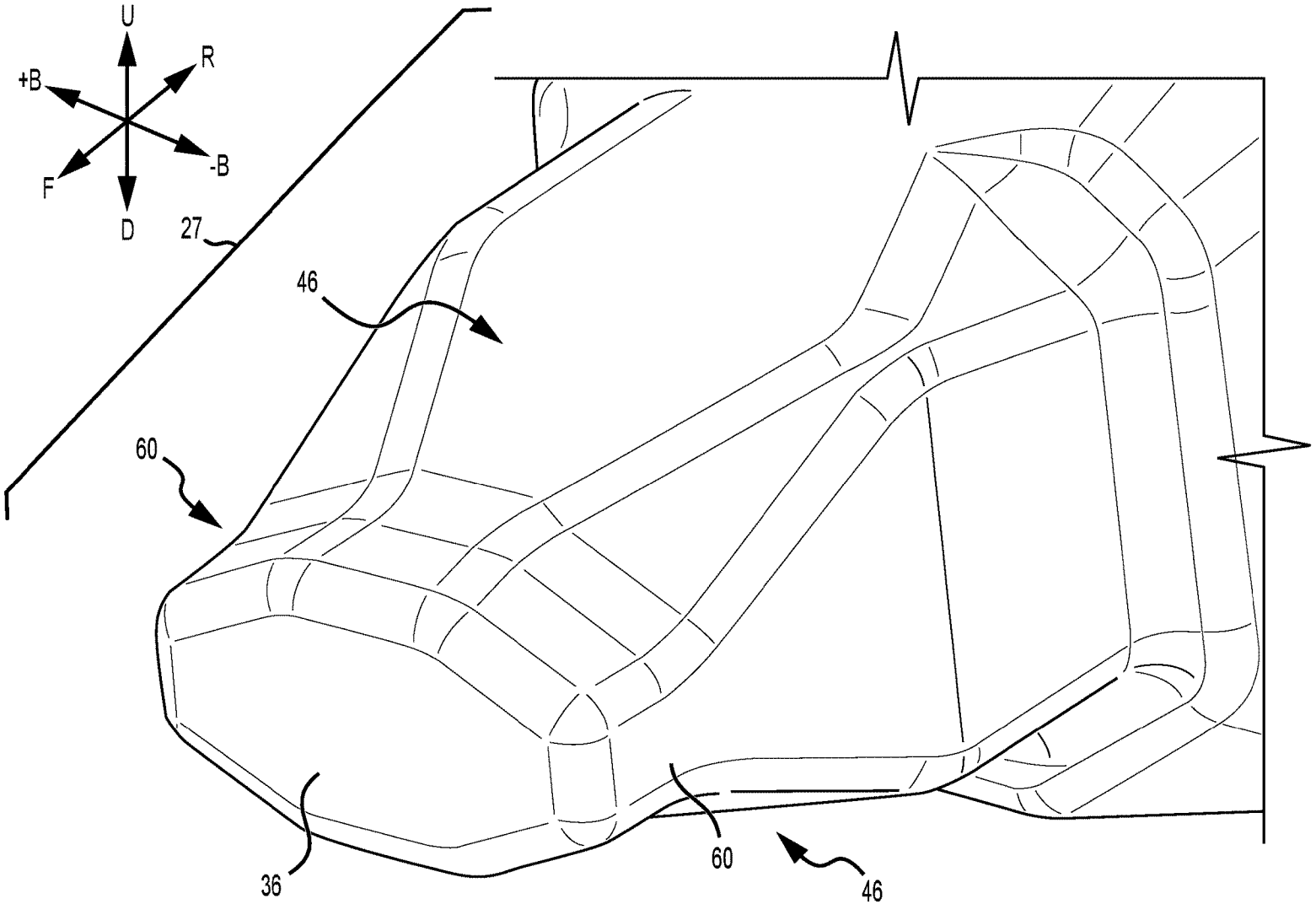
FIG. 13 is an isometric view of a nose of the adapter of FIG. 12 in accordance with the present disclosure.
Figure 14:
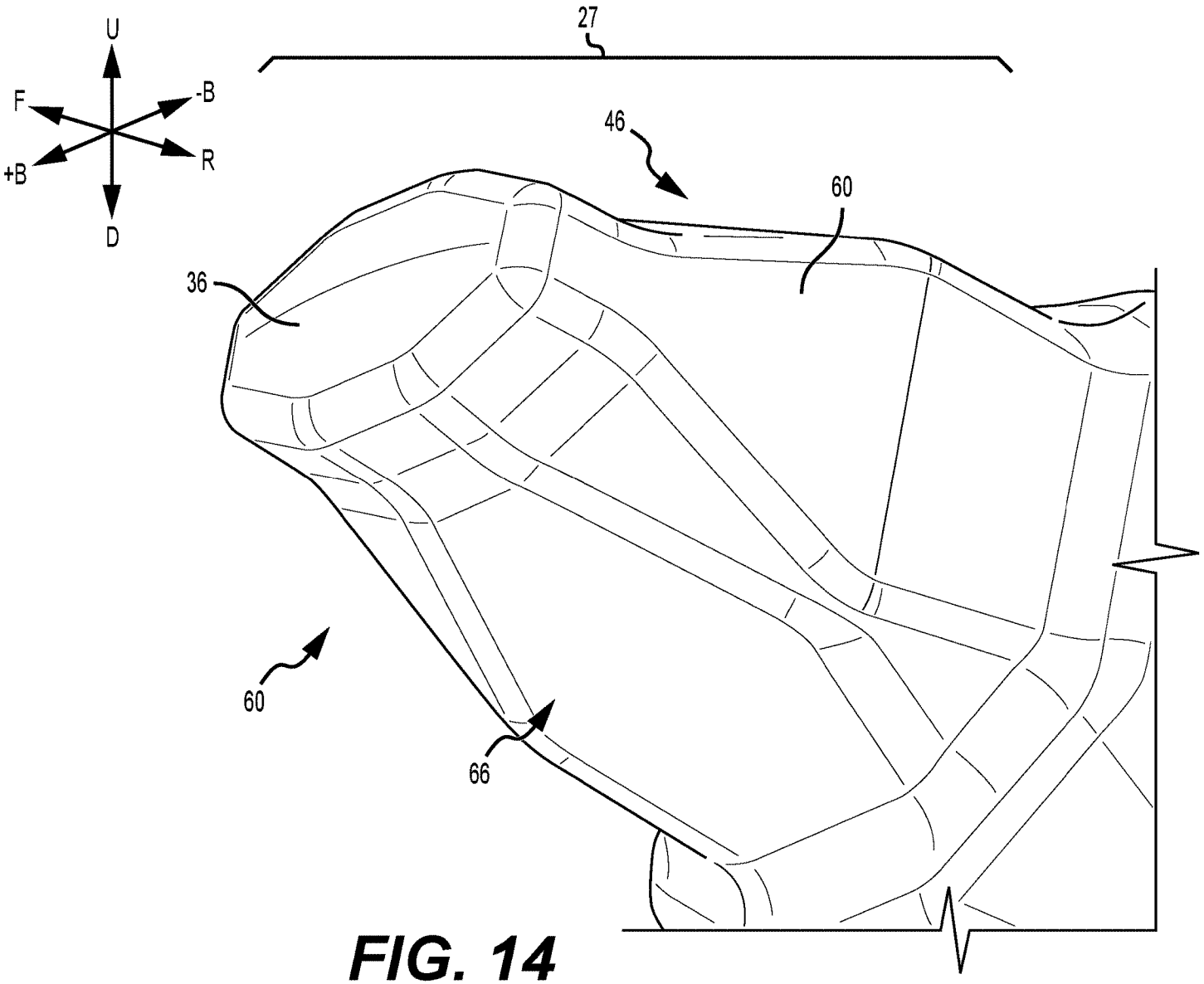
FIG. 14 is another isometric view of the nose of the adapter of FIG. 12 in accordance with the present disclosure.

FIGS. 13 and 14 illustrate isometric views of the nose 27 of adapter 12 of FIG. 12. As shown in FIGS. 13 and 14, the symmetrical nose 27 may have a front surface 36, opposing top and bottom surfaces 46 and 66, and opposing side surfaces 60. Unlike the asymmetrical nose 26 of FIGS. 5-11, top and bottom surfaces 46 and 66 may have similar features and may extend rearwardly at similar angles of inclination relative to longitudinal axis "A", the orientation of which is defined by being centered between the opposing side surfaces 60 and between top and bottom surfaces 46, 66 of the symmetrical nose 27. In one embodiment, the side surfaces 60 may have corresponding retention apertures 16 (not shown) into which a retention mechanism 13 (not shown) may be inserted to hold the tip 14 in place on the symmetrical nose 27 of the adapter 12 (as shown in FIG. 3). The retention apertures 16 may comprise, for example, through-holes or indentations configured to accept the retention mechanism 13. The retention apertures 16 may further comprise threading and/or internal recesses.

Figure 15:
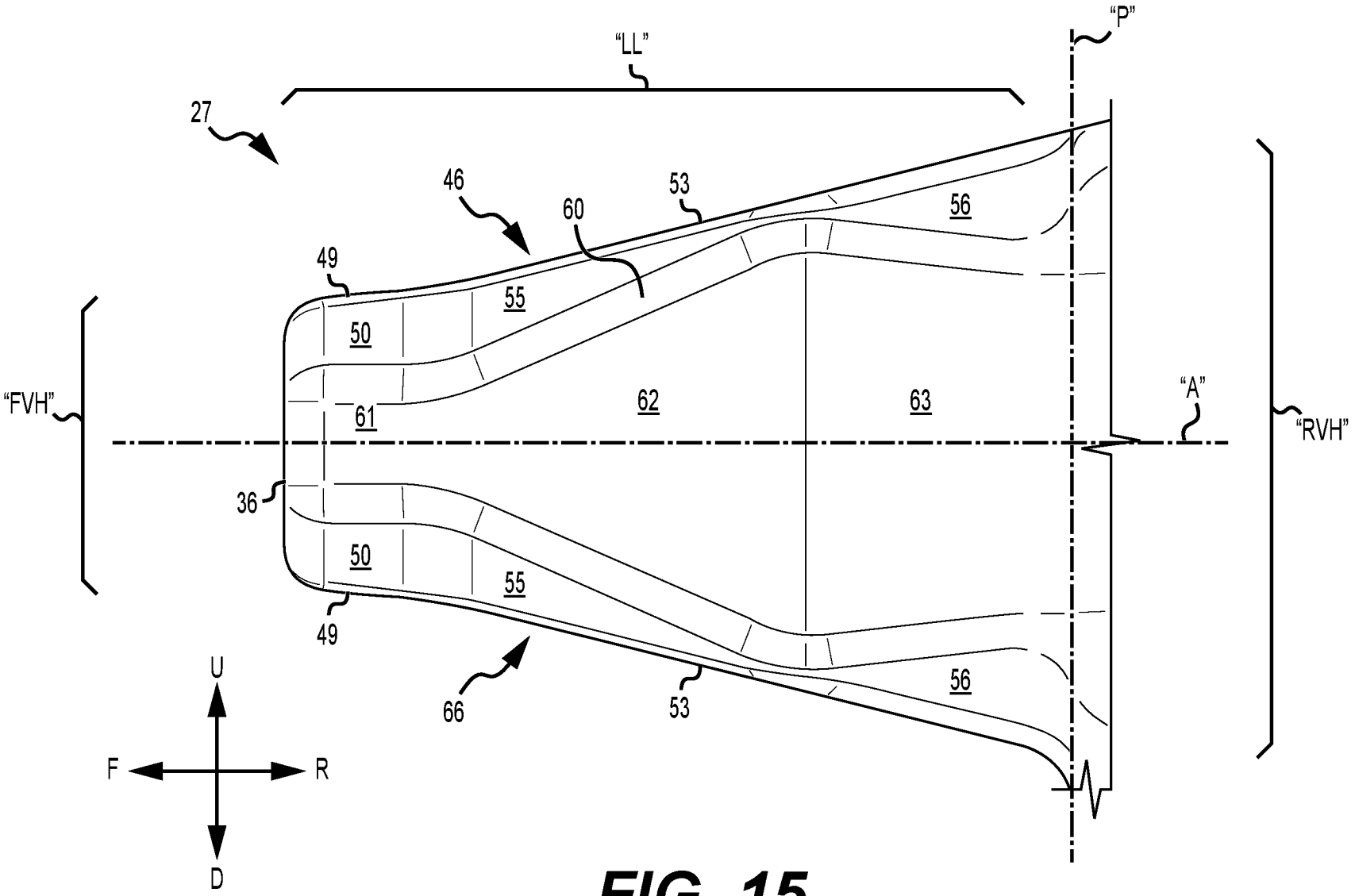
FIG. 15 is a side view of the nose of the adapter of FIG. 12 in accordance with the present disclosure.

The front surface 36 of the symmetrical nose 27 may be substantially similar to the front surface 36 of the nose 26. The front surface 36 may include a planar portion, as shown in FIG. 13, or may include a degree of curvature, as shown in FIG. 14. FIG. 15 is a side view of the nose 27 of the adapter 12 of FIG. 12. As shown in FIG. 15, the planar portion of front surface 36 may be oriented about perpendicular to a substantially longitudinal axis A or may be angled in a similar manner as described above with respect to FIGS. 5 and 6 (e.g., see inclination of front surface 36 relative to axis Z).

Figure 16:
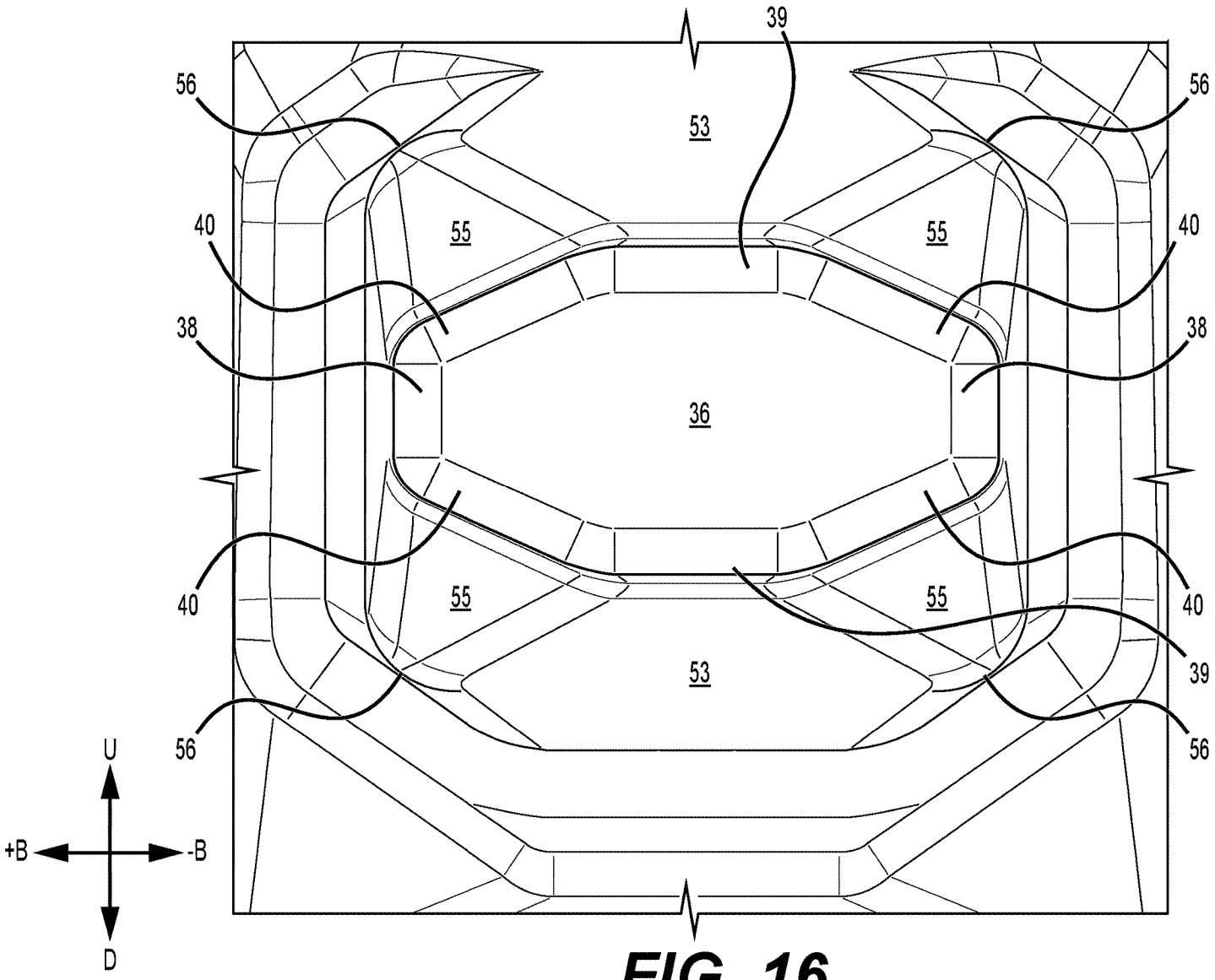
FIG. 16 is a front view of the nose of the adapter of FIG. 12 in accordance with the present disclosure.

FIG. 16 is a front view of the nose 27 of the adapter of FIG. 12. As shown in FIG. 16, the front surface 36 may be octagonally shaped, comprising opposing top and bottom horizontal edges 39, opposing side edges 38 oriented at about 90° with respect to the top and bottom horizontal edges 39, and opposing top and bottom sloping edges 40 connecting the top and bottom horizontal edges 39 to the side edges 38. An angle between the top and bottom horizontal edges 39 and top and bottom sloping edges 40 ranges from about 18.5° to 30°, preferably about 24.5°. The front edges 38-40 may be curved as shown in FIGS. 13 and 14.

The top surface 46 of the symmetrical nose 27 may be configured to support the tip 14 during use of the loader bucket assembly 1 or excavator bucket assembly 6, and to facilitate retention of the tip 14 on the symmetrical nose 27 when bearing the load of the work material.

Figure 17:
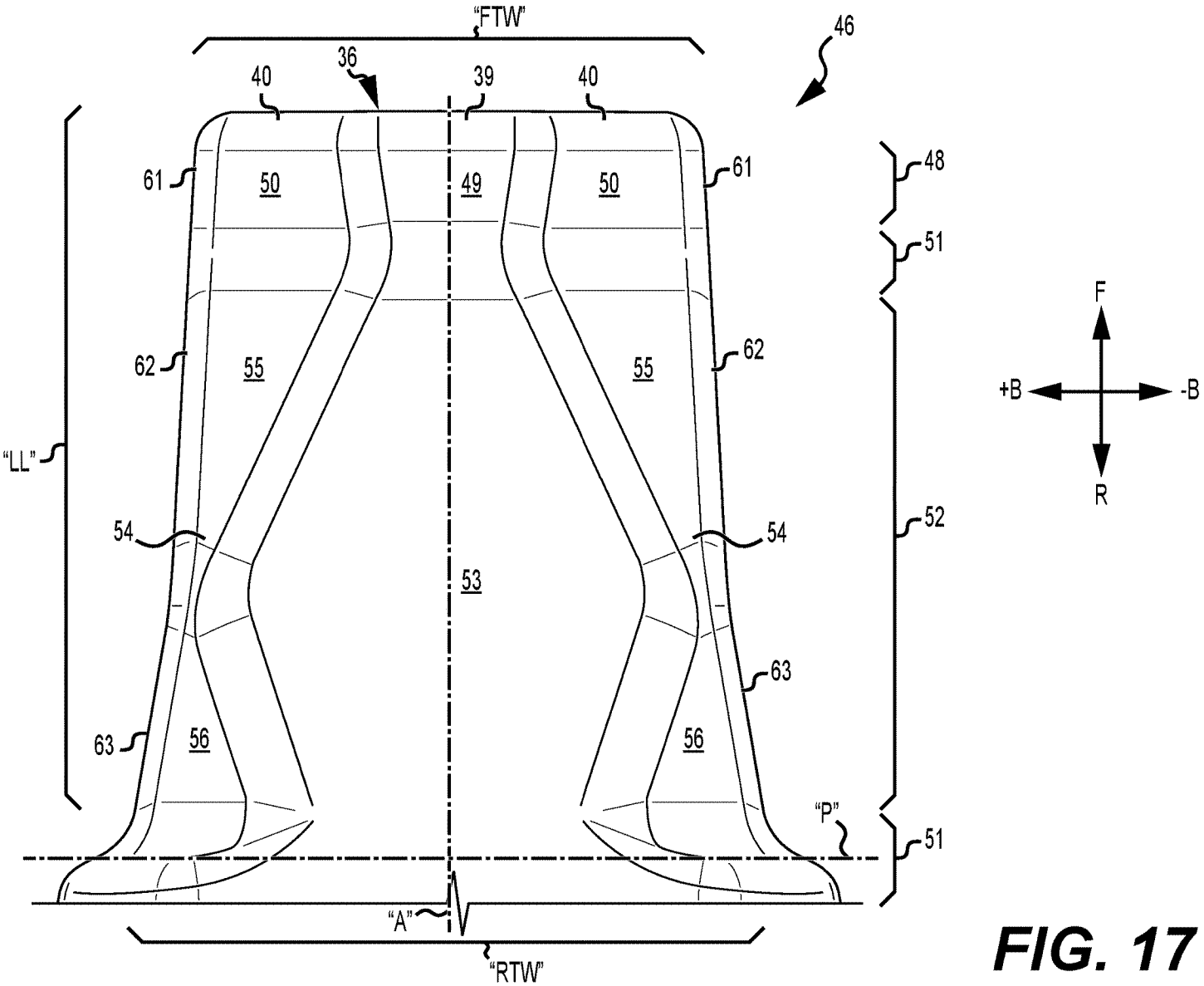
FIG. 17 is a bottom view of the nose of the adapter of FIG. 12 in accordance with the present disclosure.

FIG. 17 is a bottom view of the nose 27 of the adapter of FIG. 12. As shown in FIG. 17, the top and bottom surfaces 46, 66 may include a front portion 48 disposed proximate the front surface 36, a transition portion 51 extending rearwardly from the front surface 36, and a rear portion 52 extending rearwardly from the transition portion 51 toward the intermediate portion 24 of the adapter 12. Front portion 48 may comprise a generally planar front central surface 49 extending rearwardly from the top or bottom horizontal edge 39 of the front surface 36 between two generally planar, opposing front side-sloping surfaces 50 extending rearwardly from the top or bottom sloping edges 40 of the front surface 36 and sloping toward the side surfaces 60 in the transverse direction (e.g. along directions +B and −B), away from the front central surface 49. As the front central surface 49 extends rearward from the top or bottom horizontal edge 39, the transverse width (e.g., along directions +B and −B) of the front central surface 49 may decrease symmetrically, resulting in the front central surface 49 having a shape similar to an isosceles trapezoid, as shown in the illustrated embodiment in FIG. 17. Alternatively, the transverse width of the front central surface 49 may be constant or increase as the front central surface 49 extends rearward from the top or bottom horizontal edge 39.

As shown in FIG. 15, the front central surfaces 49 may extend away (e.g., in the upward U or downward D directions) from the substantially longitudinal axis "A" as they extend rearward such that the front central surfaces 49 and front surface 36 may be disposed at an angle ranging from 850 to 105°. The front side-sloping surfaces 50 may be oriented with respect to the front central surfaces 49 such that the surfaces form an angle ranging from 18.5° to 30°, preferably about 24.5°. The front side-sloping surfaces 50 provide stability to the tip assembly 10 during upward, downward, and sideways loading patterns, for example, by acting as wedging surfaces to reduce relative motion between the symmetrical nose 27 of the adapter 12 and the symmetrical nose cavity 127 of the tip 14. The front side-sloping surfaces 50 additionally increase the contact area between the symmetrical nose 27 of the adapter 12 and the symmetrical nose cavity 127 of the tip 14, reducing stress throughout the symmetrical nose 27. Further, the front side-sloping surfaces 50 additionally increase the frictional force when load is applied to the tip assembly 10, reducing loading on the tip 14 and the retention mechanism 13, especially in combination with other transversely sloping surfaces, for example the rear bowtie-shaped surfaces 56, described below.

Returning to FIG. 17, the rear portion 52 of the top and bottom surfaces 46, 66 may comprise a generally planar rear central surface 53 extending rearwardly from the transition portion 51 toward the intermediate portion 24 of the adapter 12 between two opposing rear side-sloping surfaces 54 extending rearwardly from the transition portion 51 and sloping downwardly (e.g., in direction D, see FIG. 15) away from the rear central surface 53 in the transverse direction (e.g., along directions +B and −B). The rear side-sloping surfaces 54 function to provide increased stability, for example during upward, downward, and sideways loading of the tip assembly 10 by acting as wedging surfaces to reduce relative motion and increase contact area between the symmetrical nose 27 and the tip 14. Further, increased contact area provided by the rear side-sloping surfaces 54 may reduce stresses through the symmetrical nose 27.

As the rear central surfaces 53 extend rearward from the transition portion 51, the transverse width (e.g., along directions +B and −B) of the rear central surfaces 53 may first increase, and subsequently decrease. In some embodiments, the width of the rear central surface 53 proximate the front central surface 49 ranges from 0.1 to 0.4 times, preferably about 0.23 times the transverse width at the rear ("RTW") of the nose 26 (at vertical plane "P"). In some embodiments, the width of the rear central surface 53 at its widest point as it extends rearward from adjacent the front central surface 49 ranges from 0.6 to 0.9 times, preferably about 0.73 times the transverse width at the rear ("RTW") of the nose 26. In some embodiments, the width of the rear central surface 53 proximate the intermediate portion 24 of the adapter 12 ranges from 0.3 to 0.6 times, preferably about 0.46 times the transverse width at the rear ("RTW") of the nose 26. As illustrated in FIG. 15, the rear central surfaces 53 may extend away (e.g., in directions U and D) from the substantially longitudinal axis "A" as they extend rearward. The differing angles of the front central surfaces 49 and the rear central surfaces 53 with respect to the substantially longitudinal axis "A" provide the advantage of creating friction on the front central surfaces 49, transferring load from the retention mechanism 13 to the symmetrical nose 27 of the adapter 12. As shown for example in FIG. 15, the rear central surface 53 may be oriented with respect to the front central surfaces 49 such that an angle between the surfaces ranges from 0° to 15°, preferably about 9°. Further, an angle of inclination of the rear central surfaces 53 may be about 5° to 25°, preferably 14° with respect to the substantially longitudinal axis "A". The slope of the rear central surfaces 53 facilitates insertion of the symmetrical nose 27 into the symmetrical nose cavity 127 (FIG. 27) of the tip 14, while the width of the rear central surfaces 53 limits the twisting of the tip 14 once the tip 14 is installed on the symmetrical nose 27.

As illustrated in FIG. 17, the rear side-sloping surfaces 54 may comprise a generally planar triangular front bowtie-shaped surface 55 and a generally planar triangular rear bowtie-shaped surface 56 oriented with vertices pointing toward each other. The front bowtie-shaped surfaces 55 provide the advantage of acting as a main wedging surface during push-on loading. As shown for example in FIG. 15, the front bowtie-shaped surfaces 55 may be inclined as they extend in the rearward direction R with respect to the front side-sloping surfaces 50. For example, the front bowtie-shaped surfaces 55 may be oriented with respect to the front side-sloping surfaces 50 such that an angle between the two surfaces ranges from 15° to 27.5°, preferably about 21.5°. Further, as shown for example in FIG. 16, the front bowtie-shaped surfaces 55 may be inclined toward the side surfaces 60 as they extend in the transverse direction (e.g., along directions +B and −B) from the rear central surfaces 53. For example, the front bowtie-shaped surfaces 55 may be oriented with respect to the rear central surfaces 53 such that an angle between the two surfaces ranges from 17.5° to 32.5°, preferably about 25°.

As shown for example in FIGS. 15 and 17, the rear bowtie-shaped surfaces 56 may be inclined toward the side surfaces 60 as they extend in the transverse direction (e.g., along directions +B and −B) from the rear central surfaces 53. The angle of inclination between the rear bowtie-shaped surfaces 56 and the rear central surfaces 53 may differ from the angle of incline between the front bowtie-shaped surfaces 55 and the rear central surfaces 53. More specifically, the angle of incline between the rear bowtie-shaped surfaces 56 and the rear central surfaces 53 may be greater than the angle of incline between the front bowtie-shaped surfaces 55 and the rear central surfaces 53. For example, the rear bowtie-shaped surfaces 56 may be oriented with respect to the rear central surfaces 53 such that an angle between the surfaces ranges from 30° to 45°, preferably about 37.5°. Further, as the rear bowtie-shaped surfaces 56 extend rearward from the front bowtie-shaped surfaces 55, the rear bowtie-shaped surfaces 56 may be oriented about parallel to the substantially longitudinal axis "A". Alternatively, as the rear bowtie-shaped surfaces 56 extend rearward from the front bowtie-shaped surfaces 55, the rear bowtie-shaped surfaces 56 may be angled away from each other in the vertical direction, but at a shallower angle than that of the front bowtie-shaped surfaces 55 with respect to the substantially longitudinal axis "A". For example, rear bowtie-shaped surfaces 56 may be oriented with respect to the front bowtie-shaped surfaces 55 such that an angle between the two surfaces ranges from 18.5° to 30°, preferably about 24.5°. The relative surface angles of the front side-sloping surfaces 50, front bowtie-shaped surfaces 55, and rear bowtie-shaped surfaces 56 provide the advantage of wedging the tip 14 onto the symmetrical nose 27, especially during front loading, reducing overall motion of the tip 14 and dispersing stresses and wear through the symmetrical nose 27.

As illustrated in FIG. 17, the front portion 48 of the top and bottom surfaces 46, 66 of the symmetrical nose 27, the rear portion 52 of the top and bottom surfaces 46 of the symmetrical nose 27, and the intermediate portion 24 of the adapter 12, and may each be separated by transition portions 51, which may comprise one or more curved surfaces translating between the relative angles of the otherwise adjoining, generally planar surfaces. The individually defined surfaces within the front portions 48 and the rear portions 52 of the top and bottom surfaces 46, for example the front and rear central surfaces 49, 53, the front side-sloping surfaces 50, and the front and rear bowtie-shaped surfaces 55, 56 may also be separated by transition portions 51.

As shown in FIG. 15, the side surfaces 60 of the symmetrical nose 27 may be generally planar and extend between the top and bottom surfaces 46, 66. The side surfaces 60 may comprise a generally planar front side surface 61 disposed proximate the front surface 36, a generally planar intermediate side surface 62 extending rearwardly from the front side surface 61, and a rear side surface 63 extending rearwardly from the intermediate side surface to the intermediate portion 24 of the adapter 12. The front side surfaces 61 may be longitudinally aligned such that they separate the front side-sloping surfaces 50 of the top and bottom surfaces 46. The intermediate side surfaces 62 may be longitudinally aligned such that they separate the front bowtie-shaped surfaces 55 of the top and bottom surfaces 46. The rear side surfaces 63 may be longitudinally aligned such that they separate the rear bowtie-shaped surfaces 56 of the top and bottom surfaces 46.

As shown in FIG. 17, the front side surfaces 61 and the intermediate side surfaces 62 may be parallel and continuous as they extend rearward from the side edges 38 of the front surface 36. The front side surfaces 61 and the intermediate side surfaces 62 may be oriented with respect to the front surface 36 such that an angle between the surfaces ranges from 90° to 105°, preferably about 93°. Further, as shown in FIG. 15, the front side surfaces 61 may be configured such that the distance between the top and bottom surfaces 46, 66 is substantially constant as the front side surfaces 61 extend rearward from the side edges 38. Alternatively, the front side surfaces 61 may be configured such that the distance between the top and bottom surfaces 46, 66 increases slightly as the front side surfaces 61 extend rearward from the side edges 38. The intermediate side surfaces 62 may be configured such that the distance between the top and bottom surfaces 46, 66 substantially increases as the intermediate side surfaces 62 extend rearward.

As shown in FIG. 17, the rear side surfaces 63 may be angled outwardly (e.g., along directions +B and −B) with respect to the front side surfaces 61 and the intermediate side surfaces 62 as they extend rearward from the intermediate side surfaces 62 such that the transverse distance between the rear side surfaces 63 symmetrically increases as the rear side surfaces 63 extend rearward. For example, the rear side surfaces 63 may be angled outwardly with respect to the intermediate side surfaces 62 at an angle ranging from greater than 0° to 15°, preferably about 7°. Angles greater than 0° provide the advantages of allowing the rear side surfaces 63 to act as wedging surfaces during push-on loading, increasing the contact surface between the adapter 12 and tip 14 during operation, and thereby reducing slippage and wear, and improving removability by reducing the friction between the adapter 12 and tip 14 during removal. Alternatively, in some exemplary embodiments, the rear side surfaces 63 may be substantially parallel to the intermediate side surfaces 62. In some exemplary embodiments, the rear side surfaces 63 may be configured such that the distance between the top and bottom surfaces 46, 66 decreases slightly as the rear side surfaces 63 extend rearward.

Figure 40:
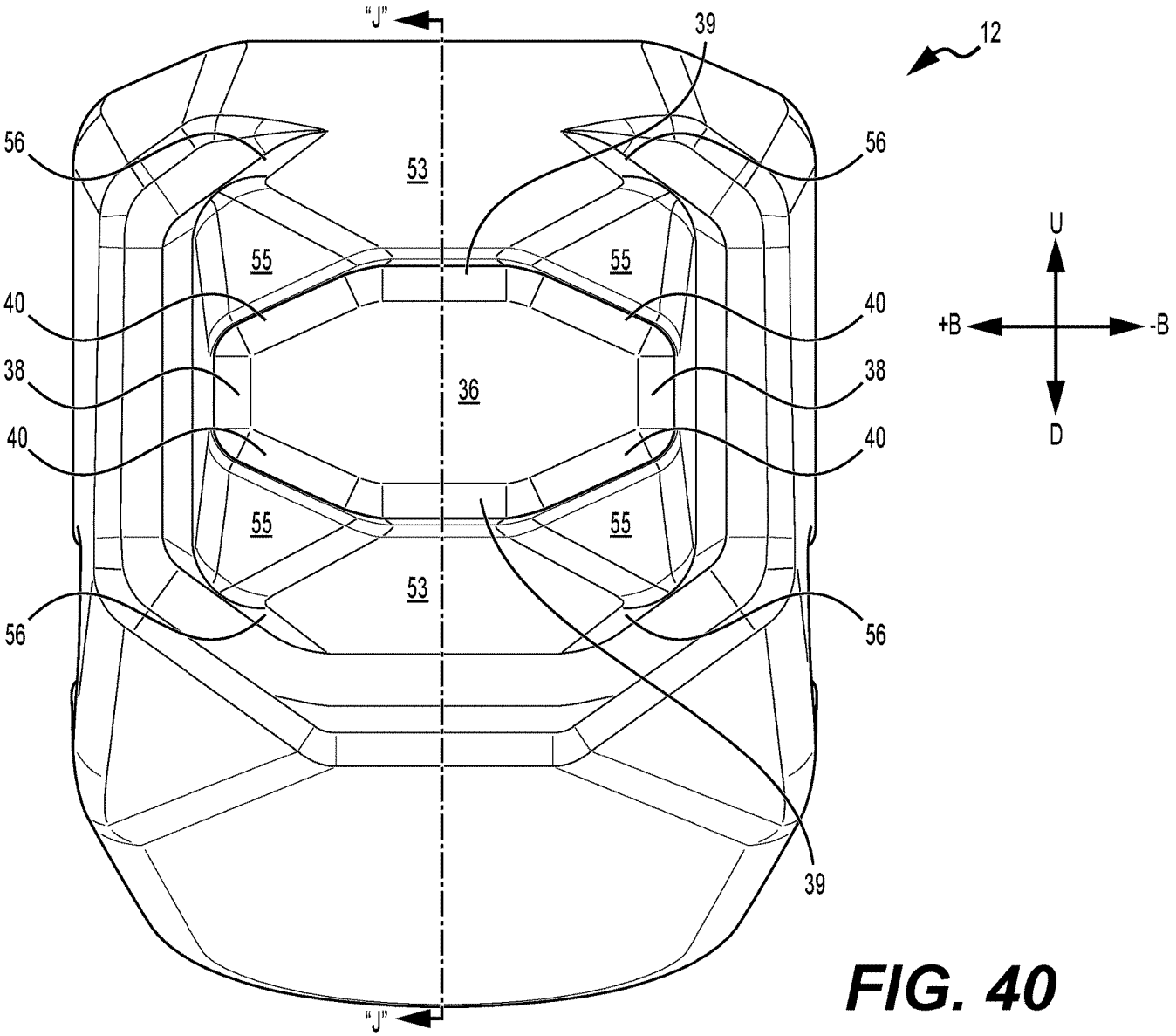
FIG. 40 illustrates a front elevation view of the adapter of FIG. 12 in accordance with the present disclosure.
Figure 41:
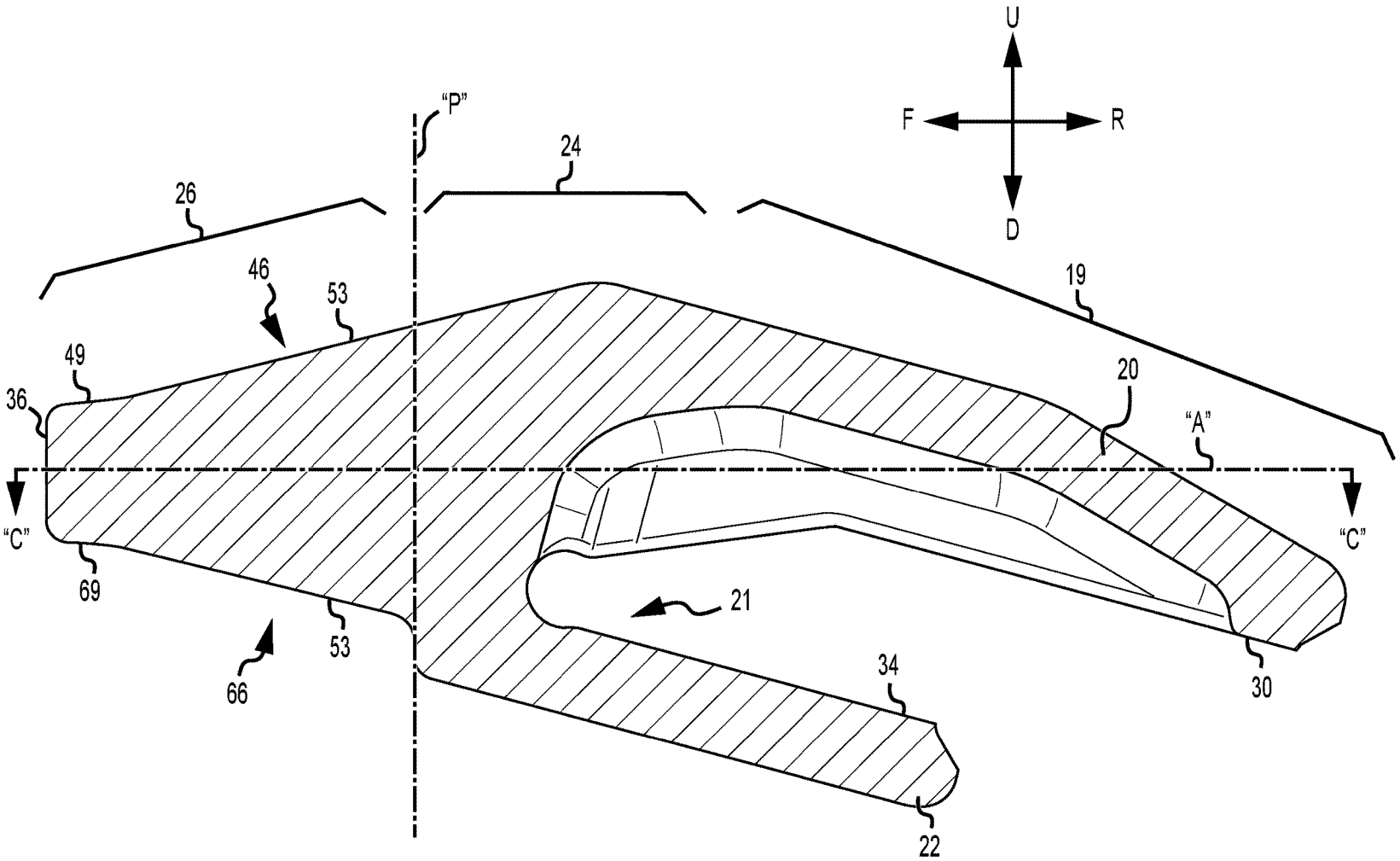
FIG. 41 illustrates a vertical cross-sectional view of the adapter of FIG. 12 taken along line J-J shown in FIG. 40 in accordance with the present disclosure.

The front side surfaces 61, intermediate side surfaces 62, and rear side surfaces 63 of the side surfaces 60 of the symmetrical nose 27, the top and bottom surfaces 46 and the intermediate portion 24 of the adapter 12 may each be separated by transition portions 51, which may comprise one or more curved surfaces translating between the relative angles of the otherwise adjoining, generally planar surfaces. FIG. 40 illustrates a front elevation view of the adapter 12 of FIG. 12, and FIG. 41 illustrates a vertical cross-sectional view of the adapter 12 taken along line J-J shown in FIG. 40. Some of the surfaces associated with symmetrical nose 27 of the adapter 12 of FIG. 12 and discussed above are also illustrated in FIG. 41.

Figure 42:
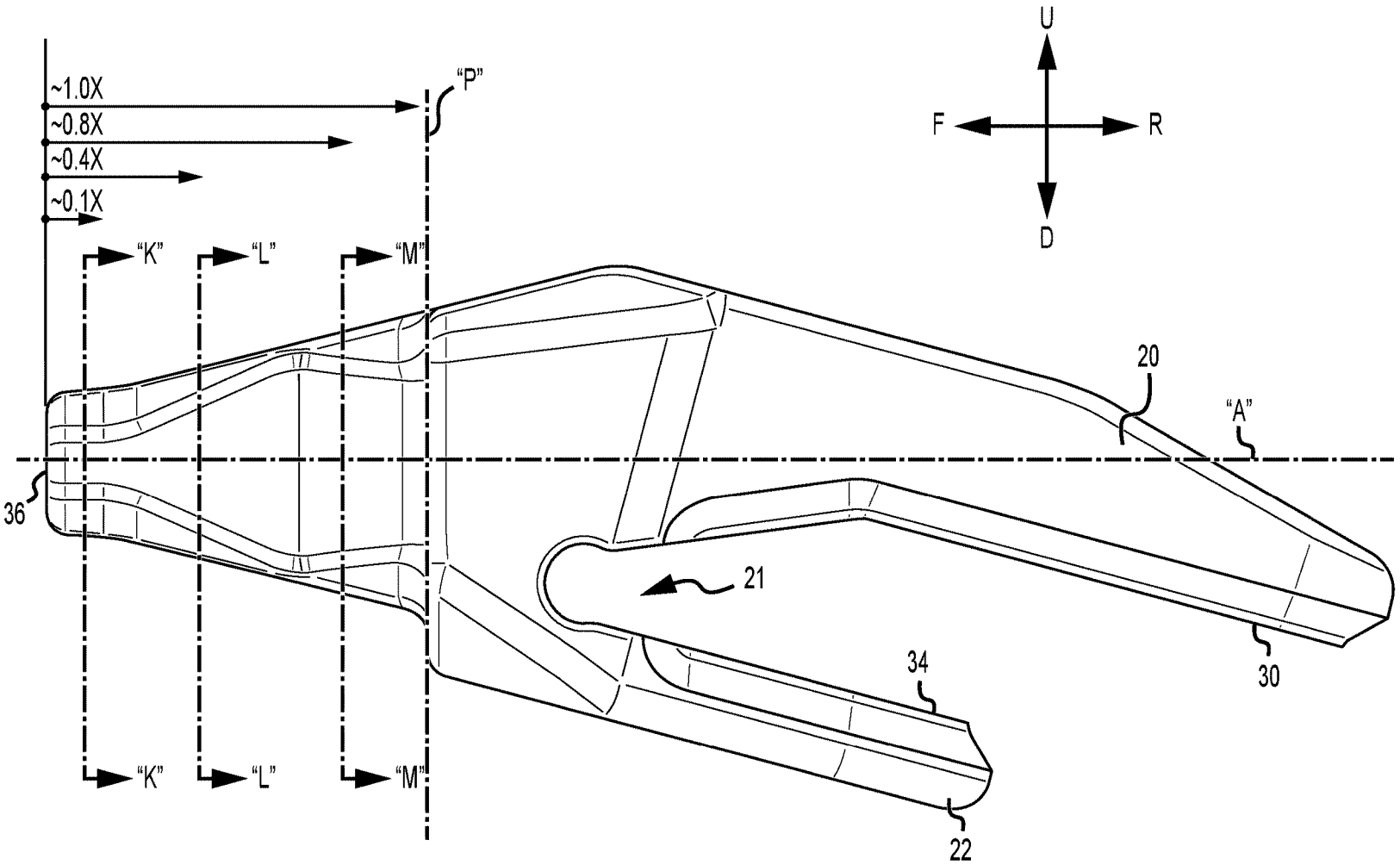
FIG. 42 illustrates a side view of the adapter of FIG. 12 with section lines K-K, L-L, and M-M in accordance with the present disclosure.
Figure 43:
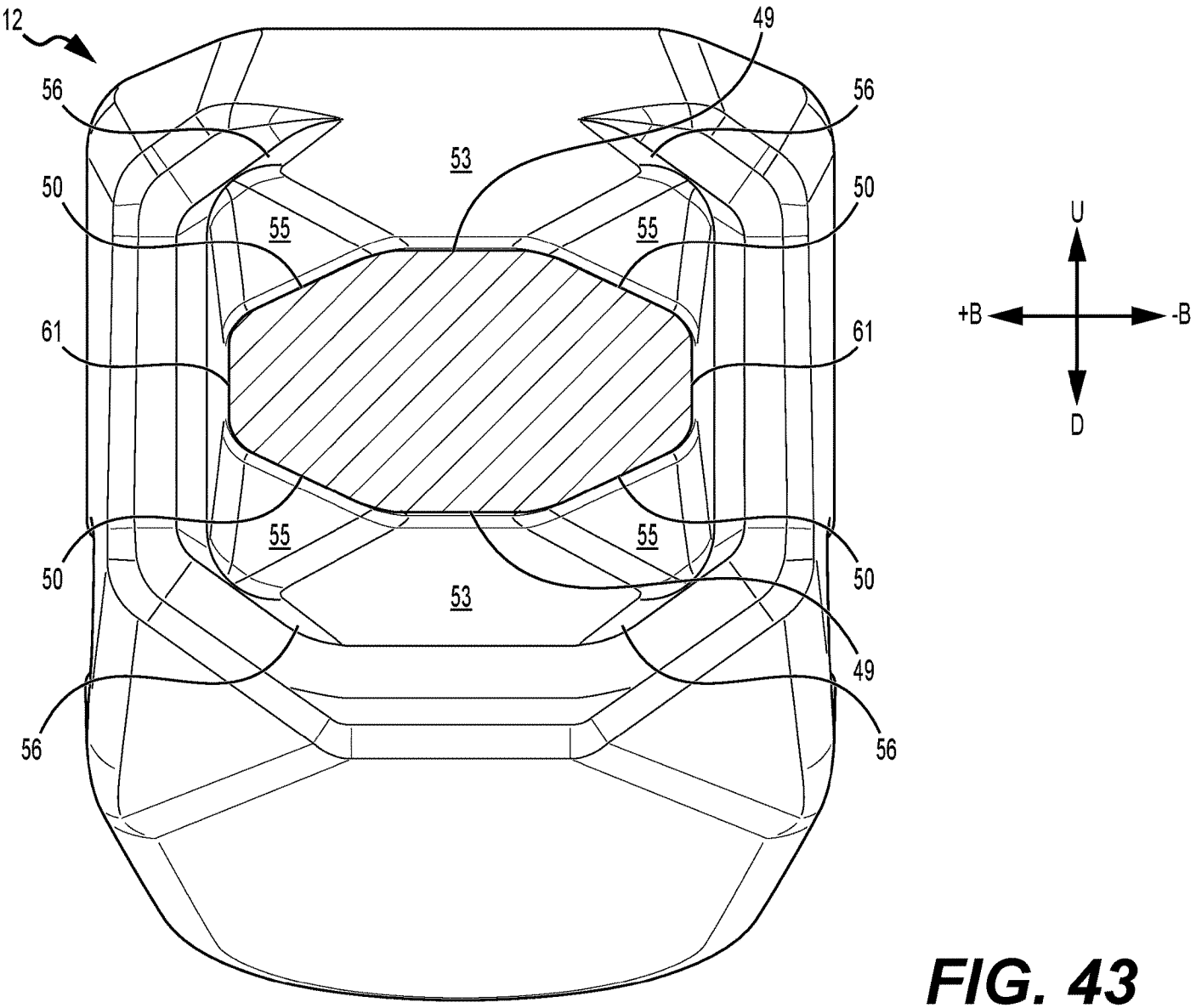
FIG. 43 illustrates a cross-sectional view of the symmetrical nose of the adapter of FIG. 12 along line K-K as shown in FIG. 42 in accordance with the present disclosure.
Figure 44:
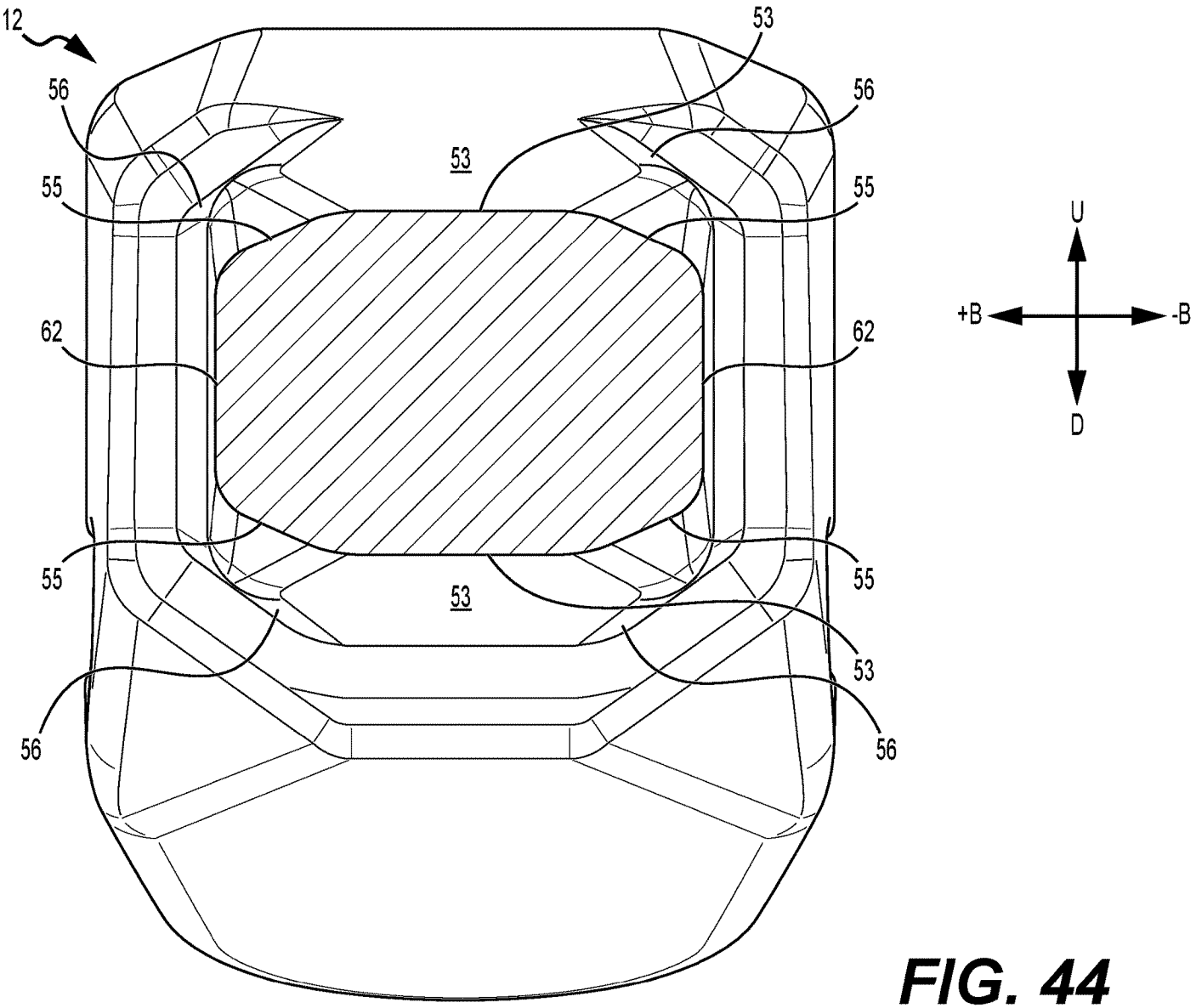
FIG. 44 illustrates a cross-sectional view of the symmetrical nose of the adapter of FIG. 12 along line L-L as shown in FIG. 42 in accordance with the present disclosure.

As shown in FIG. 15, the vertical height at the rear ("RVH") of the symmetrical nose 27 (at the vertical plane "P") may range from 0.5 to 1.0 times the longitudinal length ("LL") of the symmetrical nose 27, where the longitudinal length ("LL") is defined as the distance along the substantially longitudinal axis "A" from the vertical plane "P" to the front surface 36. The vertical height at the front ("FVH") of the symmetrical nose 27 (at the front surface 36) may range from 0.2 to 0.5 times the longitudinal length ("LL") of the symmetrical nose 27. As shown in FIG. 17, the transverse width at the rear ("RTW") of the symmetrical nose 27 (at the vertical plane "P") may range from 0.8 to 2.0 times the transverse width at the front ("FTW") of the symmetrical nose 27 (at the front surface 36). The transverse width at the front ("FTW") of the symmetrical nose 27 (at the front surface 36) may range from 0.4 to 1.5 times the longitudinal length ("LL") of the symmetrical nose 27. The longitudinal length ("LL") of the symmetrical nose 27 may range from 0.7 to 2.0 times the transverse width ("RTW") at the rear of the symmetrical nose 27 (at the vertical plane "P"). A FIG. 42 illustrates a side view of the adapter 12 of FIG. 12 with section lines K-K, L-L, and M-M. As illustrated in FIG. 42, section planes corresponding to lines K-K, L-L, and M-M may be located at distances of about 0.1×, 0.4×, 0.8×, and 1.0× from front surface 36 of symmetrical nose 27. FIG. 43 illustrates a cross-sectional view of symmetrical nose 27 along line K-K as shown in FIG. 42. As illustrated in FIG. 43, front central surface 49 may be positioned between two generally planar, opposing front side-sloping surfaces 50 sloping toward the side surfaces 60 in the transverse direction (e.g. along directions +B and −B), away from the front central surface 49. The front side-sloping surfaces 50 may be oriented with respect to the front central surfaces 49 such that the surfaces form an angle ranging from 18.5° to 30°, preferably about 24.5°. FIG. 44 illustrates a cross-sectional view of symmetrical nose 27 along line L-L as shown in FIG. 42. As illustrated in FIG. 44, the front bowtie-shaped surfaces 55 may be inclined toward the side surfaces 60 as they extend in the transverse direction (e.g., along directions +B and −B) from the rear central surfaces 53. For example, the front bowtie-shaped surfaces 55 may be oriented with respect to the rear central surfaces 53 such that an angle between the two surfaces ranges from 17.5° to 32.5°, preferably about 25°.

Figure 45:
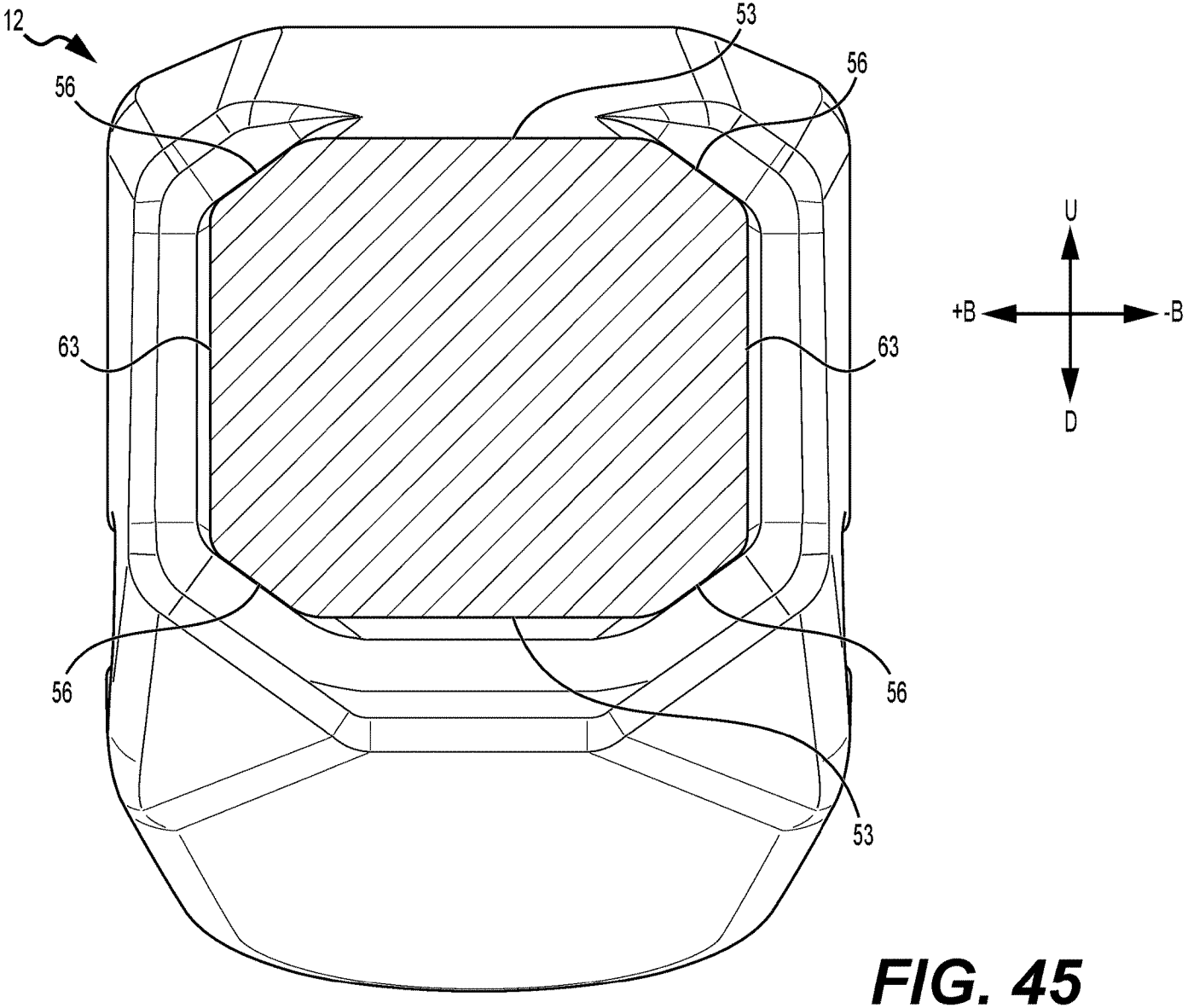
FIG. 45 illustrates a cross-sectional view of the symmetrical nose of the adapter of FIG. 12 along line M-M as shown in FIG. 42 in accordance with the present disclosure.

FIG. 45 illustrates a cross-sectional view of symmetrical nose 27 along line M-M as shown in FIG. 42. As illustrated in FIG. 45, the rear bowtie-shaped surfaces 56 may be inclined toward the side surfaces 60 as they extend in the transverse direction (e.g., along directions +B and −B) from the rear central surfaces 53. The angle of inclination between the rear bowtie-shaped surfaces 56 and the rear central surfaces 53 may differ from the angle of incline between the front bowtie-shaped surfaces 55 and the rear central surfaces 53. More specifically, the angle of incline between the rear bowtie-shaped surfaces 56 and the rear central surfaces 53 may be greater than the angle of incline between the front bowtie-shaped surfaces 55 and the rear central surfaces 53. For example, the rear bowtie-shaped surfaces 56 may be oriented with respect to the rear central surfaces 53 such that an angle between the surfaces ranges from 30° to 45°, preferably about 37.5°.

Tip Corresponding to Asymmetrical Adapter (FIGS. 18-25 and 46-49)

Figure 18:
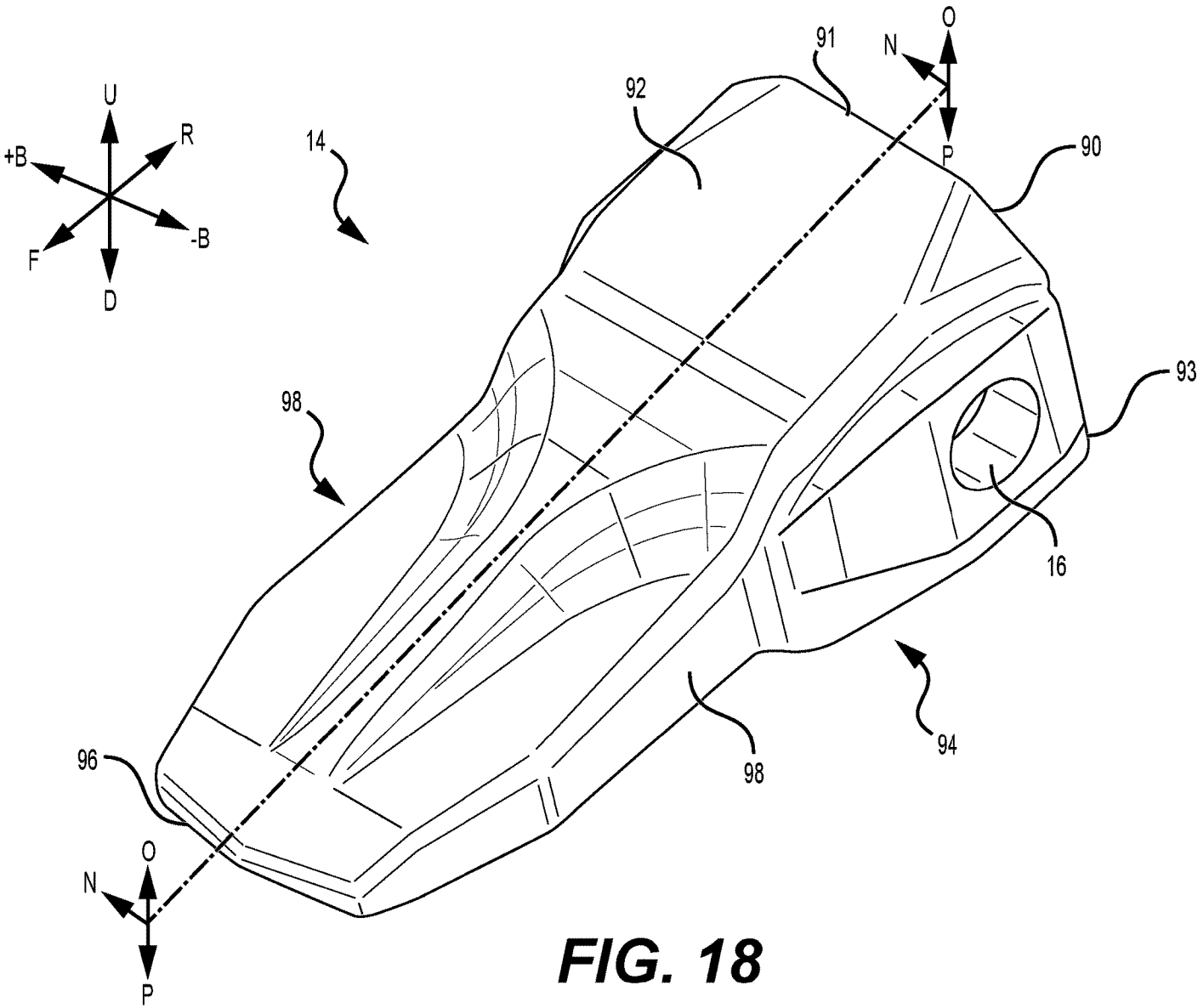
FIG. 18 is an isometric view of an exemplary tip in accordance with the present disclosure.
Figure 19:
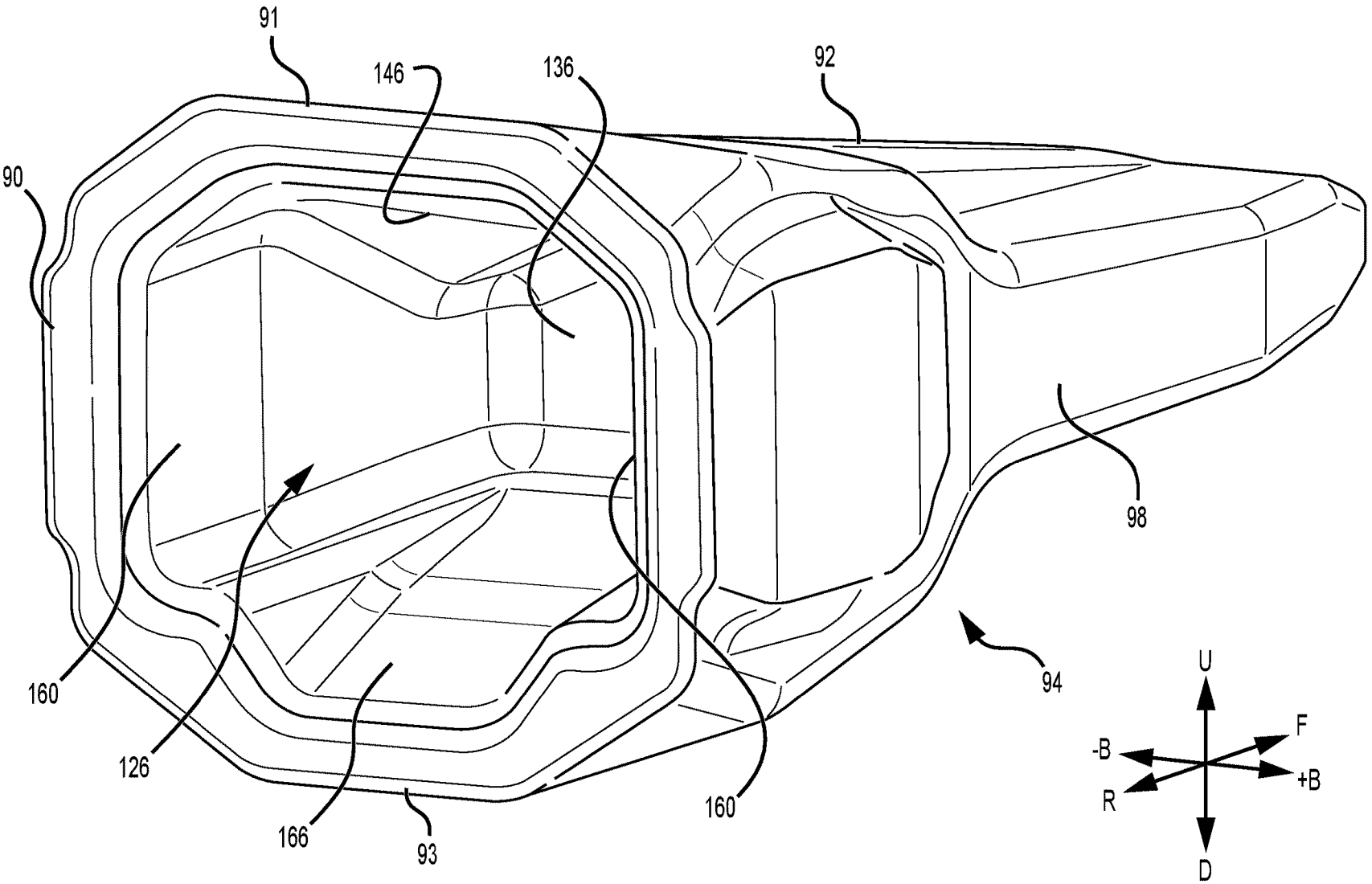
FIG. 19 is another isometric view of the tip of FIG. 18 in accordance with the present disclosure.

FIGS. 18 and 19 illustrate isometric views of the tip 14 corresponding to the nose 26 of the adapter 12 of FIG. 4. A tip 14 corresponding to the nose 26 of the adapter 12 is shown in greater detail in FIGS. 18-25 and 46-49. Referring to FIG. 18, the tip 14 may be generally wedge-shaped and have a rear edge 90. The tip may have a top outer surface 92 extending forward (e.g., in direction F) from a top edge 91 of the rear edge 90, and a bottom outer surface 94 extending forward from a bottom edge 93 of the rear edge 90. The top outer surface 92 may be angled downwardly (e.g., in direction D), and the bottom outer surface 94 may be angled upwardly (e.g., in direction U) relative to the rear edge 90 such that the top outer surface 92 and the bottom outer surface 94 converge at a front edge 96 at the front of the tip 14. The tip 14 also includes lateral outer surfaces 98 extending between the top outer surface 92 and the bottom outer surface 94 on either side of the tip 14. Each of the lateral outer surfaces 98 may have a corresponding one of the retention apertures 16 therein into which a retention mechanism 13 (not shown) may be inserted to hold the tip 14 in place on the nose 26 of the adapter 12 (as shown in FIG. 3). The retention apertures 16 may comprise, for example, through-holes configured to accept the retention mechanism 13. The retention apertures 16 may further comprise ramped surfaces, alignment slots, threading and/or internal recesses. Alternative configurations of the outer surfaces 92, 94, 98 and edges 90, 96 of tip 14 would be compatible with the embodiments of the adapter 12 described above for the tip assemblies 10 according to the present disclosure. It is also contemplated that the tip assemblies 10 according to the present disclosure are not limited to any particular configuration of the outer surfaces and edges of the tip 14.

As shown in FIG. 19, the tip 14 may be configured to be received onto the nose 26 of the adapter 12. A nose cavity 126 may be defined within the tip 14. The nose cavity 126 may have a complementary configuration relative to the nose 26 of the adapter 12, and may include a bottom inner surface 166, a top inner surface 146, a pair of opposing side inner surfaces 160 extending between the top inner surface 146 toward the bottom inner surface 166, and a front inner surface 136.

Figure 20:
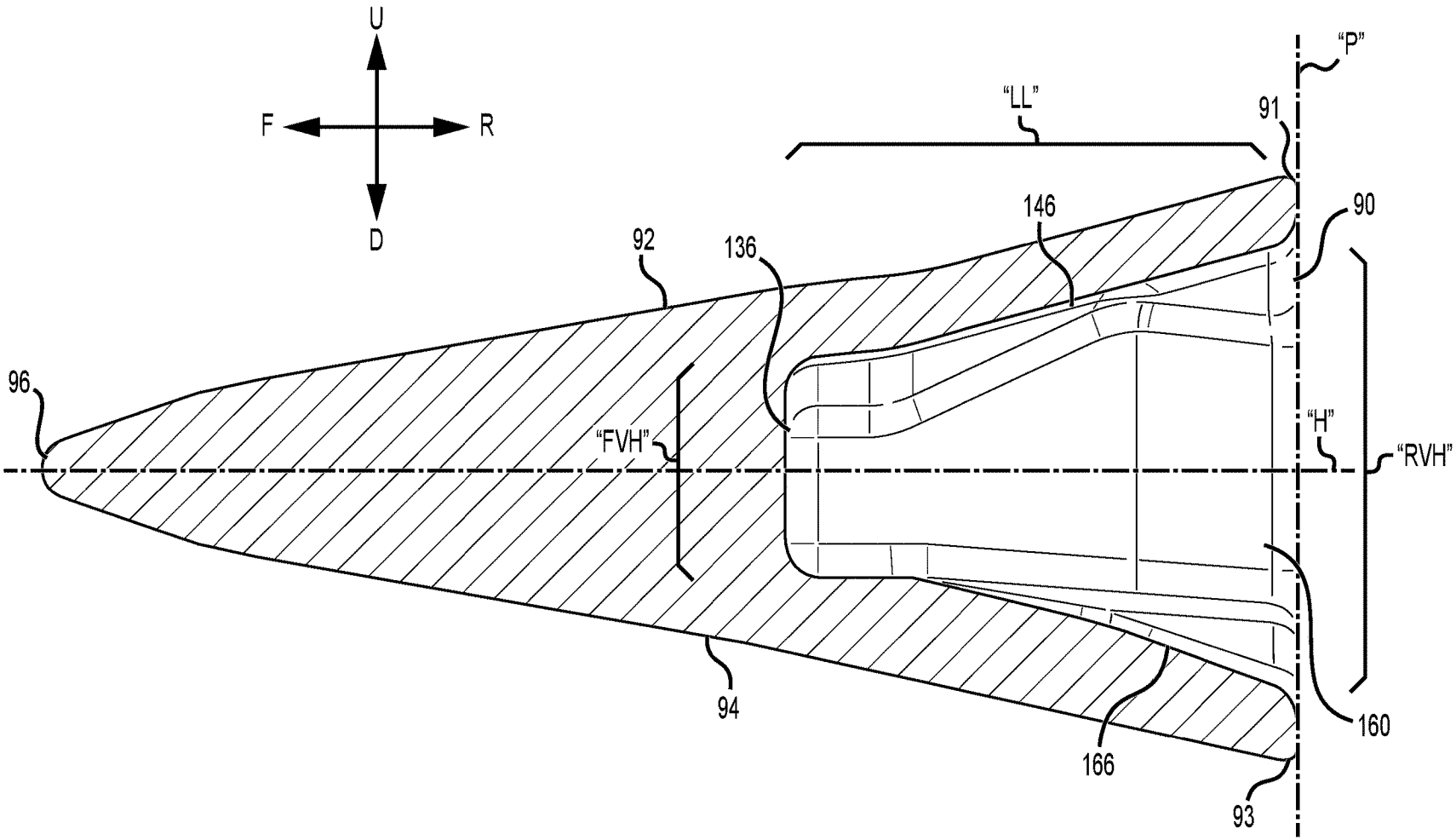
FIG. 20 is a vertical cross section side view along line N-N of the tip of FIG. 18 in accordance with the present disclosure.
Figure 21:
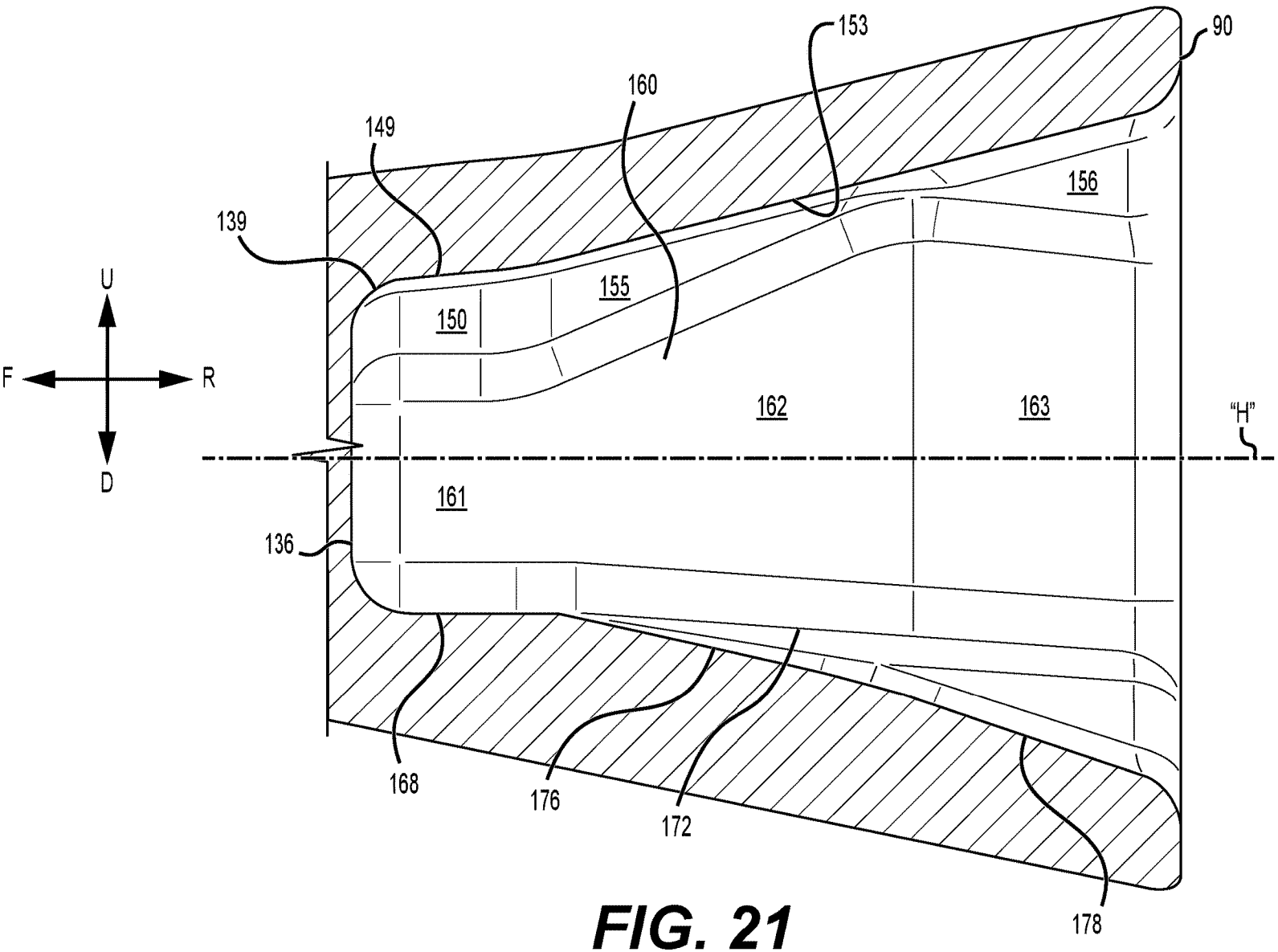
FIG. 21 is a vertical cross section side view along line N-N of a nose cavity of the tip of FIG. 18 in accordance with the present disclosure.

FIG. 20 illustrates a vertical cross section side view of the tip 14 taken along line N-N of FIG. 18. FIG. 21 illustrates a magnified view of the vertical cross section side view of the tip 14 taken along line N-N of FIG. 18 showing the nose cavity 126. The front inner surface 136 of the nose cavity 126 may be planar, as shown in FIGS. 20 and 21, or may include a degree of curvature. As shown in the illustrated embodiment, the front inner surface 136 may be oriented about perpendicular to a substantially longitudinal axis "H", the orientation of which is defined by being centered between the opposing side inner surfaces 160 of the nose cavity 126 and the top outer surface 92 and bottom outer surface 94 of the tip 14. Alternatively, front inner surface 136 may be angled 1°-5° away from the rear edge 90 or 1°-15° toward the rear edge 90 as it extends upwardly from the bottom inner surface 166.

Figure 22:
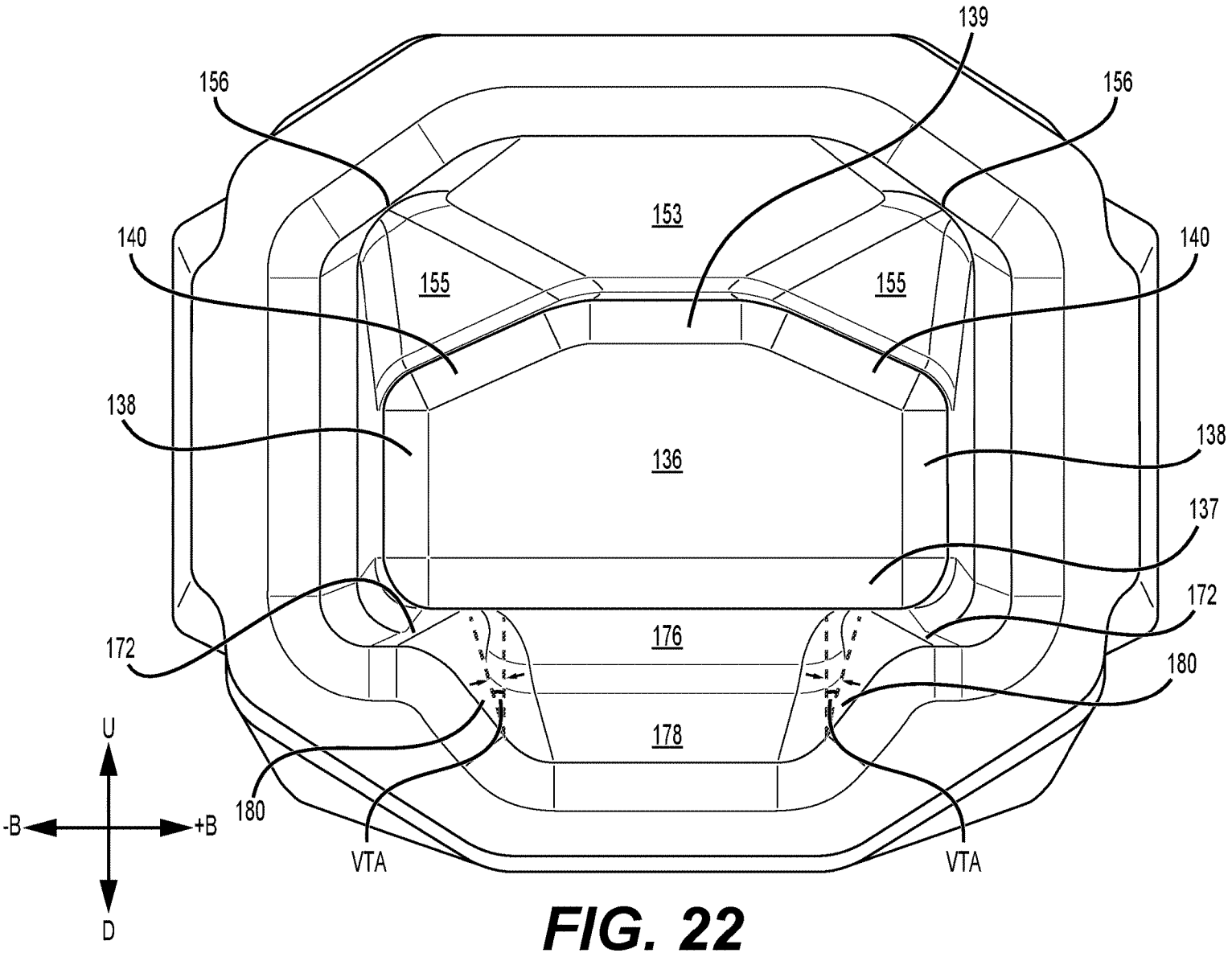
FIG. 22 is a rear view of the tip of FIG. 18 in accordance with the present disclosure.

FIG. 22 is a rear view of the tip 14 of FIG. 18. As shown in FIG. 22, the front inner surface 136 may be hexagonally shaped, comprising a bottom inner edge 137, opposing side inner edges 138 oriented at about 90° with respect to the bottom inner edge 137, a top horizontal inner edge 139 oriented about parallel to the bottom inner edge 137, and opposing top sloping inner edges 140 connecting the top horizontal inner edge 139 to the side inner edges 138. An angle between the top horizontal inner edge 139 and top sloping inner edges 140 ranges from about 18.5° to 30°, preferably about 24.5°. Inner edges 137-140 may be curved.

Figure 23:
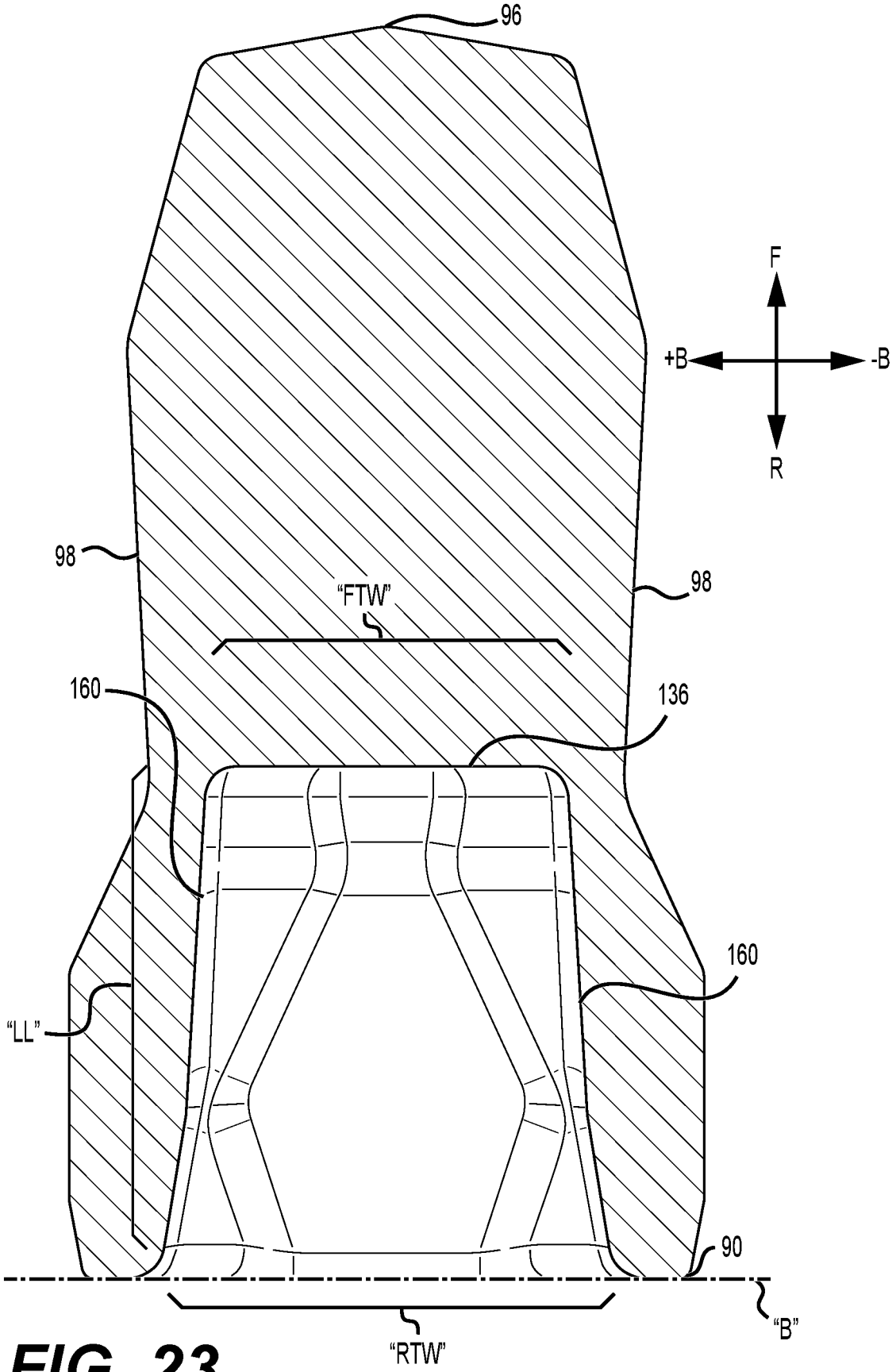
FIG. 23 is a horizontal cross section bottom view along line O-O of the tip of FIG. 18 in accordance with the present disclosure.
Figure 24:
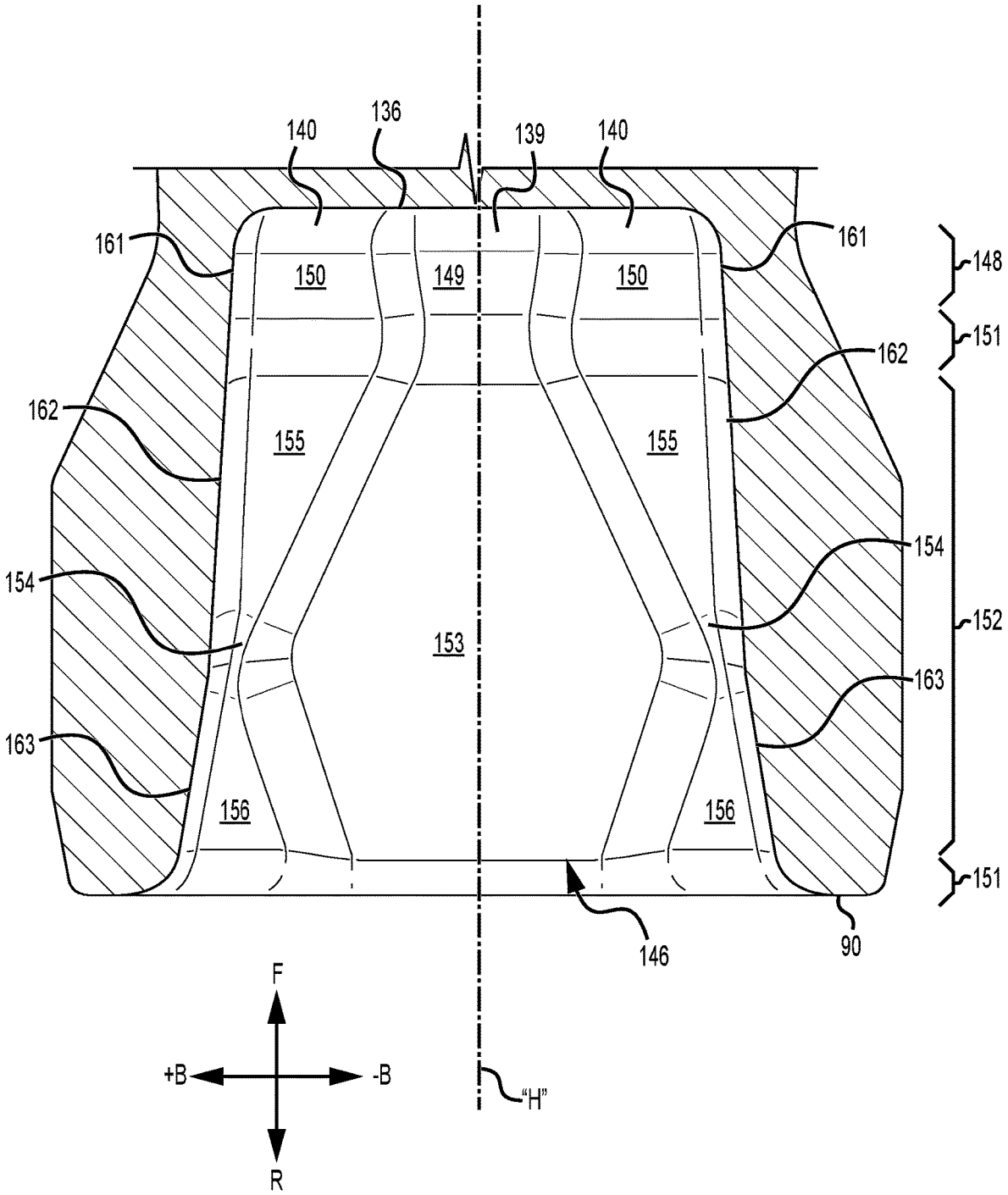
FIG. 24 is a horizontal cross section bottom view along line O-O of the nose cavity of FIG. 18 in accordance with the present disclosure.

FIG. 23 illustrates a horizontal cross section bottom view of the tip 14 taken along line O-O of FIG. 18. FIG. 24 illustrates a magnified view of the horizontal cross section bottom view of the tip 14 taken along line O-O of FIG. 18 showing the nose cavity 126. The top inner surface 146 of the nose cavity 126, as shown in FIGS. 23 and 24, may be configured to support the tip 14 during use of the loader bucket assembly 1 or excavator bucket assembly 6, and to facilitate retention of the tip 14 on the nose 26 when bearing the load of the work material. As shown in FIG. 24, the top inner surface 146 may include a front inner portion 148 disposed proximate the front inner surface 136, a transition portion 151 extending rearwardly (e.g., in direction R), and a rear portion 152 extending rearwardly from the transition portion 151 toward the rear edge 90. Front inner portion 148 may comprise a generally planar front central inner surface 149 extending rearwardly from the top horizontal inner edge 139 of front inner surface 136 between two generally planar, opposing front side-sloping inner surfaces 150 extending rearwardly from the top sloping inner edges 140 of front inner surface 136 and sloping downwardly away from the front central inner surface 149 in the transverse direction (e.g., along directions +B and −B). As the front central inner surface 149 extends rearward from the top horizontal inner edge 139, the transverse width (e.g., along directions +B and −B) of the front central inner surface 149 may decrease symmetrically, resulting in the front central inner surface 149 having a shape like an isosceles trapezoid, as shown in the illustrated embodiment in FIG. 24. Alternatively, the transverse width of the front central inner surface 149 may be constant or increase as the front central inner surface 149 extends rearward from the top horizontal inner edge 139.

As shown in FIG. 21, the front central inner surface 149 may extend upwardly (e.g., in direction U) away from top horizontal inner edge 139 such that the front central inner surface 149 and front inner surface 136 form an angle ranging from 91° to 105°, preferably about 95°. Alternatively, the front central inner surface 149 may extend substantially perpendicular to the front inner surface 136, for example, forming an angle ranging from 88° to 92°, preferably 90°. Alternatively, the front central inner surface 149 may extend at an acute angle to the front inner surface 136, for example, forming an angle ranging from 85° to 89°. The front side-sloping inner surfaces 150 may be oriented with respect to the front central inner surface 149 such that the two surfaces form an angle ranging from 18.5° to 30°, preferably about 24.5°. The front side-sloping inner surfaces 150 provide stability to the tip assembly 10 during downward and sideways loading patterns, for example, by acting as wedging surfaces to reduce relative motion between the nose 26 of the adapter 12 and the nose cavity 126 of the tip 14. The front side-sloping inner surfaces 150 additionally increase the contact area between the nose 26 of the adapter 12 and the nose cavity 126 of the tip 14, reducing stress throughout the nose 26. Further, the front side-sloping inner surfaces 150 additionally increase the frictional force when load is applied to the tip assembly 10, reducing loading on the tip 14 and the retention mechanism 13, especially in combination with other transversely sloping surfaces, for example the channel sides surfaces 180, described below.

Returning to FIG. 24, the rear portion 152 of the top inner surface 146 may comprise a generally planar rear central inner surface 153 extending rearwardly from proximate the front central inner surface 149 toward the rear edge 90 between two opposing rear side-sloping inner surfaces 154, which in turn extend rearwardly from the front side-sloping inner surfaces 150 and sloping away from the rear central inner surface 153 in the transverse direction (e.g., directions +B and −B). The rear side-sloping inner surfaces 154 function to provide increased stability, for example during downward and sideways loading of the tip assembly 10 by acting as wedging surfaces to reduce relative motion and increase contact area between the nose 26 and the tip 14. Further, increased contact area provided by the rear side-sloping inner surfaces 154 may reduce stresses through the nose 26.

As rear central inner surface 153 extends rearward from the front central inner surface 149, the transverse width (e.g., along directions +B and −B) of the rear central inner surface 153 may first increase, and subsequently decrease. In some embodiments, the width of the rear central inner surface 153 proximate the front central inner surface 149 ranges from 0.1 to 0.4 times, preferably about 0.23 times the transverse width at the rear ("RTW") of the nose cavity 126 (at vertical plane "P" as shown in FIG. 23). In some embodiments, the width of the rear central inner surface 153 at its widest point as it extends rearward from the front central inner surface 149 ranges from 0.6 to 0.9 times, preferably about 0.73 times the transverse width at the rear ("RTW") of the nose cavity 126. In some embodiments, the width of the rear central inner surface 153 proximate the rear edge 90 ranges from 0.3 to 0.6 times, preferably about 0.46 times the transverse width at the rear ("RTW") of the nose cavity 126. As illustrated in FIG. 21, the rear central inner surface 153 may be inclined upwardly with respect to the front central inner surface 149. The differing angles of the front central inner surface 149 and the rear central inner surface 153 with respect to the substantially longitudinal axis "H" provide the advantage of creating friction on the front central inner surface 149, transferring load from the retention mechanism 13 to the nose 26 of the adapter 12. As shown for example in FIG. 21, the rear central inner surface 153 may be oriented with respect to the front central inner surface 149 such that an angle between the two surfaces ranges from 0° to 15°, preferably about 9°. Further, an angle of inclination of the rear central inner surface 153 may be about 5° to 25°, preferably 14° with respect to the substantially longitudinal axis "H". The slope of the rear central inner surface 153 facilitates insertion of the nose 26 into the nose cavity 126 of the tip 14, while the width of the rear central inner surface 153 limits the twisting of the tip 14 once the tip 14 is installed on the nose 26.

As illustrated in FIG. 24, rear side-sloping inner surfaces 154 may comprise a generally planar triangular front bowtie-shaped inner surface 155 and a generally planar triangular rear bowtie-shaped inner surface 156 oriented with vertices pointing toward each other. The front bowtie-shaped inner surfaces 155 provide the advantage of acting as a main wedging surface during push-on loading. As shown for example in FIG. 21, the front bowtie-shaped inner surfaces 155 may extend away (e.g., in direction U) from the substantially longitudinal axis "H" as they extend rearward. For example, the front bowtie-shaped inner surfaces 155 may be oriented with respect to the front side-sloping inner surfaces 150 such that an angle between the two surfaces ranges from 15° to 27.5°, preferably about 21.5°. Further, as shown for example in FIG. 22, the front bowtie-shaped inner surfaces 155 may be inclined downwardly as they extend in the transverse direction (e.g., directions +B and −B) from the rear central inner surface 153. For example, the front bowtie-shaped inner surfaces 155 may be oriented with respect to the rear central inner surface 153 such that an angle between the two surfaces ranges from 17.5° to 32.5°, preferably about 25°.

As shown for example in FIGS. 21 and 22, the rear bowtie-shaped inner surfaces 156 may be inclined downwardly as they extend in the transverse direction (e.g., along directions +B and −B) from the rear central inner surface 153. The angle of inclination between the rear bowtie-shaped inner surfaces 156 and the rear central inner surface 153 may differ from the angle of inclination between the front bowtie-shaped inner surfaces 155 and the rear central inner surface 153. More specifically, the angle of inclination between the rear bowtie-shaped inner surfaces 156 and the rear central inner surface 153 may be greater than the angle of inclination between the front bowtie-shaped inner surfaces 155 and the rear central inner surface 153. For example, the rear bowtie-shaped inner surfaces 156 may be oriented with respect to the rear central inner surface 153 such that an angle between the two surfaces ranges from 30° to 45°, preferably about 37.5°. Further, as the rear bowtie-shaped inner surfaces 156 extend rearward from the front bowtie-shaped inner surfaces 155, the rear bowtie-shaped inner surfaces 156 may be oriented about parallel to the substantially longitudinal axis "H". Alternatively, as the rear bowtie-shaped inner surfaces 156 extend rearward from the front bowtie-shaped inner surfaces 155, the rear bowtie-shaped inner surfaces 156 may be angled upward, but at a shallower angle than that of the front bowtie-shaped inner surfaces 155 with respect to the substantially longitudinal axis "H". For example, the rear bowtie-shaped inner surfaces 156 may be oriented with respect to the front bowtie-shaped inner surfaces 155 such that an angle between the two surfaces ranges from 18.5° to 30°, preferably about 24.5°. The relative surface angles of the front side-sloping inner surfaces 150, front bowtie-shaped inner surfaces 155, and rear bowtie-shaped inner surfaces 156 provide the advantage of wedging the tip 14 onto the nose 26, especially during front loading, reducing overall motion of the tip 14 and dispersing stresses and wear through the nose cavity 126.

As illustrated in FIG. 24, the front inner portion 148 of the top inner surface 146 of the nose cavity 126, the rear portion 152 of the top inner surface 146 of the nose cavity 126, and the rear edge 90 may each be separated by inner transition portions 151, which may comprise one or more curved surfaces translating between the relative angles of the otherwise adjoining, generally planar surfaces. The individually defined surfaces within the front inner portion 148 and the rear portion 152 of the top inner surface 146, for example the front and rear central inner surfaces 149, 153, the front side-sloping inner surfaces 150, and the front and rear bowtie-shaped inner surfaces 155, 156 may also be separated by inner transition portions 151.

Figure 25:
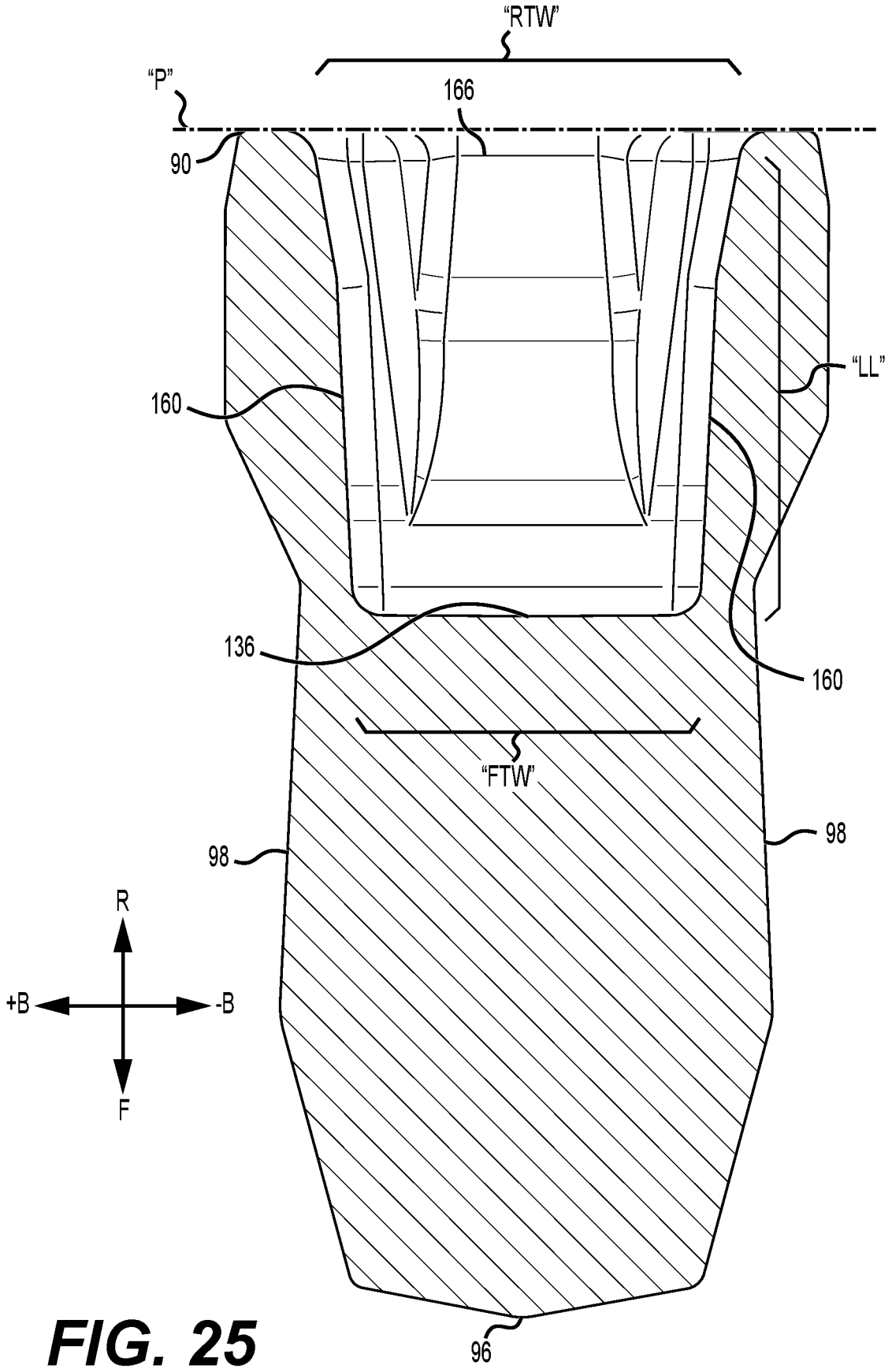
FIG. 25 is a horizontal cross section top view along line P-P of the tip of FIG. 18 in accordance with the present disclosure.
Figure 26:
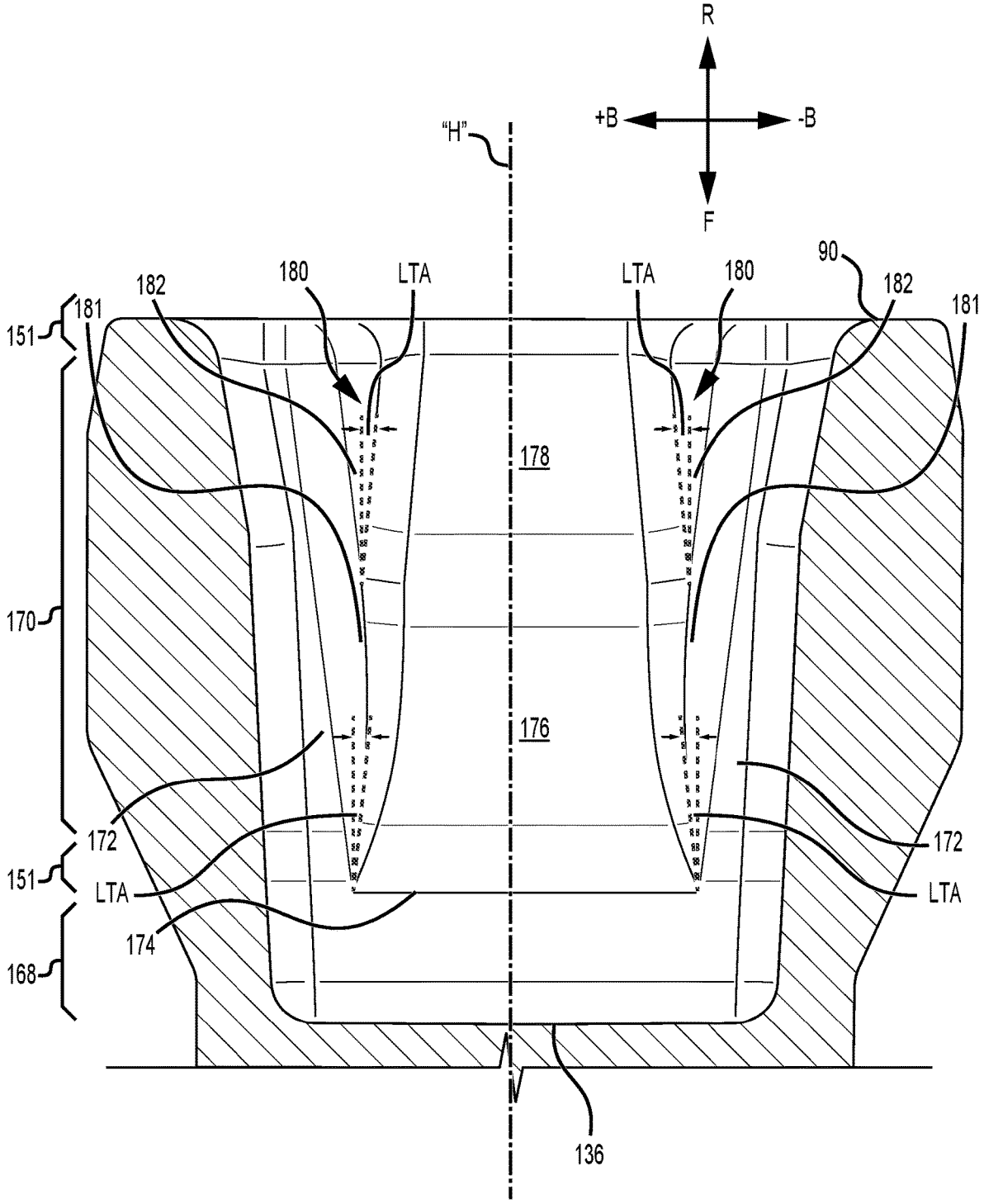
FIG. 26 is a horizontal cross section top view along line P-P of the nose cavity of FIG. 18 in accordance with the present disclosure.

FIG. 25 illustrates a horizontal cross section top view of the tip 14 taken along line P-P of FIG. 18. FIG. 25 illustrates a magnified view of the horizontal cross section top view of the tip 14 taken along line P-P of FIG. 18 showing the nose cavity 126. As seen in FIGS. 25 and 26, the bottom inner surface 166 may comprise a generally planar front portion 168 disposed proximate to and extending rearwardly (e.g., in direction R) from the front inner surface 136, a transition portion 151 extending rearwardly from front portion 168, and a rear portion 170 extending rearwardly from the transition portion 151 toward the rear edge 90 of the tip 14. The front portion 168 provides a flat stable surface to act as a main contact area during upload with the advantage of reducing wear on the tip assembly 10. As shown in FIG. 21, the front portion 168 may be oriented with respect to the front inner surface 136 at an angle ranging from 85° to 105°, preferably about 90°. Further, the front portion 168 may be oriented with respect to the front central inner surface 149 at an angle ranging from 0° to 15°, preferably about 5°. Such an orientation of the front portion 168 may provide the advantage of increased frictional force between the tip 14 and adapter 12, reducing slippage, for example, when the tip 14 is loaded in an upward direction, resulting in reduced loading on the retention mechanism 13.

Returning to FIGS. 21 and 26, the rear portion 170 of the bottom inner surface 166 may comprise opposing generally planar inner shoulder surfaces 172 inclined downwardly (e.g., in direction D of FIG. 21) or alternatively parallel relative to front portion 168 and a bottom channel 174 (see FIG. 26) inclined downwardly (e.g., in direction D of FIG. 21) relative to both the front portion 168 and the inner shoulder surfaces 172. As shown in FIG. 21, the inner shoulder surfaces 172 may be oriented downward (e.g., in direction D) with respect to the front portion 168 at an angle ranging from 0° to 10°, preferably about 4°.

The bottom channel 174 of the bottom inner surface 166, as seen in FIG. 26, may comprise a generally planar front channel portion 176 inclined downwardly (e.g., in direction D, see FIG. 21) relative to the front portion 168 and a generally planar rear channel portion 178 inclined downwardly (e.g., in direction D, see FIG. 21) relative to the front channel portion 176. Front channel portion 176 and rear channel portion 178 may extend between opposing channel side surfaces 180. The bottom channel 174 provides advantages such as increased stability during side loading and increasing wedging during push-on loading. As shown in FIG. 21, the front channel portion 176 may be oriented with respect to the front portion 168 such that an angle between the two surfaces ranges from 6° to 18°, preferably about 12.5°. The rear channel portion 178 may be oriented with respect to the front channel portion 176 such that an angle between the two surfaces ranges from 0° to 15°, preferably 6°. The differing angles of, for example, the front channel portion 176 and rear channel portion 178 provide the benefits of reduced relative motion between the adapter 12 and tip 14, reduced wear, and more even distribution of stresses.

As seen in FIG. 26, the channel side surfaces 180 of the bottom channel 174 may comprise a front channel side surface 181 and a rear channel side surface 182. The front channel side surface 181 may connect the front channel portion 176 to the inner shoulder surfaces 172. The rear channel side surface 182 may connect the rear channel portion 178 to the inner shoulder surfaces 172. The front channel side surfaces 181 of the bottom channel 174 may be substantially parallel to each other such that the transverse width (e.g., along directions +B and −B) of the front channel portion 176 is substantially constant as the front channel portion 176 extends rearward. Alternatively, the front channel side surface 181 of the bottom channel 174 may be oriented with respect to each other such that a distance between the front channel side surfaces 181 decreases substantially symmetrically at a longitudinal taper angle "LTA" ranging from 0° to 20° with respect to longitudinal lines oriented parallel to the substantially longitudinal axis "H". Further, the rear channel side surfaces 182 of the bottom channel 174 may be substantially parallel to each other such that the transverse width (e.g., along directions +B and −B) of the rear channel portion 178 is substantially constant as the rear channel portion 178 extends rearward. Alternatively, the rear channel side surface 182 of the bottom channel 174 may be oriented with respect to each other such that a distance between the rear channel side surface 182 decreases substantially symmetrically at a longitudinal taper angle "LTA" ranging from 0° to 20°, preferably about 5° with respect to longitudinal lines oriented parallel to the substantially longitudinal axis "H". The orientation of the channel side surfaces 180 with respect to the substantially longitudinal axis "H" may provide the advantage of increased wedging resulting in reduced relative motion, including reducing pivoting side to side, and reduced wear during push-on loading and downward loading. As shown in FIG. 22, the channel side surfaces 180 of the bottom channel 174 may be oriented with respect to each other such that the distance between the channel side surfaces 180 decreases substantially symmetrically at a vertical taper angle "VTA" ranging from 30° to 50°, preferably about 39.5° with respect to parallel vertical lines. Further, the channel side surfaces 180 may be oriented with respect to the inner shoulder surfaces 172 such that an angle between the two surfaces ranges from 40° to 60°, preferably about 50.5°. Such an orientation of the channel side surfaces 180 may provide the advantages of increased stability during side loading, reduced nose volume, added strength, and an additional wedging effect increasing contact area and reducing sliding motion and related wear.

As shown in FIG. 26, the front portion 168 of the bottom inner surface 166 of the nose cavity 126, the rear portion 170 of the bottom inner surface 166 of the nose cavity 126, and the rear edge 90 may each be separated by inner transition portions 151, which may comprise one or more curved surfaces translating between the relative angles of the otherwise adjoining, generally planar surfaces. The individually defined surfaces within the rear portion 170 of the bottom inner surface 166, for example the inner shoulder surfaces 172, front channel portion 176, rear channel portion 178, and channel side surfaces 180 may also be separated by inner transition portions 151.

As shown in FIGS. 20 and 21, the side inner surfaces 160 of the nose cavity 126 may be generally planar and extend between the bottom inner surface 166 and the top inner surface 146. The side inner surfaces 160 may comprise a generally planar front side inner surface 161 disposed proximate the front inner surface 136, a generally planar intermediate side inner surface 162 extending rearwardly (e.g., in direction R) from the front side inner surface 161, and a rear side inner surface 163 extending rearwardly from the intermediate side surface to the rear edge 90 of the tip 14. The front side inner surfaces 161 may be longitudinally aligned such that they separate the front side-sloping inner surfaces 150 of the top inner surface 146 from the front portion 168 of the bottom inner surface 166. The intermediate side inner surfaces 162 may be longitudinally aligned such that they separate the front bowtie-shaped inner surfaces 155 of the top inner surface 146 from the inner shoulder surfaces 172 of the bottom inner surface 166. The rear side inner surfaces 163 may be longitudinally aligned such that they separate the rear bowtie-shaped inner surfaces 156 of the top inner surface 146 from the inner shoulder surfaces 172 of the bottom inner surface 166.

As shown in FIG. 24, the front side inner surfaces 161 and the intermediate side inner surfaces 162 may be parallel and continuous as they extend rearward from the side inner edges 138 of the front inner surface 136. The front side inner surfaces 161 and the intermediate side inner surfaces 162 may be oriented with respect to the front inner surface 136 such that an angle between the surfaces ranges from 90° to 105°, preferably about 93°. Further, as shown in FIG. 21, the front side inner surfaces 161 may be configured such that the distance between the top inner surface 146 and the bottom inner surface 166 is substantially constant as the front side inner surfaces 161 extend rearwardly (e.g., in direction R). Alternatively, the front side inner surfaces 161 may be configured such that the distance between the top inner surface 146 and the bottom inner surface 166 increases slightly as the front side inner surfaces 161 extend rearwardly. The intermediate side inner surfaces 162 may be configured such that the distance between the top inner surface 146 and the bottom inner surface 166 substantially increases as the intermediate side inner surfaces 162 extend rearwardly.

As shown in FIG. 24, the rear side inner surfaces 163 may be angled outwardly (e.g., along directions +B and −B) with respect to the front side inner surfaces 161 and the intermediate side inner surfaces 162 as they extend rearward from the intermediate side inner surfaces 162 such that the transverse distance between the rear side inner surfaces 163 symmetrically increases as the rear side inner surfaces 163 extend rearward. For example, the rear side inner surfaces 163 may be angled outwardly with respect to the intermediate side inner surfaces 162 at an angle ranging from 0° to 15°, preferably about 7°. Angles greater than 0° provide the advantages of allowing the rear side inner surfaces 163 to act as wedging surfaces during push-on loading, increasing the contact surface between the adapter 12 and tip 14 during operation, and thereby reducing slippage and wear, and improving removability by reducing the friction between the adapter 12 and tip 14 during removal. Alternatively, the rear side inner surfaces 163 may be oriented substantially parallel to the intermediate side inner surfaces 162. The rear side inner surfaces 163 may be configured such that the distance between the top inner surface 146 and the bottom inner surface 166 decreases slightly as the rear side inner surfaces 163 extend rearward.

The front side inner surface 161, intermediate side inner surface 162, and rear side inner surface 163 of the side inner surfaces 160 of the nose cavity 126, the top inner surface 146, the bottom inner surface 166, and the rear edge 90 of the tip 14 may each be separated by inner transition portions 151, which may comprise one or more curved surfaces translating between the relative angles of the otherwise adjoining, generally planar surfaces.

As shown in FIG. 20, the vertical height at the rear ("RVH") of the nose cavity 126 (at the vertical plane "P") may range from 0.5 to 1.0 times the longitudinal length ("LL") of the nose cavity 126, where the longitudinal length ("LL") is defined as the distance along the substantially longitudinal axis "A" from the vertical plane "P" to the front inner surface 136. The vertical height at the front ("FVH") of the nose cavity 126 (at the front inner surface 136) may range from 0.2 to 0.5 times the longitudinal length of the nose cavity 126. As shown in FIGS. 23 and 25, the transverse width at the rear ("RTW") of the nose cavity 126 (at the vertical plane "P") may range from 0.8 to 2.0 times the transverse width at the front ("FTW") of the nose cavity 126 (at the front inner surface 136). The transverse width at the front ("FTW") of the nose cavity 126 (at the front inner surface 136) may range from 0.4 to 1.5 times the longitudinal length ("LL") of the nose cavity 126. The longitudinal length ("LL") of the nose cavity 126 may range from 0.7 to 2.0 times the transverse width ("RTW") at the rear of the nose cavity 126 (at the vertical plane "P").

Figure 46:
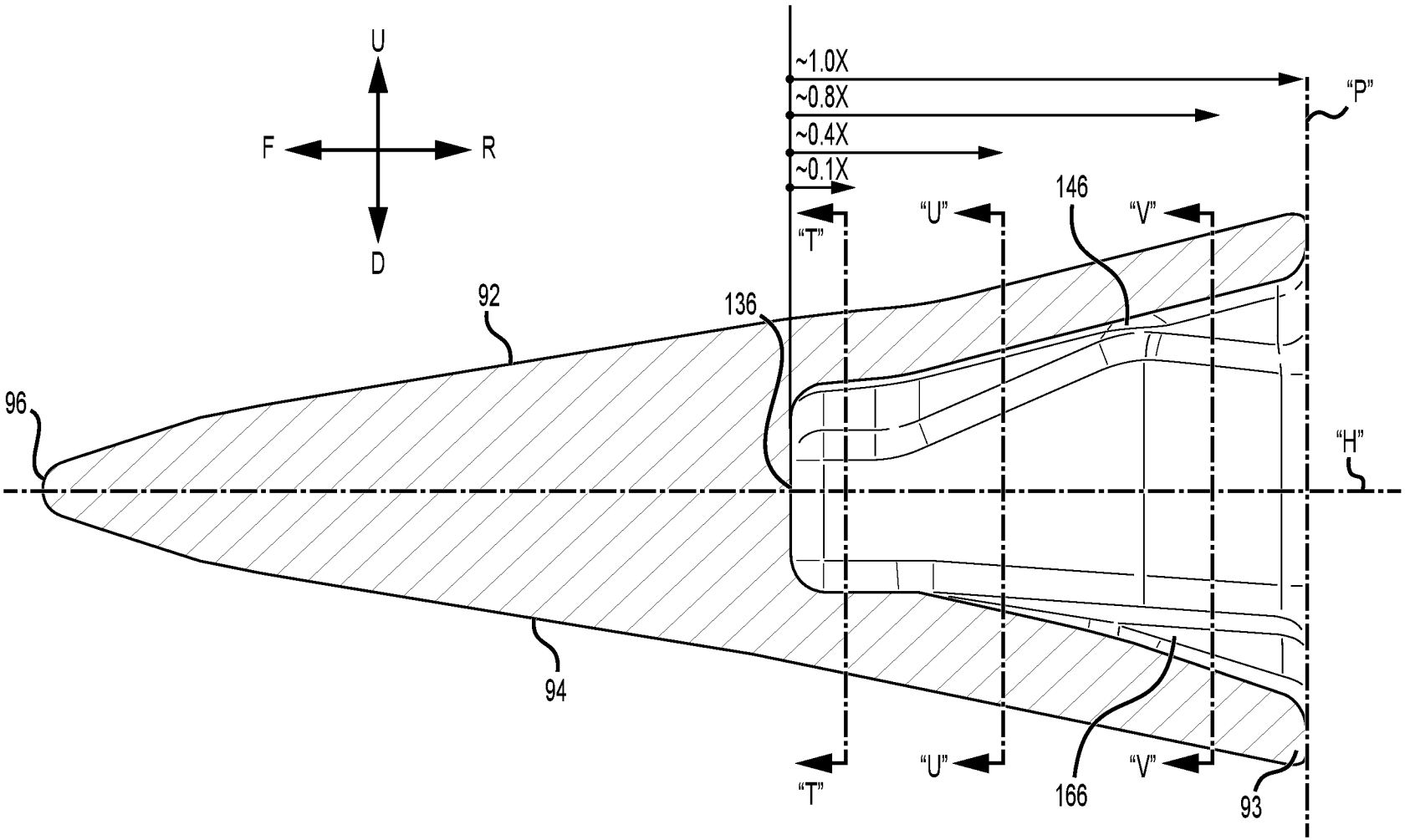
FIG. 46 illustrates a vertical cross section side view along line N-N of the tip of FIG. 18 with section lines T-T, U-U, and V-V in accordance with the present disclosure.
Figure 47:
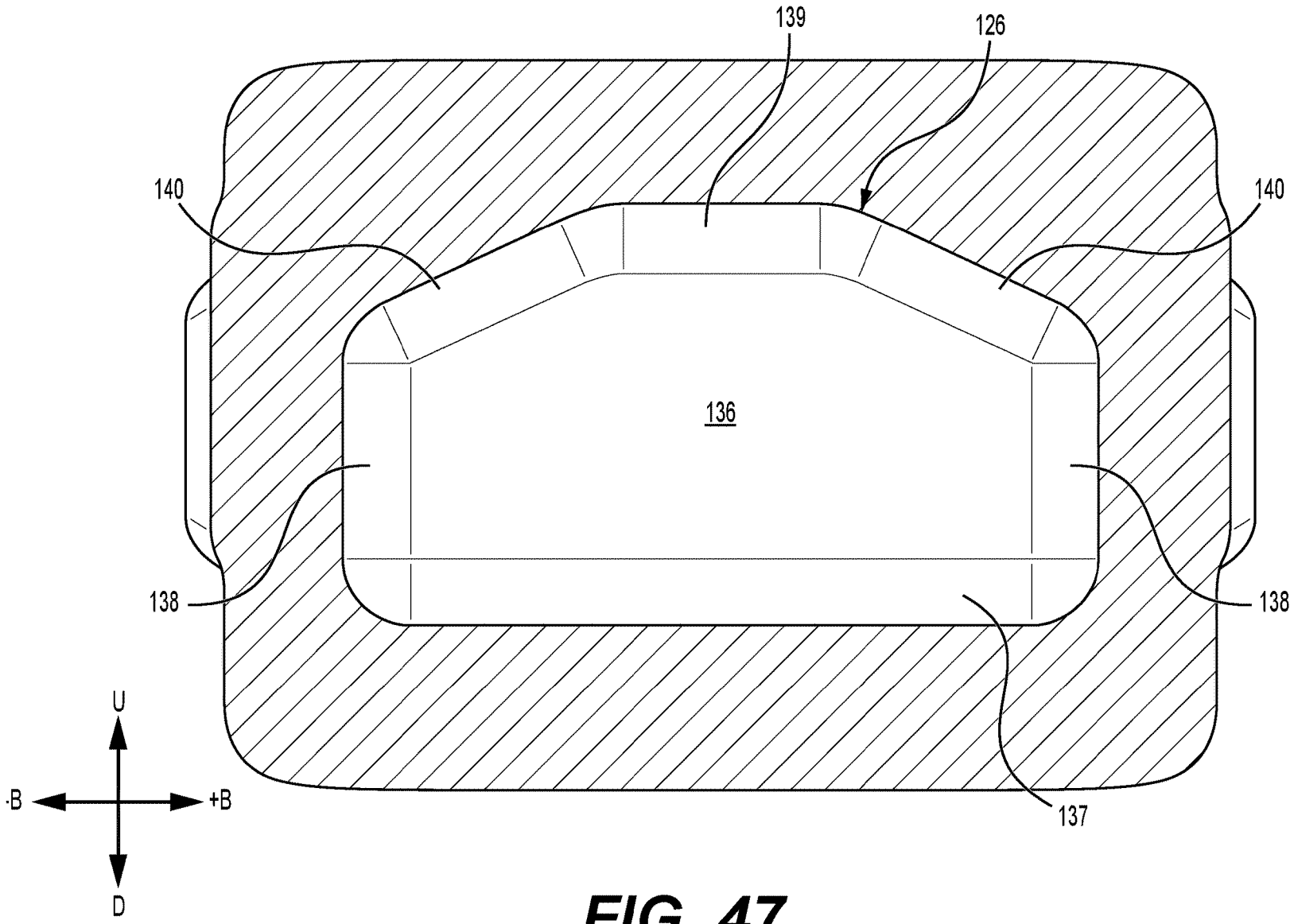
FIG. 47 illustrates a cross-sectional view of the nose cavity of the tip of FIG. 18 along line T-T as shown in FIG. 46 in accordance with the present disclosure.

FIG. 46 illustrates a vertical cross section side view along line N-N of the tip of FIG. 18 with section lines T-T, U-U, and V-V. As illustrated in FIG. 46, section planes corresponding to lines T-T, U-U, and V-V may be located at distances of about 0.1×, 0.4×, and 0.8× from front inner surface 136 of the nose cavity 126. FIG. 47 illustrates a cross-sectional view of the nose cavity 126 along line T-T as shown in FIG. 46. As illustrated in FIG. 47, the front inner surface 136 may be hexagonally shaped, comprising a bottom inner edge 137, opposing side inner edges 138 oriented at about 900 with respect to the bottom inner edge 137, a top horizontal inner edge 139 oriented about parallel to the bottom inner edge 137, and opposing top sloping inner edges 140 connecting the top horizontal inner edge 139 to the side inner edges 138. An angle between the top horizontal inner edge 139 and top sloping inner edges 140 ranges from about 18.5° to 30°, preferably about 24.5°. Inner edges 137-140 may be curved.

Figure 48:
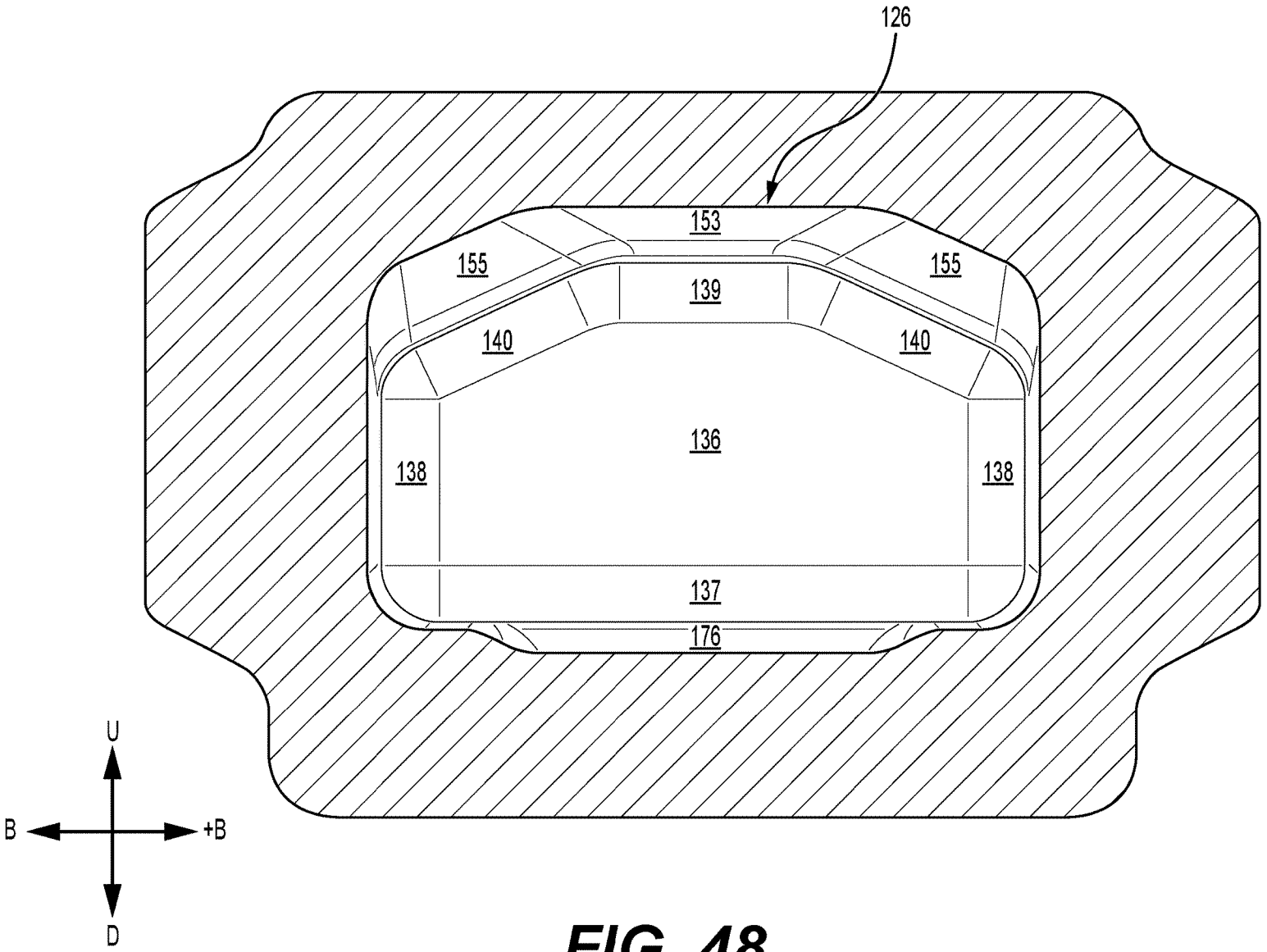
FIG. 48 illustrates a cross-sectional view of the nose cavity of the tip of FIG. 18 along line U-U as shown in FIG. 46 in accordance with the present disclosure.
Figure 49:
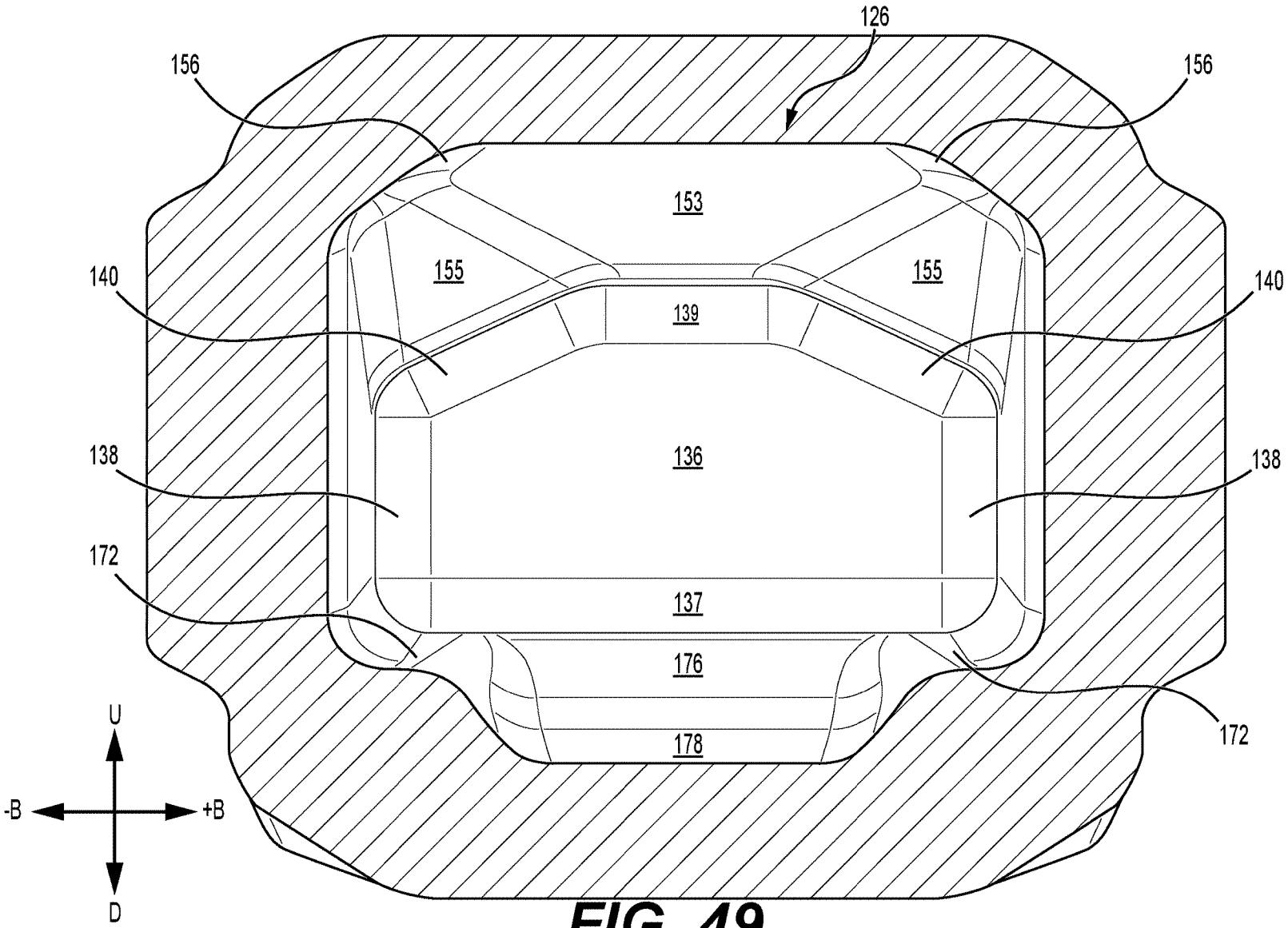
FIG. 49 illustrates a cross-sectional view of the nose cavity of the tip of FIG. 18 along line V-V as shown in FIG. 46 in accordance with the present disclosure.

FIG. 48 illustrates a cross-sectional view of the nose cavity 126 along line U-U as shown in FIG. 46. As illustrated in FIG. 48, generally planar rear central inner surface 153 may be disposed between two opposing rear side-sloping inner surfaces 154 sloping away from the rear central inner surface 153 in the transverse direction (e.g., directions +B and −B). The rear central inner surface 153 may be oriented with respect to the front central inner surface 149 such that an angle between the two surfaces ranges from 0° to 15°, preferably about 9°. FIG. 49 illustrates a cross-sectional view of the nose cavity 126 along line V-V as shown in FIG. 46. As illustrated in FIG. 49, generally planar triangular front bowtie-shaped inner surface 155 and a generally planar triangular rear bowtie-shaped inner surface 156 may be oriented with vertices pointing toward each other. Further, as shown for example in FIG. 22, the front bowtie-shaped inner surfaces 155 may be inclined downwardly as they extend in the transverse direction (e.g., directions +B and −B) from the rear central inner surface 153. For example, the front bowtie-shaped inner surfaces 155 may be oriented with respect to the rear central inner surface 153 such that an angle between the two surfaces ranges from 17.5° to 32.5°, preferably about 25°. The rear bowtie-shaped inner surfaces 156 may be inclined downwardly (e.g., in direction D) as they extend in the transverse direction (e.g., along directions +B and −B) from the rear central inner surface 153. The angle of inclination between the rear bowtie-shaped inner surfaces 156 and the rear central inner surface 153 may differ from the angle of inclination between the front bowtie-shaped inner surfaces 155 and the rear central inner surface 153. More specifically, the angle of inclination between the rear bowtie-shaped inner surfaces 156 and the rear central inner surface 153 may be greater than the angle of inclination between the front bowtie-shaped inner surfaces 155 and the rear central inner surface 153. For example, the rear bowtie-shaped inner surfaces 156 may be oriented with respect to the rear central inner surface 153 such that an angle between the two surfaces ranges from 30° to 45°, preferably about 37.5°.

Tip Corresponding to Symmetrical Adapter (FIGS. 27-32 and 50-53)

An alternative embodiment of the tip 14 is shown in FIGS. 27-32 and 50-53 comprising a symmetrical nose cavity 127. The symmetrical nose cavity 127 is configured to receive the corresponding alternative embodiment of the adapter 12 comprising a symmetrical nose 27 (FIGS. 12-17) as will be described more fully below. The symmetrical nose cavity 127 and corresponding symmetrical nose 27 provide the benefit of enabling a user to reverse the top and bottom orientation of the tip 14 as it is attached to the adapter 12 in order to achieve more even wear of the top and bottom surfaces of the tip. While not shown in FIGS. 27-32, each of the lateral outer surfaces 98 (FIG. 27) may have a corresponding one of the retention apertures 16 (not shown) therein into which a retention mechanism 13 (not shown) may be inserted to hold the tip 14 in place on the symmetrical nose 27 of the adapter 12 (as shown in FIG. 3). The retention apertures 16 may comprise, for example, through-holes configured to accept the retention mechanism 13. The retention apertures 16 may further comprise ramped surfaces, alignment slots, threading and/or internal recesses.

Figure 27:
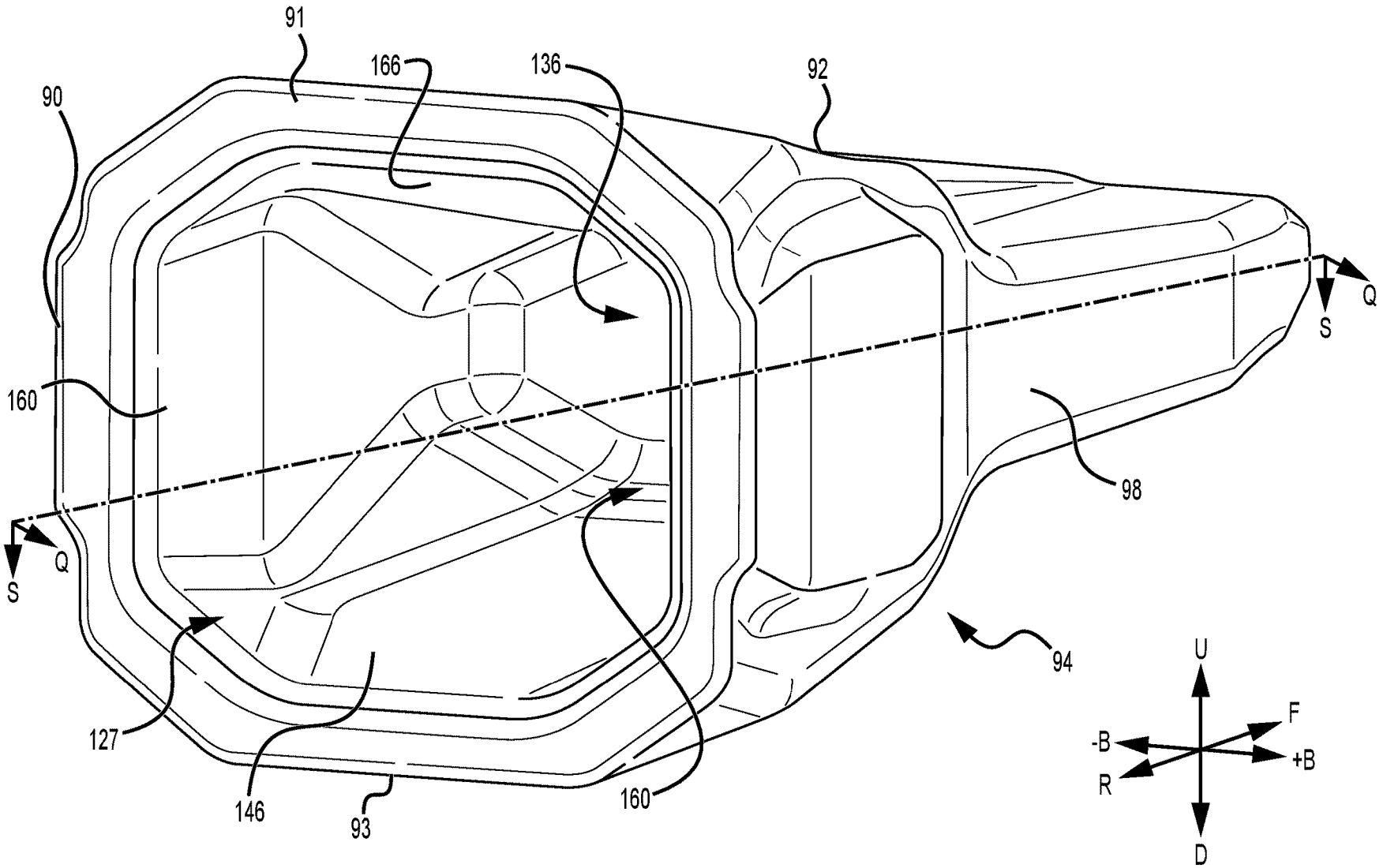
FIG. 27 is an isometric view of another exemplary tip in accordance with the present disclosure.

FIG. 27 illustrates an isometric view of the alternative embodiment of tip 14. As shown in FIG. 27, the tip 14 may be configured to be received onto the symmetrical nose 27 of the adapter 12. A symmetrical nose cavity 127 may be defined within the tip 14. The symmetrical nose cavity 127 may have a complementary configuration relative to the symmetrical nose 27 of the adapter 12 and may include a pair of opposing top and bottom inner surfaces 146, 166 a pair of opposing side inner surfaces 160 extending between the top and bottom inner surfaces 146, 166, and a front inner surface 136.

Figure 28:
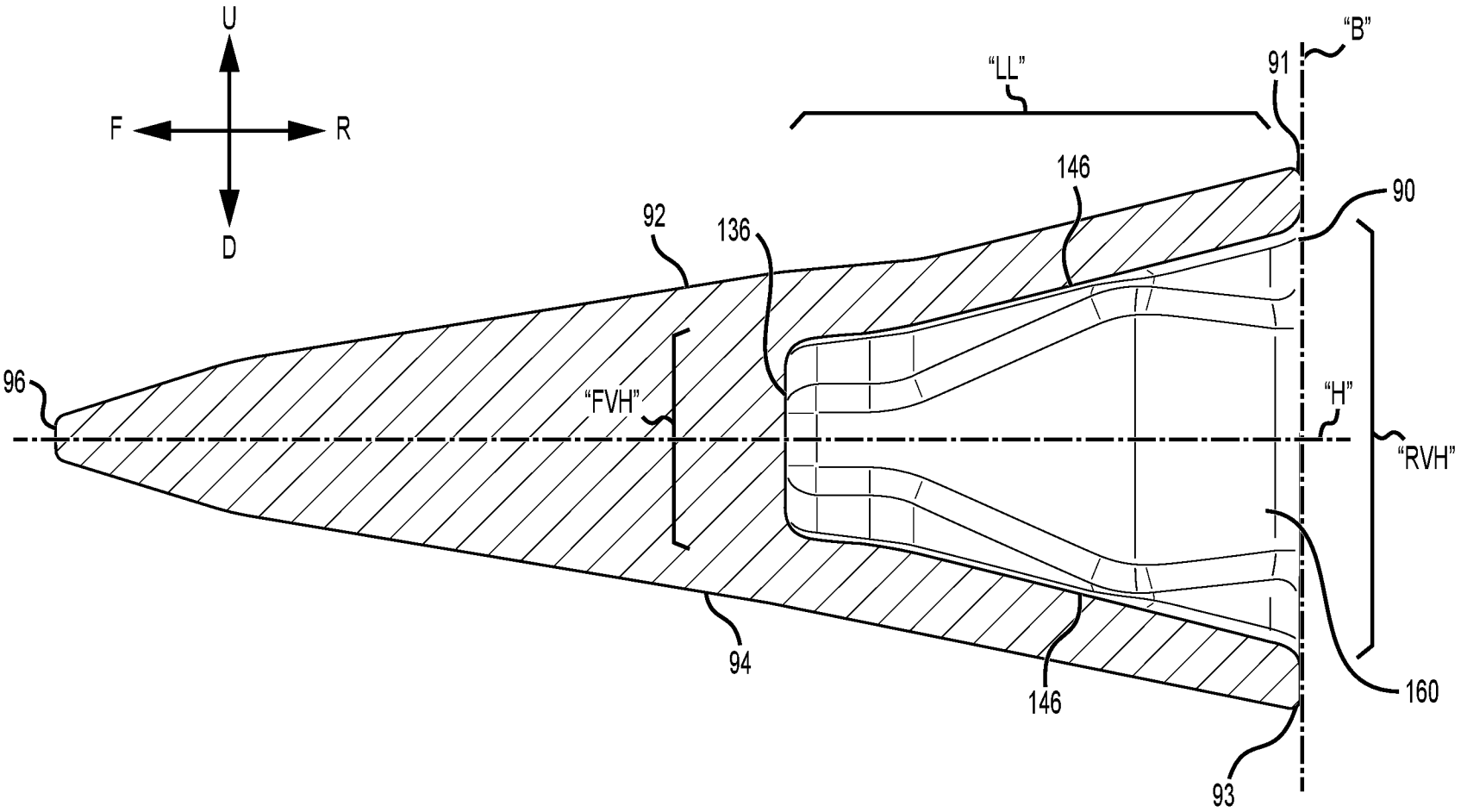
FIG. 28 is a vertical cross section side view along line Q-Q, illustrated in FIG. 27, of the tip of FIG. 27 in accordance with the present disclosure.
Figure 29:
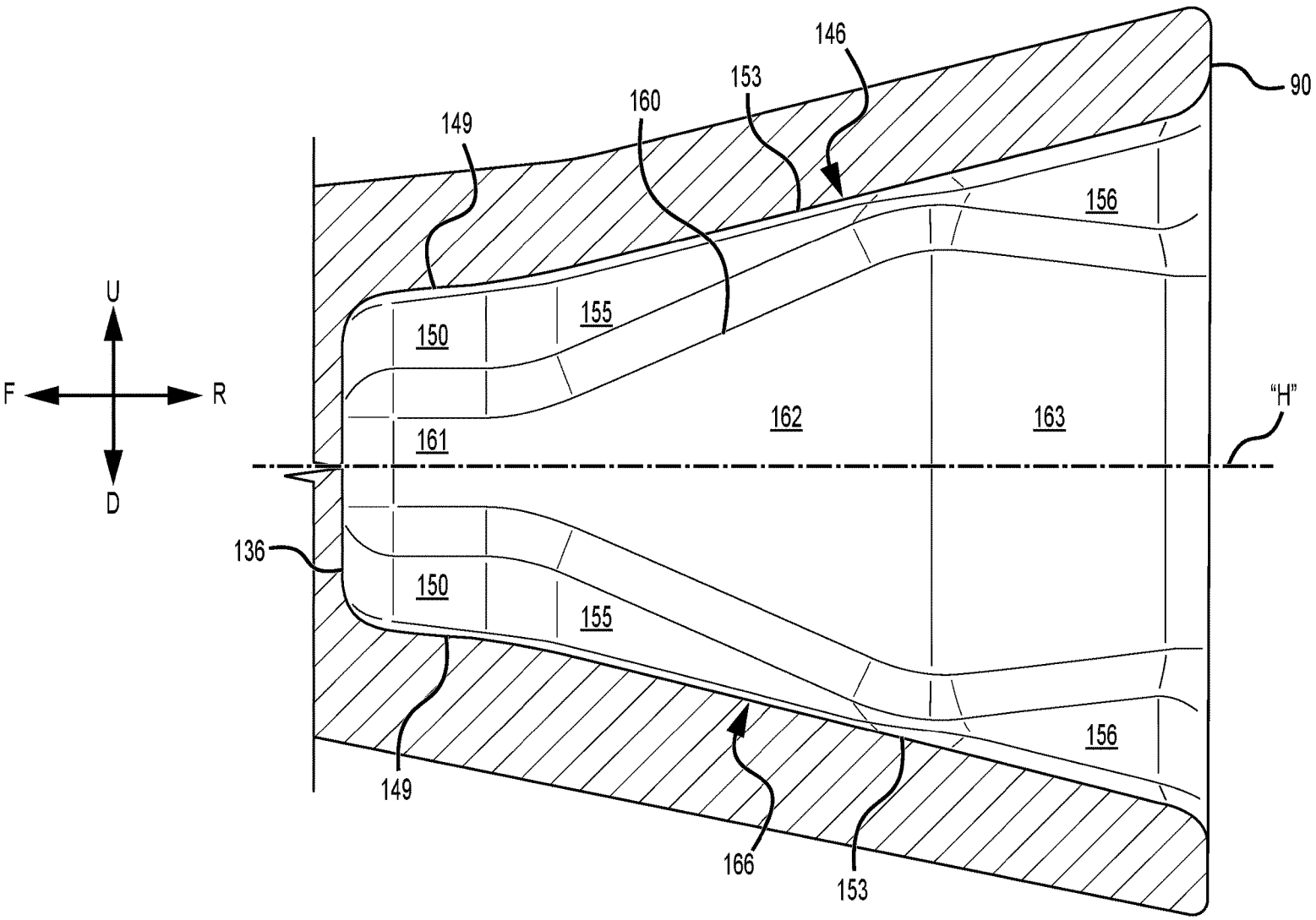
FIG. 29 is a vertical cross section side view along line Q-Q, illustrated in FIG. 27, of a nose cavity of the tip of FIG. 27 in accordance with the present disclosure.

FIG. 28 is a vertical cross section side view of the tip 14 along line Q-Q of FIG. 27 and FIG. 29 is a magnified view of the vertical cross section side view of the tip 14 along line Q-Q of FIG. 27 showing the nose cavity 127. The front inner surface 136 of the symmetrical nose cavity 127 may be planar, as shown in FIGS. 28 and 29, or may include a degree of curvature. As shown in FIG. 28, the front inner surface 136 may be oriented about perpendicular to a substantially longitudinal axis "H", the orientation of which is defined by being centered between the opposing side inner surfaces 160 and the top and bottom inner surfaces 146, 166 of the symmetrical nose cavity 127.

Figure 30:
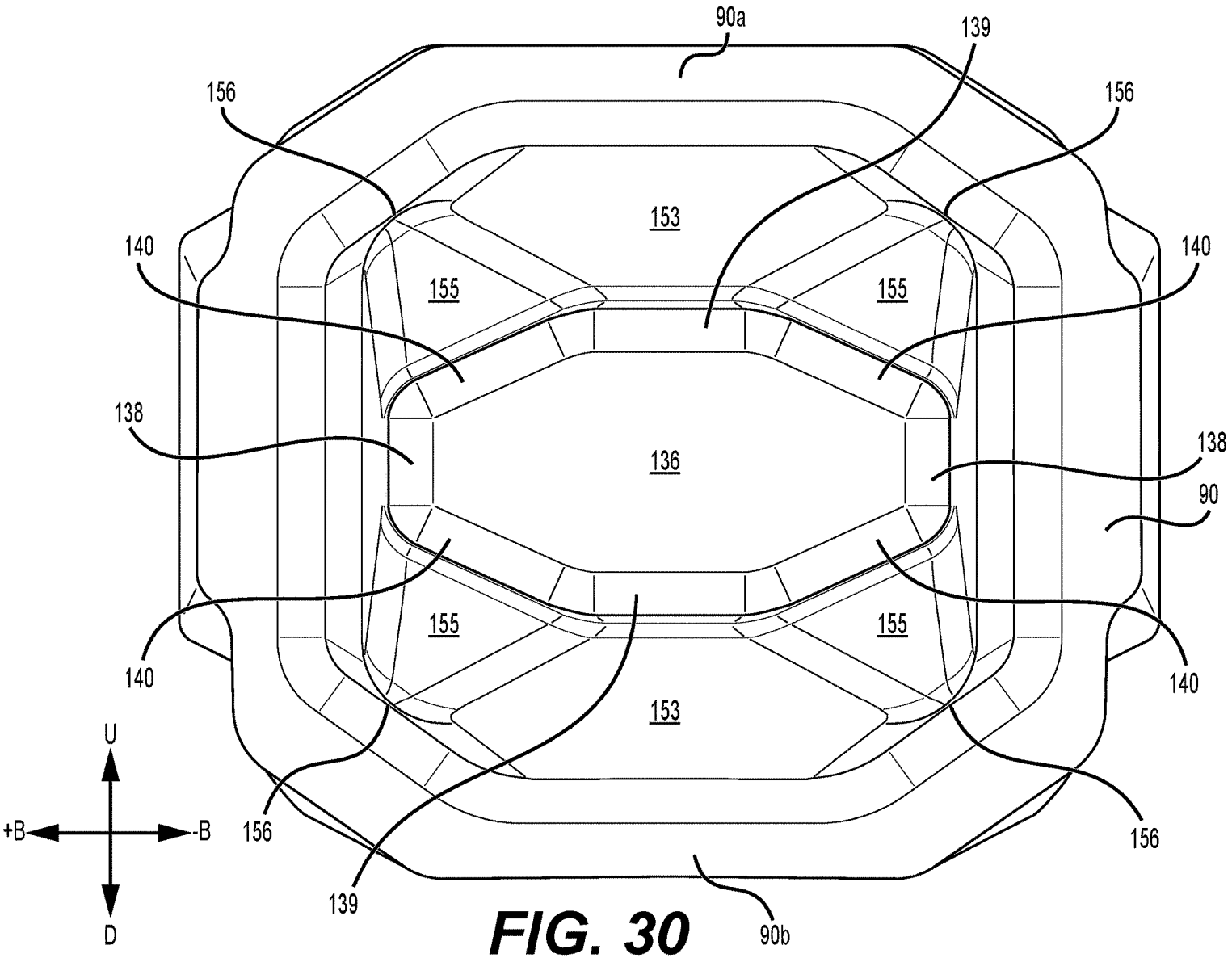
FIG. 30 is a rear view of the tip of FIG. 27 in accordance with the present disclosure.

FIG. 30 illustrates a rear view of the tip 14 of FIG. 27. As shown in FIG. 30, the front inner surface 136 may be octagonally shaped, comprising opposing top and bottom horizontal inner edges 139, opposing side inner edges 138 oriented at about 90° with respect to the top and bottom horizontal inner edges 139, and opposing top and bottom sloping inner edges 140 connecting the top and bottom horizontal inner edges 139 to the side inner edges 138. An angle between the top and bottom horizontal inner edges 139 and top and bottom sloping inner edges 140 ranges from about 18.5° to 30°, preferably about 24.5°. The inner edges 139-140 may be curved.

Figure 31:
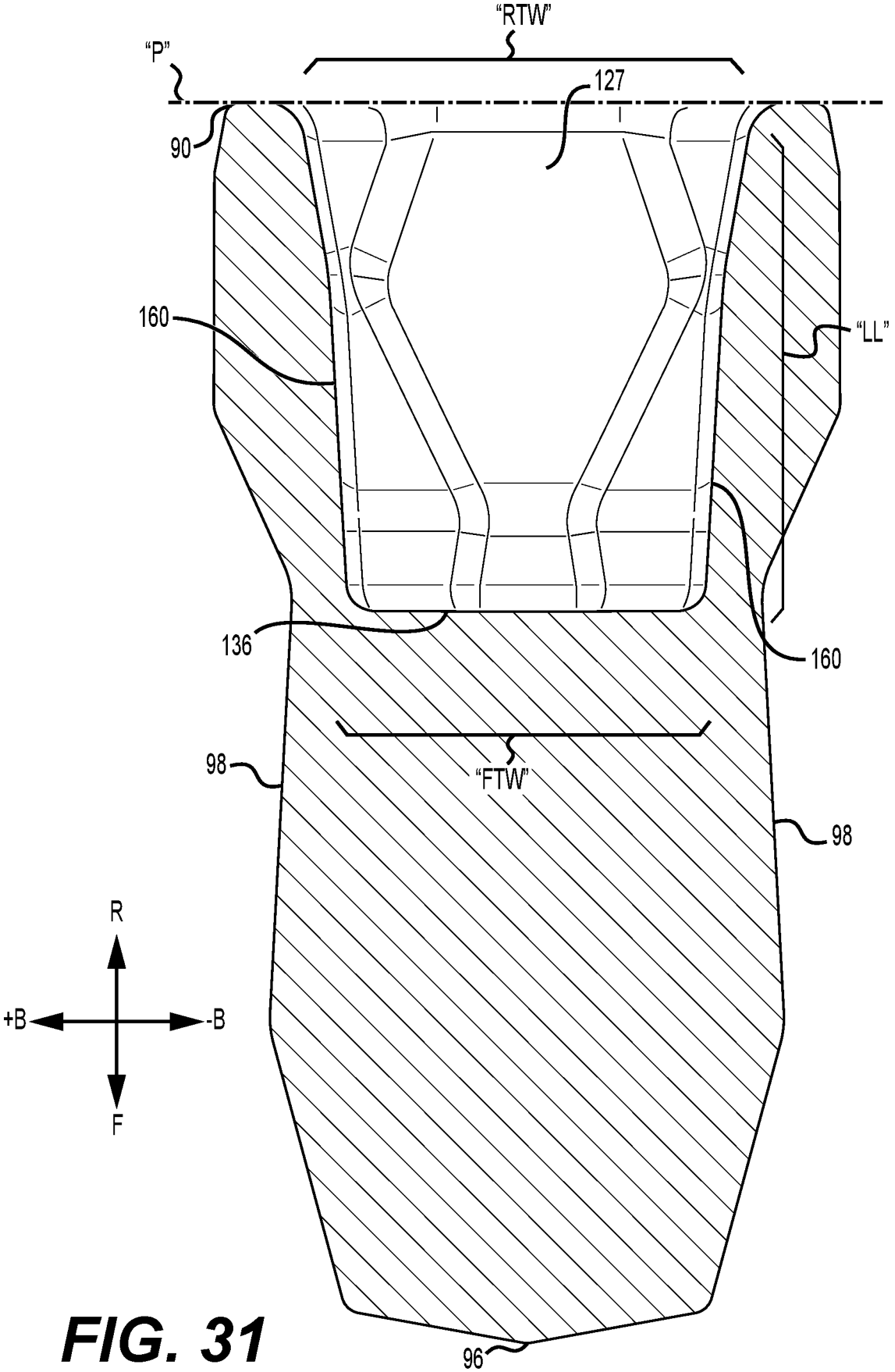
FIG. 31 is a horizontal cross section top view S-S of the tip of FIG. 27 in accordance with the present disclosure.
Figure 32:
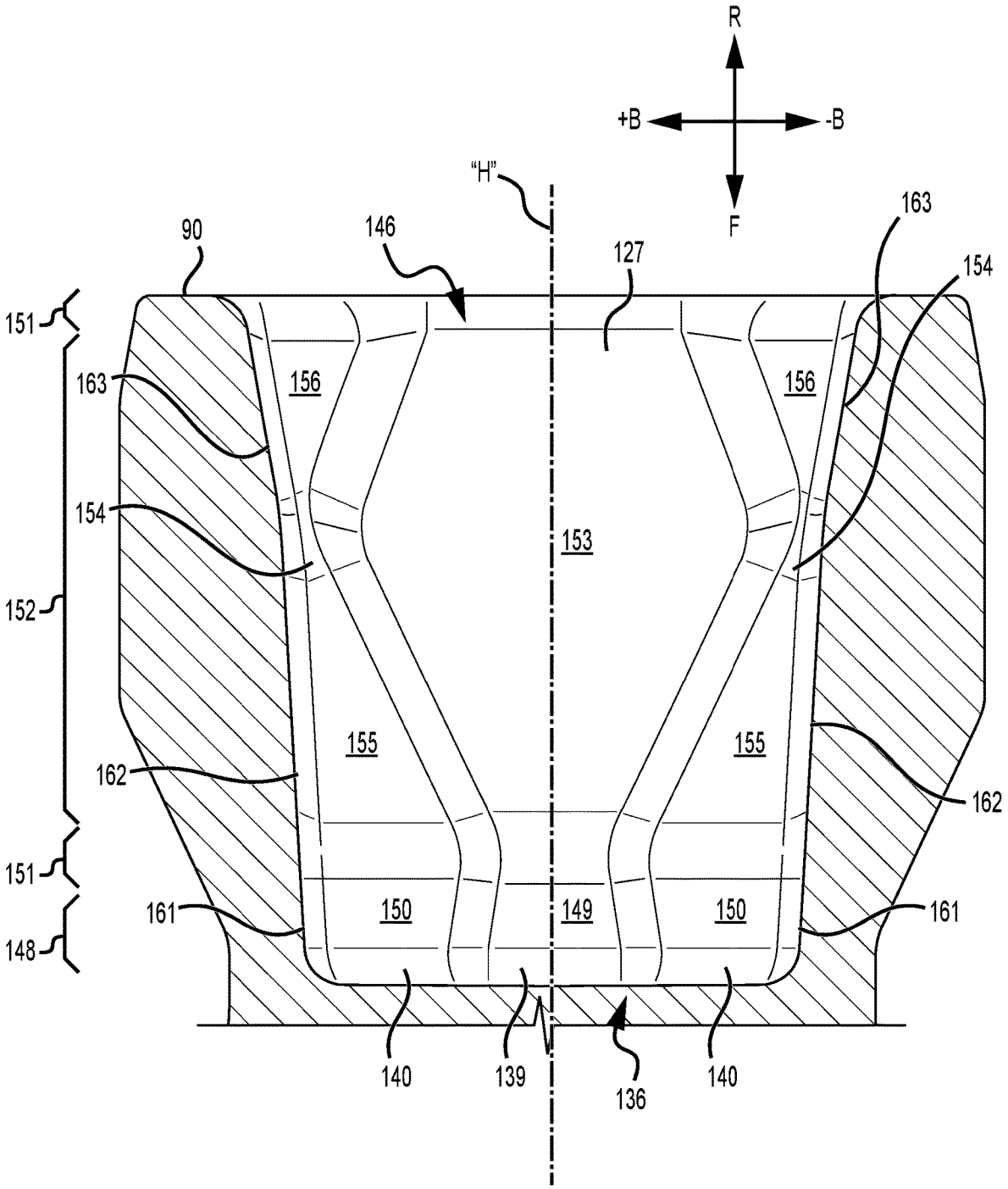
FIG. 32 is a horizontal cross section top view S-S of the nose cavity of the tip of FIG. 27 in accordance with the present disclosure.

FIG. 31 is a horizontal cross section top view of the tip 14 along line S-S of FIG. 27 and FIG. 30 is a magnified view of the horizontal cross section top view of the tip 14 along line S-S of FIG. 27 showing the nose cavity 127. The top and bottom inner surfaces 146, 166 of the symmetrical nose cavity 127, as shown in FIGS. 31 and 32, may be configured to support the tip 14 during use of the loader bucket assembly 1 or excavator bucket assembly 6, and to facilitate retention of the tip 14 on the symmetrical nose 27 when bearing the load of the work material. As shown in FIG. 32, the top and bottom inner surfaces 146, 166 may include a front inner portion 148 disposed proximate the front inner surface 136, a transition portion 151 extending rearwardly (e.g., in direction R) from front inner portion 148, and a rear portion 152 extending rearwardly from the transition portion 151 toward the rear edge 90. The front portions 148 may comprise a generally planar front central inner surface 149 extending rearwardly from the top or bottom horizontal inner edges 139 of the front inner surface 136 between two generally planar, opposing front side-sloping inner surfaces 150 extending rearwardly from the top and bottom sloping inner edges 140 of the front inner surface 136 and sloping toward the side inner surfaces 160 in the transverse direction (e.g., along directions +B and −B), away from the front central inner surface 149. As the front central inner surfaces 149 extend rearward from the top and bottom horizontal inner edges 139, the transverse width of the front central inner surfaces 149 may decrease symmetrically, resulting in the front central inner surfaces 149 having a shape similar to an isosceles trapezoid, as shown in the illustrated embodiment in FIG. 32. Alternatively, the transverse width of the front central inner surfaces 149 may be constant or increase as the front central inner surfaces 149 extend rearward from the top and bottom horizontal inner edges 139.

As shown in FIG. 29, the front central inner surfaces 149 may extend away (in directions U and D) from the substantially longitudinal axis "H" as they extend rearward such that the front central inner surfaces 149 and the front inner surface 136 form an angle ranging from 91° to 105°, preferably about 95°. Alternatively, the front central inner surfaces 149 may extend substantially perpendicular to the front inner surface 136, for example, forming an angle ranging from 88° to 92°, preferably 90°. The front side-sloping inner surfaces 150 may be oriented with respect to the front central inner surfaces 149 such that the surfaces form an angle ranging from 18.5° to 30°, preferably about 24.5°. The front side-sloping inner surfaces 150 provide stability to tip assembly 10 during downward and sideways loading patterns, for example, by acting as wedging surfaces to reduce relative motion between the symmetrical nose 27 of the adapter 12 and the symmetrical nose cavity 127 of the tip 14. The front side-sloping inner surfaces 150 additionally increase the contact area between the symmetrical nose 27 of the adapter 12 and symmetrical nose cavity 127 of the tip 14, reducing stress throughout the symmetrical nose 27. Further, the front side-sloping inner surfaces 150 additionally increase the frictional force when load is applied to the tip assembly 10, reducing loading on the tip 14 and the retention mechanism 13, especially in combination with other transversely sloping surfaces, for example the rear bowtie-shaped inner surfaces 156, described below.

Returning to FIG. 32, the rear portions 152 of the top and bottom inner surfaces 146 may comprise a generally planar rear central inner surface 153 extending rearwardly (e.g., in direction R) from the transition portion 151 toward the rear edge 90. Planar rear central inner surface 153 may also extend between two opposing rear side-sloping inner surfaces 154 extending rearwardly from the transition portion 151 and sloping away from the rear central inner surface 153 in the transverse direction (e.g., along directions +B and −B). The rear side-sloping inner surfaces 154 function to provide increased stability, for example during upward, downward, and sideways loading of the tip assembly 10 by acting as wedging surfaces to reduce relative motion and increase contact area between the symmetrical nose 27 and the tip 14. Further, increased contact area provided by the rear side-sloping inner surfaces 154 may reduce stresses through the symmetrical nose 27.

As rear central inner surfaces 153 extend rearward from the front central inner surfaces 149, the transverse width (e.g., along directions +B and −B) of the rear central inner surfaces 153 may first increase, and subsequently decrease. In some embodiments, the width of the rear central inner surfaces 153 proximate the front central inner surfaces 149 ranges from 0.1 to 0.4 times, preferably about 0.23 times the transverse width at the rear ("RTW") of the symmetrical nose cavity 127 (at vertical plane "P" as shown in FIG. 31). In some embodiments, the width of the rear central inner surfaces 153 at its widest point as it extends rearward from the front central inner surfaces 149 ranges from 0.6 to 0.9 times, preferably about 0.73 times the transverse width at the rear ("RTW") of the symmetrical nose cavity 127. In some embodiments, the width of the rear central inner surfaces 153 proximate the rear edge 90 ranges from 0.3 to 0.6 times, preferably about 0.46 times the transverse width at the rear ("RTW") of the symmetrical nose cavity 127. The rear central inner surfaces 153 may extend away from the substantially longitudinal axis "H" as they extend rearward. The differing angles of the front central inner surfaces 149 and the rear central inner surfaces 153 with respect to the substantially longitudinal axis "H" provide the advantage of creating friction on the front central inner surfaces 149, transferring load from the retention mechanism 13 to the symmetrical nose 27 of the adapter 12. As shown for example in FIG. 29, the rear central inner surfaces 153 may be oriented with respect to the front central inner surfaces 149 such that an angle formed by the two surfaces ranges from 0° to 15°, preferably about 9°. Further, an angle of inclination of the rear central inner surfaces 153 may be about 5° to 25°, preferably 14° with respect to the substantially longitudinal axis "H". The slope of the rear central inner surfaces 153 facilitates insertion of the symmetrical nose 27 into the symmetrical nose cavity 127 of the tip 14, while the width of the rear central inner surfaces 153 limits the twisting of the tip 14 once the tip 14 is installed on the symmetrical nose 27.

As illustrated in FIG. 32, the rear side-sloping inner surfaces 154 may comprise a generally planar triangular front bowtie-shaped inner surface 155 and a generally planar triangular rear bowtie-shaped inner surface 156 oriented with vertices pointing toward each other. The front bowtie-shaped inner surfaces 155 provide the advantage of acting as a main wedging surface during push-on loading. As shown for example in FIG. 32, the front bowtie-shaped inner surfaces 155 may extend away from the substantially longitudinal axis "H" as they extend rearward. For example, the front bowtie-shaped inner surfaces 155 may be oriented with respect to the front side-sloping inner surfaces 150 such that an angle between the two surfaces ranges from 15° to 27.5°, preferably about 21.5°. Further, as shown for example in FIG. 30, the front bowtie-shaped inner surfaces 155 may be inclined toward the side inner surfaces 160 as they extend in the transverse directions +B and −B from the rear central inner surfaces 153. For example, the front bowtie-shaped inner surfaces 155 may be oriented with respect to the rear central inner surfaces 153 such that an angle between the two surfaces ranges from 17.5° to 32.5°, preferably about 25°.

As shown for example in FIG. 30, the rear bowtie-shaped inner surfaces 156 may be inclined toward the side inner surfaces 160 as they extend in the transverse directions +B and −B from the rear central inner surfaces 153. The angle of incline between the rear bowtie-shaped inner surfaces 156 and the rear central inner surfaces 153 may differ from the angle of incline between the front bowtie-shaped inner surfaces 155 and the rear central inner surfaces 153. More specifically, the angle of incline between the rear bowtie-shaped inner surfaces 156 and the rear central inner surfaces 153 may be greater than the angle of incline between the front bowtie-shaped inner surfaces 155 and the rear central inner surfaces 153. For example, the rear bowtie-shaped inner surfaces 156 may be oriented with respect to the rear central inner surfaces 153 such that an angle between the surfaces ranges from 30° to 45°, preferably about 37.5°. Further, as the rear bowtie-shaped inner surfaces 156 extend rearward from the front bowtie-shaped inner surfaces 155, the rear bowtie-shaped inner surfaces 156 may be oriented about parallel to the substantially longitudinal axis "H". Alternatively, as the rear bowtie-shaped inner surfaces 156 extend rearward from the front bowtie-shaped inner surfaces 155, the rear bowtie-shaped inner surfaces 156 may be angled away from the substantially longitudinal axis "H", but at a shallower angle than that of the front bowtie-shaped inner surfaces 155 with respect to the substantially longitudinal axis "A". For example, the rear bowtie-shaped inner surfaces 156 may be oriented with respect to the front bowtie-shaped inner surfaces 155 such that an angle between the two surfaces ranges from 18.5° to 30°, preferably about 24.5°. The relative surface angles of the front side-sloping inner surfaces 150, front bowtie-shaped inner surfaces 155, and rear bowtie-shaped inner surfaces 156 provide the advantage of wedging the tip 14 onto the symmetrical nose 27, especially during front loading, reducing overall motion of the tip 14 and dispersing stresses and wear through the symmetrical nose cavity 127.

As illustrated in FIG. 32, the front portions 148 of the top and bottom inner surfaces 146 of the symmetrical nose cavity 127, the rear portions 152 of the top and bottom inner surfaces 146 of the symmetrical nose cavity 127, and the rear edge 90 may each be separated by inner transition portions 151, which may comprise one or more curved surfaces translating between the relative angles of the otherwise adjoining, generally planar surfaces. The individually defined surfaces within the front portions 148 and the rear portions 152 of the top and bottom inner surfaces 146, for example the front and rear central inner surfaces 149, 153, the front side-sloping inner surfaces 150, and the front and rear bowtie-shaped inner surfaces 155, 156 may also each be separated by inner transition portions 151.

As shown in FIGS. 28 and 29, the side inner surfaces 160 of the symmetrical nose cavity 127 may be generally planar and extend between the top and bottom inner surfaces 146. The side inner surfaces 160 may comprise a generally planar front side inner surface 161 disposed proximate the front inner surface 136, a generally planar intermediate side inner surface 162 extending rearwardly (e.g., in direction R) from the front side inner surface 161, and a rear side inner surface 163 extending rearwardly from the intermediate side surface to the rear edge 90 of the tip 14. The front side inner surfaces 161 may be longitudinally aligned such that they separate the front side-sloping inner surfaces 150 of the top and bottom inner surfaces 146. The intermediate side inner surfaces 162 may be longitudinally aligned such that they separate the front bowtie-shaped inner surfaces 155 of the top and bottom inner surfaces 146. The rear side inner surfaces 163 may be longitudinally aligned such that they separate the rear bowtie-shaped inner surfaces 156 of the top and bottom inner surfaces 146.

As shown in FIG. 32, the front side inner surfaces 161 and the intermediate side inner surfaces 162 may be parallel and continuous as they extend rearward from the side inner edges 138 of the front inner surface 136. The front side inner surfaces 161 and the intermediate side inner surfaces 162 may be oriented with respect to the front inner surface 136 such that an angle between the surfaces ranges from 90° to 105°, preferably about 93°. Further, as shown in FIG. 29, the front side inner surfaces 161 may be configured such that the distance between the top and bottom inner surfaces 146, 166 is substantially constant as the front side inner surfaces 161 extend rearward from the side inner edges 138. Alternatively, the front side inner surfaces 161 may be configured such that the distance between the top and bottom inner surfaces 146 increases slightly or as the front side inner surfaces 161 extend rearward from the side inner edges 138. The intermediate side inner surfaces 162 may be configured such that the distance between the top and bottom inner surfaces 146 substantially increases as the intermediate side inner surfaces 162 extend rearward.

As shown in FIG. 32, the rear side inner surfaces 163 may be angled outwardly (e.g., along directions +B and −B) with respect to the front side inner surfaces 161 and the intermediate side inner surfaces 162 as they extend rearward from the intermediate side inner surfaces 162 such that the transverse distance (e.g., along directions +B and −B) between the rear side inner surfaces 163 symmetrically increases as the rear side inner surfaces 163 extend rearward. For example, the rear side inner surfaces 163 may be angled outwardly with respect to the intermediate side inner surfaces 162 at an angle ranging from 0° to 15°, preferably about 7°. Angles greater than 0° provide the advantages of allowing the rear side inner surfaces 163 to act as wedging surfaces during push-on loading, increasing the contact surface between the adapter 12 and tip 14 during operation, and thereby reducing slippage and wear, and improving removability by reducing the friction between the adapter 12 and tip 14 during removal. Alternatively, the rear side inner surfaces 163 may be oriented substantially parallel to the intermediate side inner surfaces 162. The rear side inner surfaces 163 may be configured such that the distance between the top and bottom inner surfaces 146 decreases slightly as the rear side inner surfaces 163 extend rearward.

The front side inner surface 161, intermediate side inner surface 162, and rear side inner surface 163 of the side inner surfaces 160 of the symmetrical nose cavity 127, the top and bottom inner surfaces 146, and the rear edge 90 of the tip 14 may each be separated by inner transition portions 151, which may comprise one or more curved surfaces translating between the relative angles of the otherwise adjoining, generally planar surfaces.

As shown in FIG. 28, the vertical height at the rear ("RVH") of the symmetrical nose cavity 127 (at the vertical plane "P") may range from 0.5 to 1.0 times the longitudinal length ("LL") of the symmetrical nose cavity 127, where the longitudinal length ("LL") is defined as the distance along the substantially longitudinal axis "A" from the vertical plane "P" to the front inner surface 136. The vertical height at the front ("FVH") of the symmetrical nose cavity 127 (at the front inner surface 136) may range from 0.2 to 0.5 times the longitudinal length of the symmetrical nose cavity 127. As shown in FIG. 31, the transverse width at the rear ("RTW") of the symmetrical nose cavity 127 (at the vertical plane "P") may range from 0.8 to 2.0 times the transverse width at the front ("FTW") of the symmetrical nose cavity 127 (at the front inner surface 136). The transverse width at the front ("FTW") of the symmetrical nose cavity 127 (at the front inner surface 136) may range from 0.4 to 1.5 times the longitudinal length ("LL") of the symmetrical nose cavity 127. The longitudinal length ("LL") of the symmetrical nose cavity 127 may range from 0.7 to 2.0 times the transverse width ("RTW") at the rear of the symmetrical nose cavity 127 (at the vertical plane "P").

Figure 50:
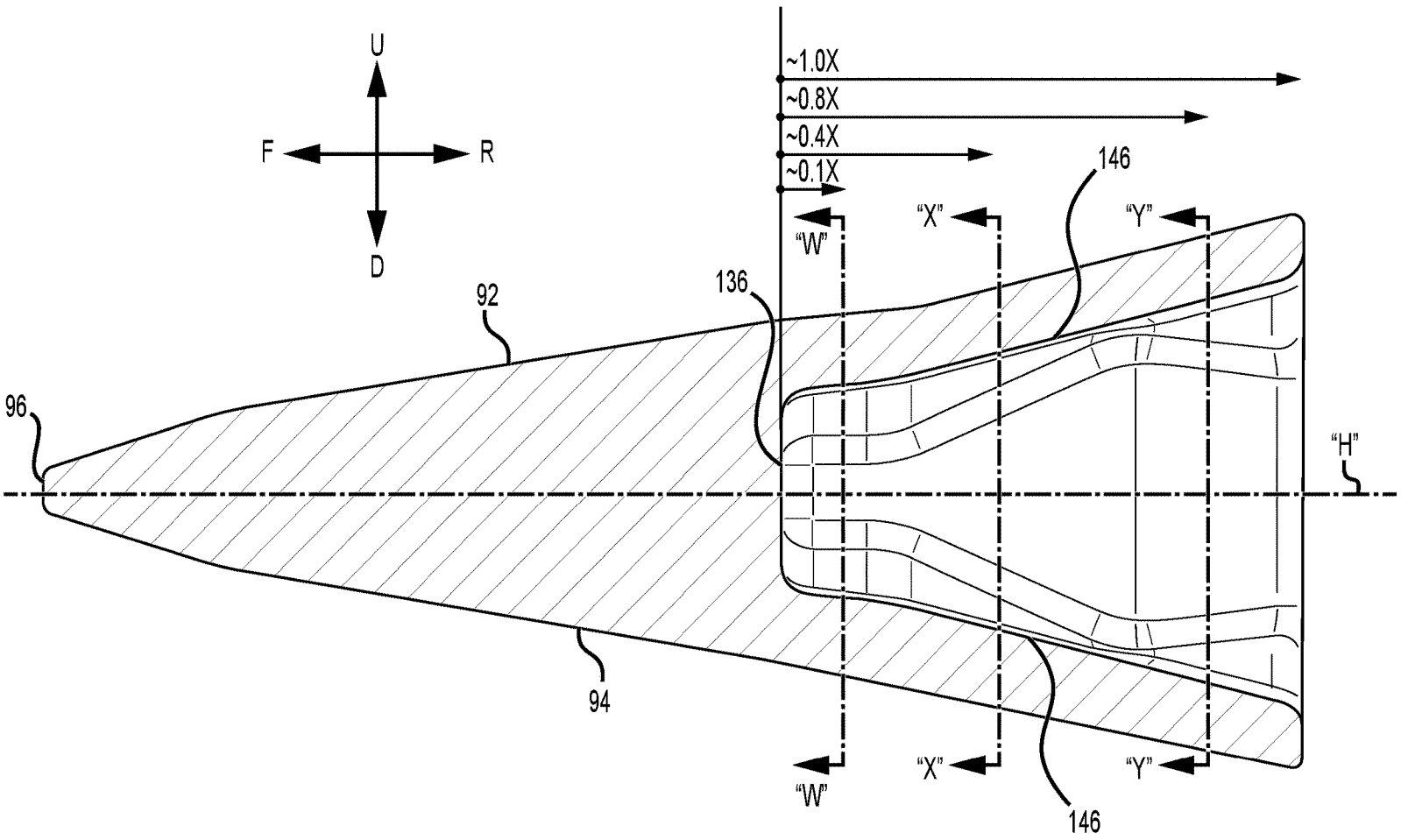
FIG. 50 illustrates a vertical cross section side view along line Q-Q of the tip of FIG. 27 with section lines W-W, X-X, and Y-Y in accordance with the present disclosure.
Figure 51:
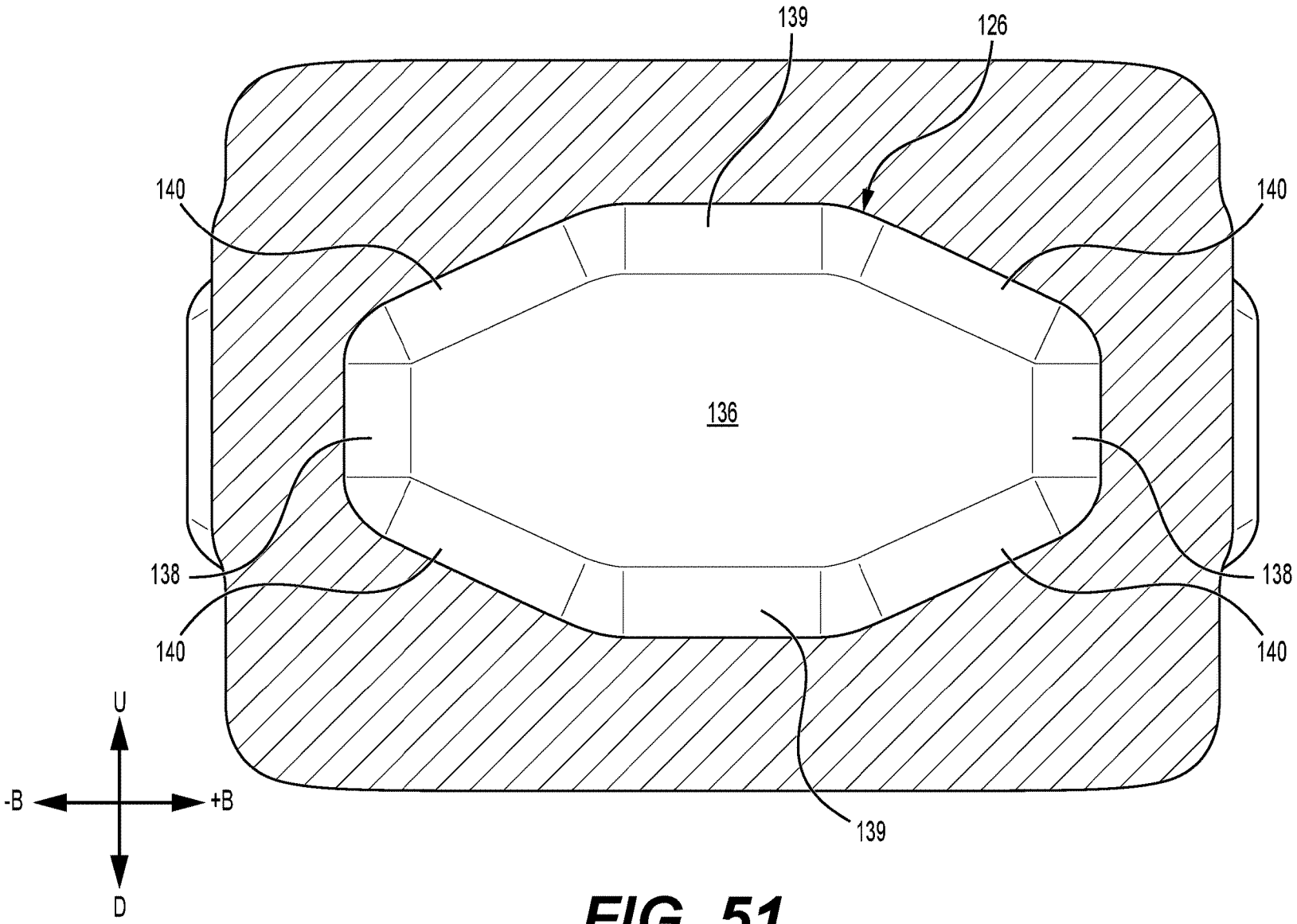
FIG. 51 illustrates a cross-sectional view of the symmetrical nose cavity of the tip of FIG. 27 along line W-W as shown in FIG. 50 in accordance with the present disclosure.

FIG. 50 illustrates a vertical cross section side view along line Q-Q of the tip of FIG. 27 with section lines W-W, X-X, and Y-Y. As illustrated in FIG. 50, section planes corresponding to lines W-W, X-X, and Y-Y may be located at distances of about 0.1×, 0.4×, and 0.8× from front inner surface 136 of the symmetrical nose cavity 127. FIG. 51 illustrates a cross-sectional view of the symmetrical nose cavity 127 along line W-W as shown in FIG. 50. As illustrated in FIG. 51, the front inner surface 136 may be hexagonally shaped, comprising a bottom inner edge 137, opposing side inner edges 138 oriented at about 900 with respect to the bottom inner edge 137, a top horizontal inner edge 139 oriented about parallel to the bottom inner edge 137, and opposing top sloping inner edges 140 connecting the top horizontal inner edge 139 to the side inner edges 138. An angle between the top horizontal inner edge 139 and top sloping inner edges 140 ranges from about 18.5° to 30°, preferably about 24.5°. Front inner edges 137-140 may be curved.

Figure 52:
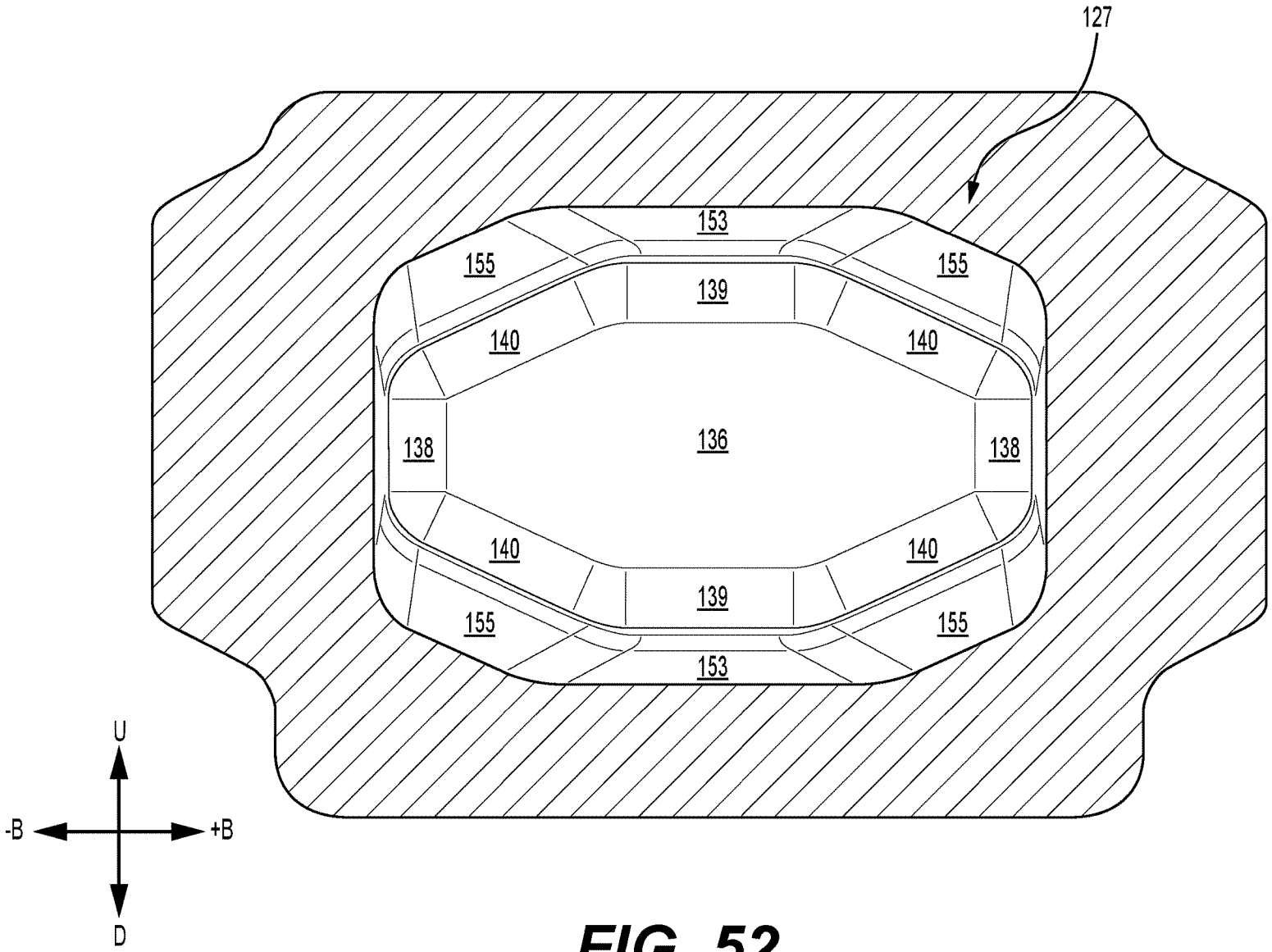
FIG. 52 illustrates a cross-sectional view of the symmetrical nose cavity of the tip of FIG. 27 along line X-X as shown in FIG. 50 in accordance with the present disclosure.

FIG. 52 illustrates a cross-sectional view of the symmetrical nose cavity 127 along line X-X as shown in FIG. 50. As illustrated in FIG. 52, generally planar triangular front bowtie-shaped inner surface 155 and a generally planar triangular rear bowtie-shaped inner surface 156 may be oriented with vertices pointing toward each other. The front bowtie-shaped inner surfaces 155 may be inclined downwardly as they extend in the transverse direction (e.g., directions +B and −B) from the rear central inner surface 153. The front bowtie-shaped inner surfaces 155 may be inclined toward the side inner surfaces 160 as they extend in the transverse directions +B and −B from the rear central inner surfaces 153. For example, the front bowtie-shaped inner surfaces 155 may be oriented with respect to the rear central inner surfaces 153 such that an angle between the two surfaces ranges from 17.5° to 32.5°, preferably about 25°.

Figure 53:
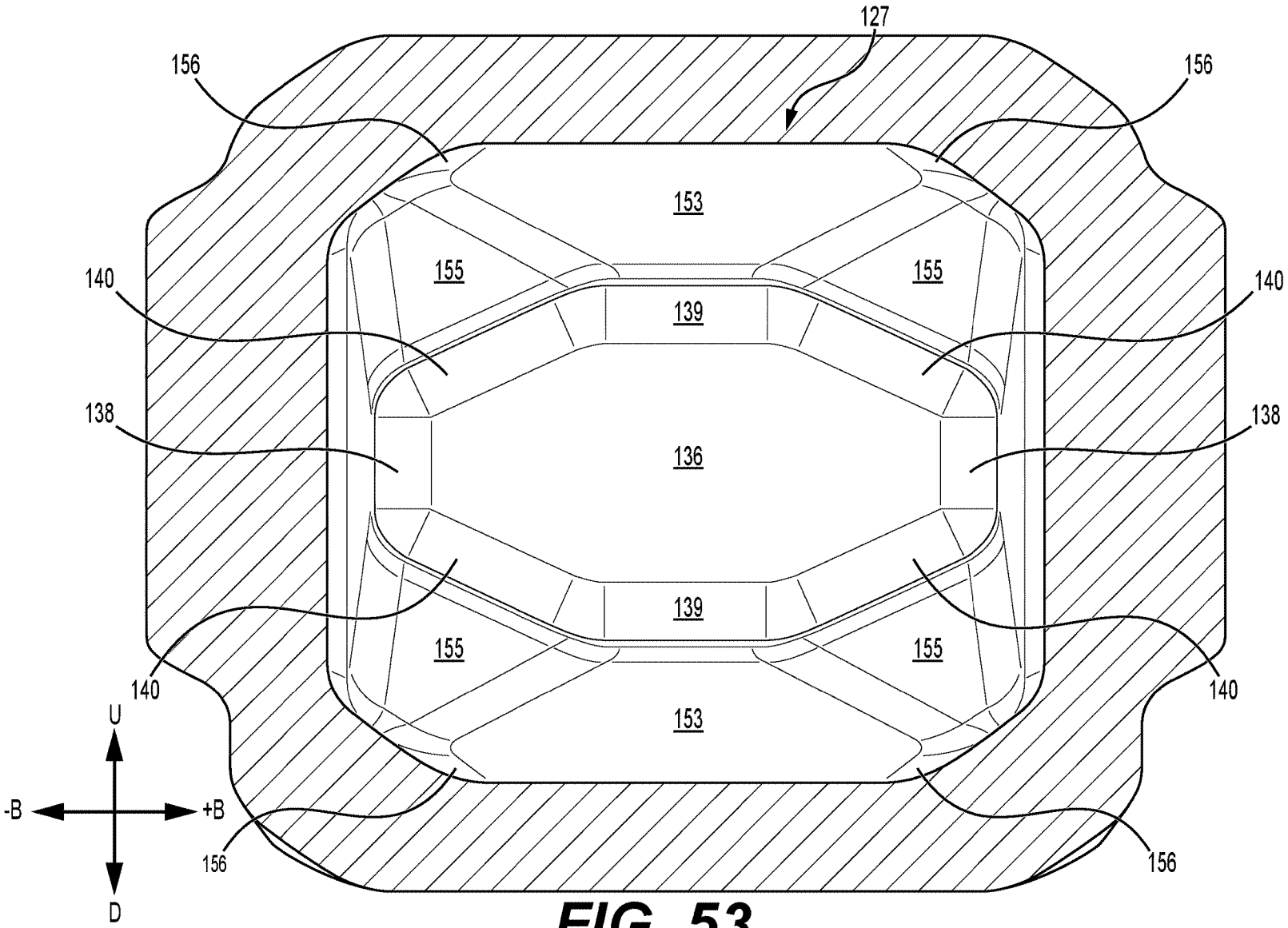
FIG. 53 illustrates a cross-sectional view of the symmetrical nose cavity of the tip of FIG. 27 along line Y-Y as shown in FIG. 50 in accordance with the present disclosure.

FIG. 53 illustrates a cross-sectional view of the symmetrical nose cavity 127 along line Y-Y as shown in FIG. 50. As illustrated in FIG. 53, the rear bowtie-shaped inner surfaces 156 may be inclined downwardly (e.g., in direction D) as they extend in the transverse directions +B and −B from the rear central inner surfaces 153. The angle of incline between the rear bowtie-shaped inner surfaces 156 and the rear central inner surfaces 153 may differ from the angle of incline between the front bowtie-shaped inner surfaces 155 and the rear central inner surfaces 153. More specifically, the angle of incline between the rear bowtie-shaped inner surfaces 156 and the rear central inner surfaces 153 may be greater than the angle of incline between the front bowtie-shaped inner surfaces 155 and the rear central inner surfaces 153. For example, the rear bowtie-shaped inner surfaces 156 may be oriented with respect to the rear central inner surfaces 153 such that an angle between the surfaces ranges from 30° to 45°, preferably about 37.5°.

Figure 54:
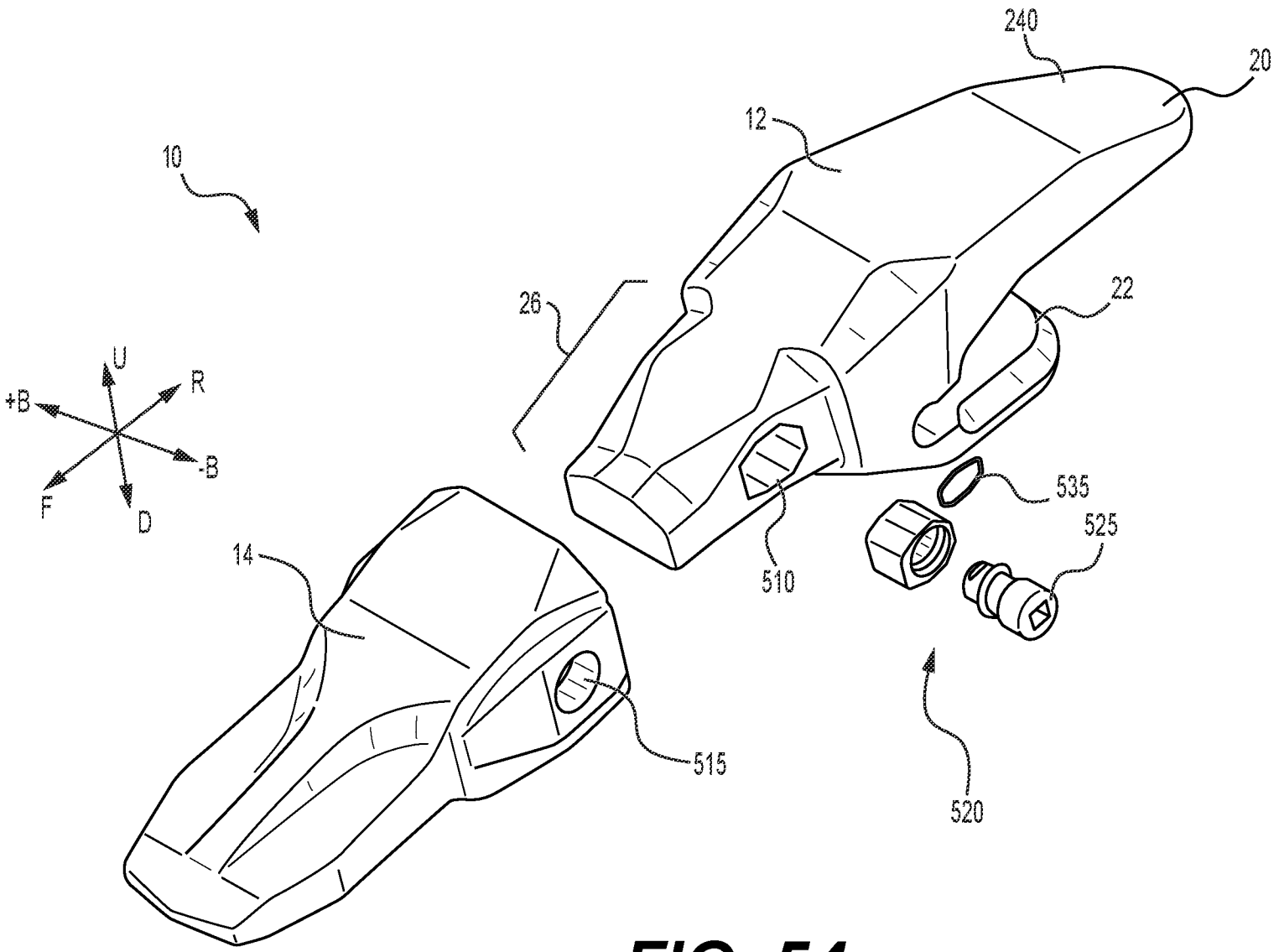
FIG. 54 is an exploded view of an exemplary tip assembly with an exemplary retention mechanism.

FIG. 54 is an exploded view illustrating components of an exemplary tip assembly 10. Tip assembly 10 may include an adapter 12 configured for attachment to a base edge, such as the base edge 108 of the implement 100 (FIGS. 1 and 2), and a ground engaging tip 14 configured for attachment to the adapter 12. The tip assembly 10 may further include a retention mechanism 500 for securing the ground engaging tip 14 to the adapter 12. Retention mechanism 500 may be an exemplary embodiment of retention mechanism 13. The retention mechanism 500 may comprise a retainer 525, a retainer block 530, and a spring 535. Adapter 12 may include a cutout 510 to allow for installation of retainer block 530. Ground engaging tip 14 may include an opening 515, such as a thru hole, to allow for installation of retainer 525 into retainer block 530 when ground engaging tip 14 is connected to adapter 12. Once attached to the adapter 12, the ground engaging tip 14 may extend outwardly from a base edge, such as the base edge 108 of the implement 100, for initial engagement with work material.

Figure 56:
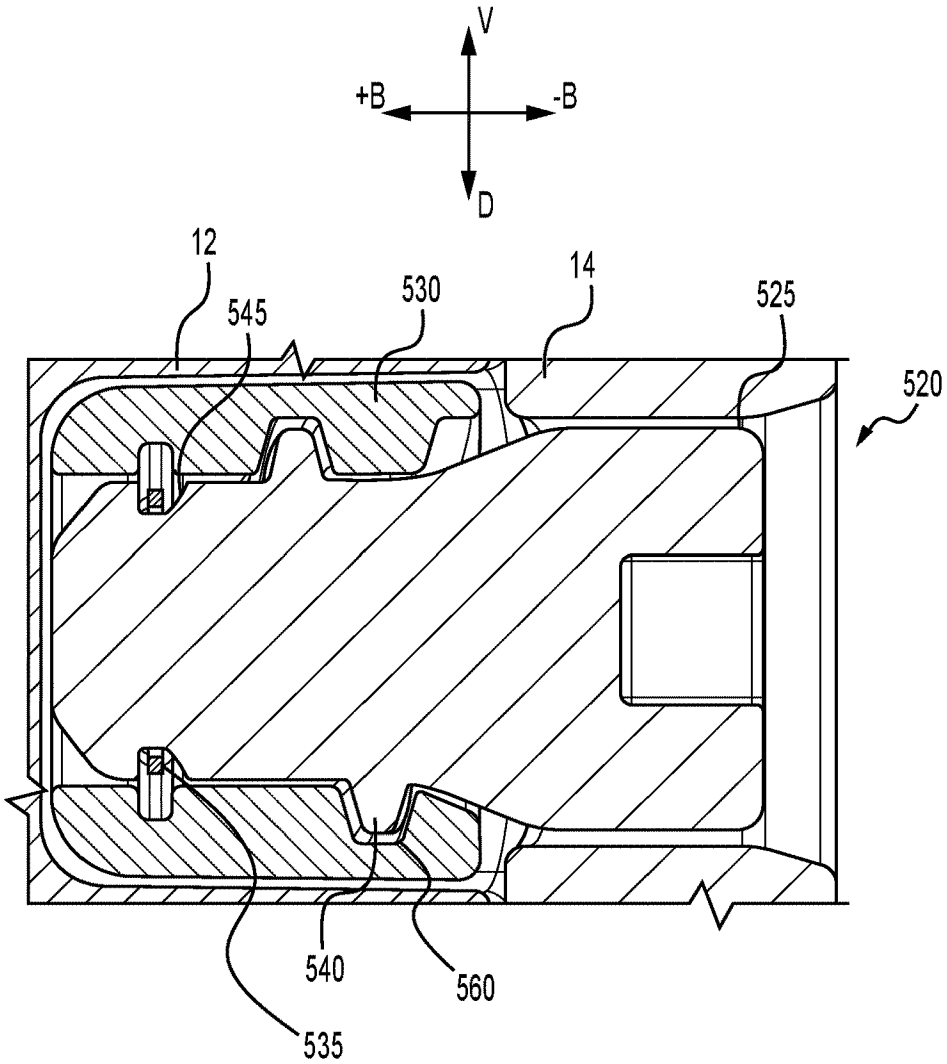
FIG. 56 illustrates a cross-sectional view of the retention mechanism along line F-F as shown in FIG. 55 in accordance with the present disclosure.
Figure 55:
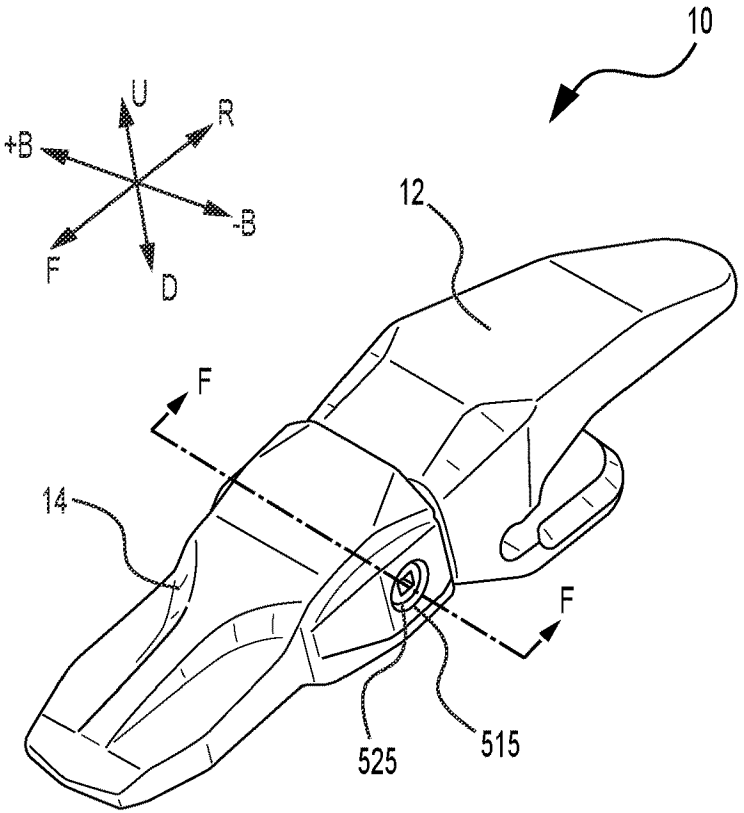
FIG. 55 depicts a perspective view of an exemplary tip assembly with the retention mechanism installed in accordance with the present disclosure.

FIG. 55 depicts the tip assembly 10 with the retention mechanism 520 installed to connect ground engaging tip 14 with adapter 12. FIG. 56 depicts a cross-sectional view of retention mechanism 520, taken along the line F-F as depicted in FIG. 55. As illustrated in FIG. 56, retainer 525 may be installed within retainer block 530 and spring 535 may be engaged within detent cutouts 545 of retainer 525. Internal thread 560 of retainer block 530 may be fully interconnected with thread 540 of retainer 525 to prevent linear movement of retainer 525 within retainer block 530. As depicted in FIG. 56, spring 535 may no longer be deflected and may be locked within detent cutouts 545. When in the locked position as depicted in FIG. 56, detent cutouts 545 may interact with spring 535 to prevent rotation of retainer 525 during use of the bucket assembly 1 (see FIGS. 1 and 2).

INDUSTRIAL APPLICABILITY

Tip assemblies 10 in accordance with the present disclosure incorporate features that may extend the useful life of the tip assemblies 10. The design of the tip assemblies 10 in accordance with the present disclosure provides various surfaces and surface angles on the nose 26 and symmetrical nose 27 of the adapter 12 and corresponding surfaces and surface angles in the nose cavity 126 and symmetrical nose cavity 127 of the tip 14 that work together to provide various advantages including increased contact area between the tip 14 and adapter 12, reduced stress on the adapter 12 and tip 14, increased frictional force between the tip 14 and adapter 12 during loading, increased stability to the tip assemblies 10 during loading, reduced relative motion between the tip 14 and adapter 12, more even distribution of wear through the tip assembly 10, reduced load on the retention mechanism 13, reduced force required for remove of tip 14 from adapter 12, and reduced volume of nose 26 of adapter 12 with added strength. While the discussion below focuses primarily on the various surfaces and surface orientations of the nose 26 and symmetrical nose 27, a person of skill understands that it is the combination of the relevant surfaces of the nose 26 and or symmetrical nose 27 as they interact with the corresponding surfaces in the nose cavity 126 or symmetrical nose cavity 127 when the tip 14 is installed on the adapter 12 that provide the described advantages.

Tip assemblies 10 in accordance with the present disclosure provide increased contact area between the tip 14 and adapter 12. For example, when the tip assembly 10 used, it can be subjected to loads in various directions. When a downward load is applied to the tip assembly 10, a significant portion of the load is experienced by the front portion 48 of the top surface 46 of the nose 26 or symmetrical nose 27 of the adapter 12. Because as seen in FIG. 10, the front portion 48 may comprise three distinct surfaces (a front central surface 49 and two front side-sloping surfaces 50) at varying angles, the total contact area of the front portion 48 with the corresponding front inner portion 148 of the top inner surface 146 of the nose cavity 126 or symmetrical nose cavity 127 of the tip 14, as seen in FIGS. 24 and 32, is greater than if the front portion 48 and corresponding front inner portion 148 were limited to a single surface. Similarly, with respect to the asymmetrical adapter 12, the relative orientations of the rear rib portion 78, rear rib side surfaces 82, and shoulder surfaces 72 of the bottom surface 66, as seen in FIG. 11, which will also experience a significant portion of the download, results in a contact area with the corresponding surfaces of the bottom inner surface 166 of the nose cavity 126 of the tip 14, as seen in FIG. 26, that is greater than if the bottom surface 66 and corresponding bottom inner surface 166 consisted of a single surface.

When an upward load is applied to the tip assembly 10, a significant portion of the load is experienced by the rear portion 52 of the top surface 46 of the nose 26 or symmetrical nose 27 of the adapter 12, shown in FIG. 10. More specifically, the rear central surface 53 and rear bowtie-shaped surfaces 56 will experience a significant load. Because the rear central surface 53 and rear bowtie-shaped surfaces 56 may be oriented at differing angles, the total contact area with the corresponding surfaces of the top inner surface 146 of the nose cavity 126 or symmetrical nose cavity 127 of the tip 14, as shown in FIGS. 24 and 32, is greater than if the top surface 46 and corresponding top inner surface 146 consisted of a single surface.

When a transverse load is applied to the tip assembly 10, the load is shared by several surfaces of the nose 26 or symmetrical nose 27 with a transverse profile, as shown in FIG. 8, including the front side-sloping surface 50, front bowtie-shaped surface 55, rear bowtie-shaped surface 56, front and intermediate side surfaces 61, 62, rear side surface 63, and (with respect to the nose 26) rib side surface 80. Because these surfaces are oriented at varying angles, the total contact area between the nose 26 or symmetrical nose 27 and corresponding surfaces of the nose cavity 126 or symmetrical nose cavity 127 of the tip 14, shown in FIGS. 21 and 29, is greater than if the transverse profile of the nose 26 or symmetrical nose 27 consisted of a single surface.

When a push-on load is applied to the tip assembly 10, the load is shared by several surfaces of the nose 26 or symmetrical nose 27 with a profile in the front view of FIG. 9 or FIG. 16, for example front surface 36, rear central surface(s) 53, front bowtie-shaped surfaces 55, rear side surfaces 63, and (with respect to the asymmetrical adapter 12) front rib portion 76, rear rib portion 78, and rib side surfaces 80. Because these surfaces are oriented at varying angles, the total contact area between the nose 26 or symmetrical nose 27 and corresponding surfaces of the nose cavity 126 or symmetrical nose cavity 127 of the tip 14, as shown in FIGS. 22 and 30, is greater than if the front profile of the nose 26 or symmetrical nose 27 consisted of a single surface.

The increased contact area between the nose 26 or symmetrical nose 27 of the adapter 12 and the nose cavity 126 or the symmetrical nose cavity 127 of the tip 14 described above reduces the stress on the adapter 12 and tip 14, as compared to the same load applied to an adapter 12 and tip 14 with a smaller contact area.

Tip assemblies 10 in accordance with the present disclosure provide increased frictional force between the tip 14 and adapter 12 during loading. For example, when a downward load is applied to the tip assembly 10, a tip 14 mounted to a nose 26 with a top surface 46 that is sloped downward toward the front of the nose 26 will tend to slide forward. In the tip assembly 10 in accordance with the present disclosure, however, the front portion 48 and rear bowtie-shaped surfaces 56 of the top surface 46 of the nose 26 of the adapter 12 have reduced forward angles as compared to the rear central surface 53 of the top surface 46, as shown in FIGS. 8 and 15. These reduced-angle surfaces increase the frictional force holding the tip 14 in place on the nose 26 or symmetrical nose 27 of the adapter 12 under a downward load.

When an upward load is applied to the tip assembly 10, a tip mounted to a nose 26 with a bottom surface 66 that is sloped upward toward the front of the nose 26 will tend to slide forward. In the tip assembly 10 in accordance with the present disclosure, however, the front portion 68 of the bottom surface 66 (with respect to the nose 26) or the front central surface 49 of the top surface 46 (with respect to the symmetrical nose 27) may have a decreased forward angle as compared to the rear portion 70 of the bottom surface 66 (with respect to the nose 26) or the rear central surface 53 of the top surface 46 (with respect to the symmetrical nose 27). For example, front portion 68 or front central surface 49 may be oriented substantially parallel to substantially longitudinal axis "A", as shown in FIGS. 8 and 15. This configuration increases the frictional force holding the tip 14 in place on the nose 26 of the adapter 12 under an upward load.

When a transverse load is applied to the tip assembly 10, the load is shared by several surfaces of the nose 26 or symmetrical nose 26 with a transverse profile, as shown in FIGS. 8 and 15, including the sloping surface(s) 50, front bowtie-shaped surface(s) 55, rear bowtie-shaped surface(s) 56, front and intermediate side surfaces 61, 62, rear side surface 63, and (with respect to the asymmetrical adapter 12) rib side surface 80. Because these surfaces are oriented at varying angles, the total contact area between the nose 26 or symmetrical nose 27 and corresponding surfaces of the nose cavity 126 or symmetrical nose cavity 127 of the tip 14, shown in FIGS. 21 and 29, is greater than if the transverse profile of the nose 26 or symmetrical nose 27 consisted of a single surface.

Tip assemblies 10 in accordance with the present disclosure provide increased stability to the tip assemblies 10 during loading. For example, when a downward load is applied to the tip assembly 10, front side-sloping surfaces 50 and rear side-sloping surfaces 54 provided on either side of the front central surface 49 and rear central surface 53, as shown in FIGS. 9-10 and 16-17, act as wedging surfaces in combination with the corresponding surfaces of the nose cavity 126 or symmetrical nose cavity 127, increasing the stability of the tip assembly 10 under a downward load. With respect to the asymmetrical adapter 12, the rib side surfaces 80 provided on either side of the bottom rib 74, as shown in FIGS. 9 and 11, similarly act as wedging surfaces in combination with the corresponding surfaces of the nose cavity 126 when a downward load is applied, resulting in improved stability.

When an upward load is applied to the tip assembly 10 with an asymmetrical adapter 12, increased stability is provided by the front portion 68 of the bottom surface 66 in combination with the corresponding surface of the nose cavity 126, which may have a decreased forward angle as compared to the rear portion 70 of the bottom surface 66. For example, front portion 68 may be substantially parallel to substantially longitudinal axis "A", as shown in FIG. 8. Further, with respect to either nose 26 or symmetrical nose 27, rear bowtie-shaped surfaces 56 provided on either side of the rear central surface 53, as shown in FIGS. 9-10 and 16-17, also act as wedging surfaces in combination with the corresponding surfaces of the nose cavity 126 or symmetrical nose cavity 127 when an upward load is applied to the tip assembly, resulting in increased stability.

When a transverse load is applied to the tip assembly 10, front side-sloping surfaces 50, front bowtie-shaped surfaces 55, rear bowtie-shaped surfaces 56, and (with respect to asymmetrical adapter 12) rib side surfaces 80, as shown in FIGS. 8 and 15, for nose 26 and symmetrical nose 27, respectively, act as wedging surfaces in combination with the corresponding surfaces of the nose cavity 126 or symmetrical nose cavity 127, increasing stability by preventing the tip 14 from pivoting around the front of the nose 26 or symmetrical nose 27. Further, the difference in orientation of the front and intermediate side surfaces 61, 62 with respect to the rear side surface 63, as shown in FIGS. 10 and 17, provide additional stability under a transverse load as compared to a nose 26 with a single flat side surface.

When a front load is applied to the tip assembly 10, front side-sloping surfaces 50, front bowtie-shaped surfaces 55, rear bowtie-shaped surfaces 56, rear side surfaces 63, and (with respect to asymmetrical adapter 12) front rib portion 76, rear rib portion 78, and rib side surfaces 80, which are oriented at various angles in the lateral direction, as shown in FIGS. 8 and 15, for nose 26 and symmetrical nose 27, respectively, all act as wedging surfaces in combination with the corresponding surfaces of the nose cavity 126 or symmetrical nose cavity 127, increasing the stability of the tip 14 on the adapter 12.

The increased stability of the tip 14 on the nose 26 or symmetrical nose 27 of the adapter 12 provided by the surfaces described above and their corresponding surfaces in the nose cavity 126 or symmetrical nose cavity 127 of the tip 14, results in reduced relative motion between the tip 14 and adapter 12 under each of the directional loads. Reduced relative motion provides the advantage of spreading the overall wear through the tip assembly 10, thereby increasing the durability of the tip assembly 10. Reduced relative motion also provides the advantage of reducing the load on the retention mechanism 13, which is designed to secure the tip 14 to the adapter 12. Reduced load on the retention mechanism 13 results in increased reliability and durability of the retention mechanism 13 and the tip assembly 10 as a whole.

The rear side surfaces 63 also provide the benefit of a reduced force threshold required to remove the tip 14 from the nose 26 or symmetrical nose 27 of the adapter 12. This is because, as shown in FIGS. 10 and 17, rear side surfaces 63 may be oriented such that a distance between the opposing surfaces increases as they extend rearward. Thus, the rear side surfaces 63 provide a release point during tip removal and lower the overall force needed to remove the tip 14 from the adapter 12.

Additionally, with respect to the asymmetrical adapter 12, the bottom rib 74 of the bottom surface 66, as shown in FIG. 11, and the corresponding bottom channel 174 of the nose cavity 126, as shown in FIG. 22, provide the tip assembly 10 in accordance with the present disclosure a reduced volume of nose 26 of adapter 12 with added strength.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, not impossible. Numerous alternative embodiments could be implemented, using either current technology or technology developed after the filing date of this patent, which would still fall within the scope of the claims defining the invention.

What is claimed is:

1. A ground engaging tip comprising:
- a rear edge;
- a top outer surface extending forward from the rear edge;
- a bottom outer surface extending forward from the rear edge and converging with the top outer surface at a front edge;
- oppositely disposed lateral outer surfaces extending downwardly from the top outer surface to the bottom outer surface;
- an inner surface extending inwardly into the ground engaging tip from the rear edge and defining a nose cavity within the ground engaging tip, the inner surface comprising:
  - a front inner surface,
  - a top inner surface extending rearwardly from the front inner surface toward the rear edge of the ground engaging tip comprising:
    - a front portion proximate the front inner surface comprising a front central surface connecting two opposing front side-sloping surfaces and
    - a rear portion proximate the rear edge comprising a rear central surface connecting two opposing rear side-sloping surfaces,
  - a bottom inner surface extending rearwardly from the front inner surface toward the rear edge of the ground engaging tip, comprising a tapered bottom channel, wherein the tapered bottom channel includes a front channel portion inclined relative to a longitudinal axis of the ground engaging tip at a first angle, and a second channel portion inclined relative to the longitudinal axis at a second angle greater than the first angle, and
  - oppositely disposed side inner surfaces extending downward from the top inner surface to the bottom inner surface.

2. The ground engaging tip of claim 1 wherein the front inner surface is generally planar.

3. The ground engaging tip of claim 1, further including a transition portion extending between the front portion and the rear portion of the top inner surface.

4. The ground engaging tip of claim 1 wherein the front inner surface is oriented substantially parallel to the rear edge.

5. The ground engaging tip of claim 1 wherein the front inner surface is hexagonally shaped.

6. The ground engaging tip of claim 1 wherein a front central surface extends rearward from a top horizontal edge of the front inner surface at a first central angle defined as a relative angle between the front central surface and a front portion of the bottom inner surface, ranging from 0° to 15°.

7. The ground engaging tip of claim 6 wherein the rear central surface extends upward from the front central surface toward the rear edge at a second central angle ranging from 0° to 15° greater than the first central angle.

8. The ground engaging tip of claim 6 wherein the opposing front side-sloping surfaces extend downward from the front central surface toward the side inner surfaces.

9. The ground engaging tip of claim 6 wherein an angle defined by an intersection of the front central surface and front side-sloping surfaces ranges from about 18.5° to 30°.

10. The ground engaging tip of claim 6 wherein the opposing rear side-sloping surfaces extend downward from the rear central surface toward the side inner surfaces.

11. The ground engaging tip of claim 6 wherein a distance between the rear side-sloping surfaces increases and/or decreases over some portion of the top inner surface as a rear central surface extends rearward from the front central surface.

12. The ground engaging tip of claim 11 wherein the distance between the rear side-sloping surfaces both increases over some portion of the top inner surface and decreases over some portion of the top inner surface as the rear central surface extends rearward from the front central surface.

13. The ground engaging tip of claim 12 wherein the distance between the rear side-sloping surfaces increases over a front portion of the rear central surface and decreases over a rear portion of the rear central surface as the rear central surface extends rearward from the front central surface.

14. The ground engaging tip of claim 1 wherein the opposing rear side-sloping surfaces each comprise two generally planar surface oriented at different angles as they extend from a rear central surface to the side inner surfaces.

15. The ground engaging tip of claim 14 wherein the opposing rear side-sloping surfaces have a bowtie shape with a substantially triangular front bowtie-shaped surface and a substantially triangular rear bowtie-shaped surface.

16. The ground engaging tip of claim 15 wherein a first rear side-sloping angle defined by an intersection of the rear central surface and the front bowtie-shaped surface is less than a second rear side-sloping angle defined by the intersection of the rear central surface and the rear bowtie-shaped surface.

17. The ground engaging tip of claim 16 wherein the first rear side-sloping angle ranges from 17.5° to 32.5°.

18. The ground engaging tip of claim 16 wherein the second rear side-sloping angle ranges from 30° to 40°.

19. A ground engaging tip comprising:

a rear edge;

a top outer surface extending forward from the rear edge;

a bottom outer surface extending forward from the rear edge and converging with the top outer surface at a front edge;

oppositely disposed lateral outer surfaces extending downwardly from the top outer surface to the bottom outer surface;

an inner surface extending inwardly into the ground engaging tip from the rear edge and defining a nose cavity within the ground engaging tip, the inner surface comprising:

a front inner surface, a top inner surface extending rearwardly from the front inner surface toward the rear edge of the ground engaging tip comprising:

a front portion proximate the front inner surface comprising a generally planar front central surface connecting two opposing front side-sloping surfaces and a rear portion proximate the rear edge comprising a rear central surface connecting two opposing rear side-sloping surfaces, a bottom inner surface extending rearwardly from the front inner surface toward the rear edge of the ground engaging tip, configured to be symmetrical to the top inner surface across a substantially longitudinal axis, and oppositely disposed side inner surfaces extending downward from the top inner surface to the bottom inner surface.

20. A ground engaging tip assembly comprising:

a ground engaging tip, comprising:

a rear edge;

a top outer surface extending forward from the rear edge;

a bottom outer surface extending forward from the rear edge and converging with the top outer surface at a front edge;

oppositely disposed lateral outer surfaces extending downwardly from the top outer surface to the bottom outer surface;

an inner surface extending inwardly into the ground engaging tip from the rear edge and defining a nose cavity within the ground engaging tip, the inner surface comprising:

a front inner surface including a bottom edge, opposing side edges extending from and disposed generally perpendicular to the bottom edge, and a top edge disposed generally parallel to the bottom edge, a top inner surface extending rearwardly from the front inner surface toward the rear edge of the ground engaging tip comprising:

a front portion proximate the front inner surface comprising a front central surface connecting two opposing front side-sloping surfaces and a rear portion proximate the rear edge comprising a rear central surface connecting two opposing rear side-sloping surfaces, a bottom inner surface extending rearwardly from the front inner surface toward the rear edge of the ground engaging tip, and oppositely disposed side inner surfaces extending downward from the top inner surface to the bottom inner surface;

an adapter comprising a nose portion with a shape corresponding to the inner surface of the ground engaging tip configured to be inserted into the nose cavity of the ground engaging tip; and a retention mechanism configured to secure the ground engaging tip to the adapter.

* * * * *